US011180960B2

(12) United States Patent
Smith

(10) Patent No.: US 11,180,960 B2
(45) Date of Patent: Nov. 23, 2021

(54) HDD REAMER HAVING REMOVABLE CUTTING TEETH

(71) Applicant: Vermeer Manufacturing Company, Pella, IA (US)

(72) Inventor: Jacob Richard Smith, Altoona, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 17/287,752

(22) PCT Filed: Jul. 1, 2020

(86) PCT No.: PCT/US2020/040453
§ 371 (c)(1),
(2) Date: Apr. 22, 2021

(87) PCT Pub. No.: WO2021/003242
PCT Pub. Date: Jan. 7, 2021

(65) Prior Publication Data

US 2021/0310312 A1 Oct. 7, 2021

Related U.S. Application Data

(60) Provisional application No. 62/870,373, filed on Jul. 3, 2019.

(51) Int. Cl.
*E21B 10/26* (2006.01)
*E21B 10/567* (2006.01)
*E21B 7/04* (2006.01)

(52) U.S. Cl.
CPC ..... *E21B 10/26* (2013.01); *E21B 7/046* (2013.01); *E21B 10/567* (2013.01)

(58) Field of Classification Search
CPC ..... E21B 10/26; E21B 7/046; E21B 10/567; E21B 10/56; E21B 7/28; E21B 10/55; E21B 10/46
See application file for complete search history.

(56) References Cited

U.S. PATENT DOCUMENTS 4,662,461 A 5/1987 Garrett
6,926,100 B1 8/2005 Anthony et al.
(Continued)

FOREIGN PATENT DOCUMENTS

CN 105443042 B 7/2018
DE 20201900218 U1 7/2019
(Continued)

OTHER PUBLICATIONS

International Search Report and Written Opinion; PCT/US2020/040453; dated Sep. 9, 2020.
(Continued)

*Primary Examiner* — Caroline N Butcher
(74) *Attorney, Agent, or Firm* — Michael Best and Friedrich LLP

(57) ABSTRACT

A reamer for drill string pullback of a horizontal directional drill includes a shaft portion defining a central axis and a first end configured for attachment with a drill string of the horizontal directional drill. A plurality of vanes extend radially from an outer periphery of the shaft, each of the plurality of vanes defining an outer peripheral tooth base surface. On each of the plurality of vanes, a plurality of cutter teeth are individually and removably secured along the outer peripheral tooth base surface thereof, each one of the plurality of cutter teeth including a body and a PDC insert manufactured separately from the body and joined therewith. Each cutter tooth of the plurality is coupled to the respective one of the plurality of vanes by a removable fastener extending at least partially through the cutter tooth
(Continued)

and at least partially through the one of the plurality of vanes.

17 Claims, 39 Drawing Sheets

(56) References Cited

U.S. PATENT DOCUMENTS

| | | | | |
|---|---|---|---|---|
| 8,201,647 | B2 | 6/2012 | Zulak | |
| 10,926,268 | B2 | 2/2021 | Daining et al. | |
| 11,045,814 | B2 | 6/2021 | Daining et al. | |
| 2010/0175927 | A1 | 7/2010 | Zulak | |
| 2014/0305708 | A1 | 10/2014 | Gunsaulis | |
| 2015/0069160 | A1 | 3/2015 | Roozeboom et al. | |
| 2015/0211304 | A1* | 7/2015 | Thomas | E21B 10/567 175/406 |
| 2020/0222999 | A1 | 7/2020 | Curry, Jr. | |

FOREIGN PATENT DOCUMENTS

| | | | | |
|---|---|---|---|---|
| WO | 2014110253 | A1 | 7/2014 | |
| WO | 2016/001815 | A1 | 1/2016 | |
| WO | WO-2018222436 | A1 * | 12/2018 | E21B 10/633 |
| WO | 2019/157167 | A2 | 8/2019 | |
| WO | 2021003242 | A1 | 1/2021 | |

OTHER PUBLICATIONS

D E. Scott, "The History and Impact of Synthetic Diamond Cutters and Diamond Enhanced Inserts on the Oil and Gas Industry," Hughes Christensen (Texas).

Vermeer, "Barrel Reamer with replaceable teeth, Fly Cutter Reamer with replaceable cutters, Pipe Reamer", Product Information, available at least as early as Sep. 28, 2020, (3 Pages).

Mills Machine Company, "Drag Type Horizontal Reamer", webpage: https://www.environmental-expert.com/products/mills-machine-drag-type-horizontal-reamer-523122, available at least as early as Sep. 28, 2020, (2 Pages).

* cited by examiner

HDD REAMER HAVING REMOVABLE CUTTING TEETH

BACKGROUND

The present invention relates to horizontal directional drills (HDD) that form underground passages (e.g., for utilities installation) and to reamers that attach to HDD's for reaming drilled passages during pullback operation of the HDD.

SUMMARY

In one aspect, the invention provides a reamer for reaming an underground passage during a drill string pullback operation of a horizontal directional drill. A shaft portion defines a central axis and having a first end configured for attachment with a drill string of the horizontal directional drill. A plurality of vanes extend radially from an outer periphery of the shaft portion, each of the plurality of vanes defining an outer peripheral tooth base surface. On each of the plurality of vanes, a plurality of cutter teeth are individually and removably secured along the outer peripheral tooth base surface thereof, and each one of the plurality of cutter teeth includes a body and a polycrystalline diamond compact (PDC) insert manufactured separately from the body and joined therewith. Each cutter tooth of the plurality of cutter teeth is coupled to the respective one of the plurality of vanes by a removable fastener extending at least partially through the cutter tooth and at least partially through the one of the plurality of vanes.

In another aspect, the invention provides a reamer for reaming an underground passage during a drill string pullback operation of a horizontal directional drill. A shaft portion defines a central axis and has a first end configured for attachment with a drill string of the horizontal directional drill. A plurality of vanes extend radially outward from an outer periphery of the shaft portion, each of the plurality of vanes defining an outer peripheral tooth base surface. On each of the plurality of vanes, a plurality of cutter teeth are individually and removably secured along the outer peripheral tooth base surface thereof. Each cutter tooth of the plurality of cutter teeth has a first mounting surface configured to engage the outer peripheral tooth base surface and has a second mounting surface configured to engage an additional tooth support surface adjacent the outer peripheral tooth base surface. Each cutter tooth of the plurality of cutter teeth is coupled to the respective one of the plurality of vanes by a removable fastener extending at least partially through the cutter tooth and at least partially through the vane.

In yet another aspect, the invention provides a cutter for a directional drilling reamer, the cutter defining a mounting interface for attachment with one of a plurality of support vanes of the reamer. A body is formed of a first material and has front, rear, top, bottom, left, and right sides. One or more cutting inserts include a cutting material dissimilar from the first material of the body and secured to the front side of the body, the one or more cutting inserts defining a forward-facing normal surface vector. A first mounting surface extends along a bottom of the body and is configured to mate with a generally circumferential support surface on one of the plurality of support vanes. A second mounting surface of the body is provided at a forward end of the first mounting surface and extending away from the first mounting surface in a direction away from the top side of the body, perpendicular to the first mounting surface. A mounting aperture extends through one of the first and second mounting surfaces. The normal surface vector of the one or more cutting inserts is offset from a reference line perpendicular to the second mounting surface as viewed from the bottom to define a non-zero side rake angle. The normal surface vector of the one or more cutting inserts is offset from the first mounting surface as viewed from the side to define a non-zero back rake angle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
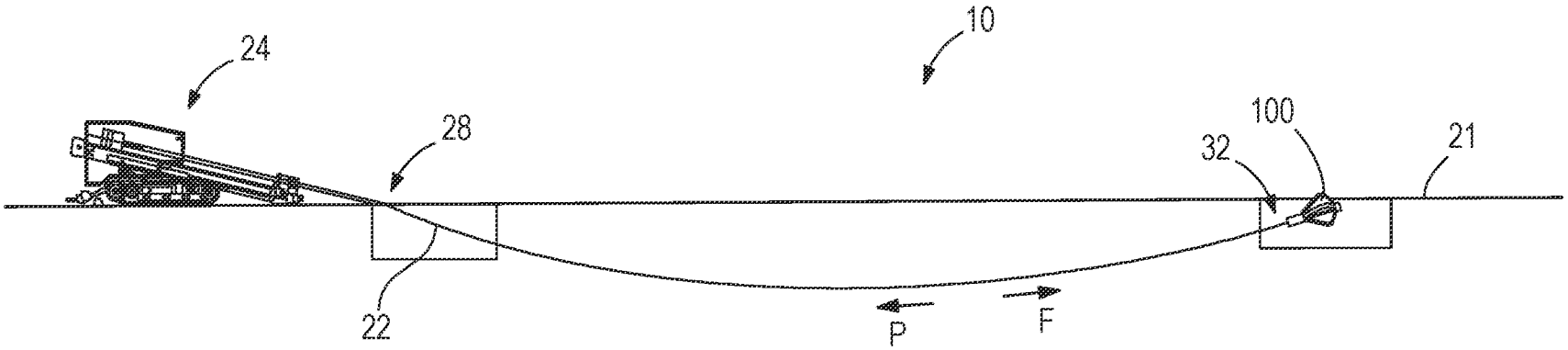
FIG. 1 is a schematic side view of a directional drilling system including a drilling machine, a drill string, and a reamer according to one embodiment of the present disclosure.
Figure 2:
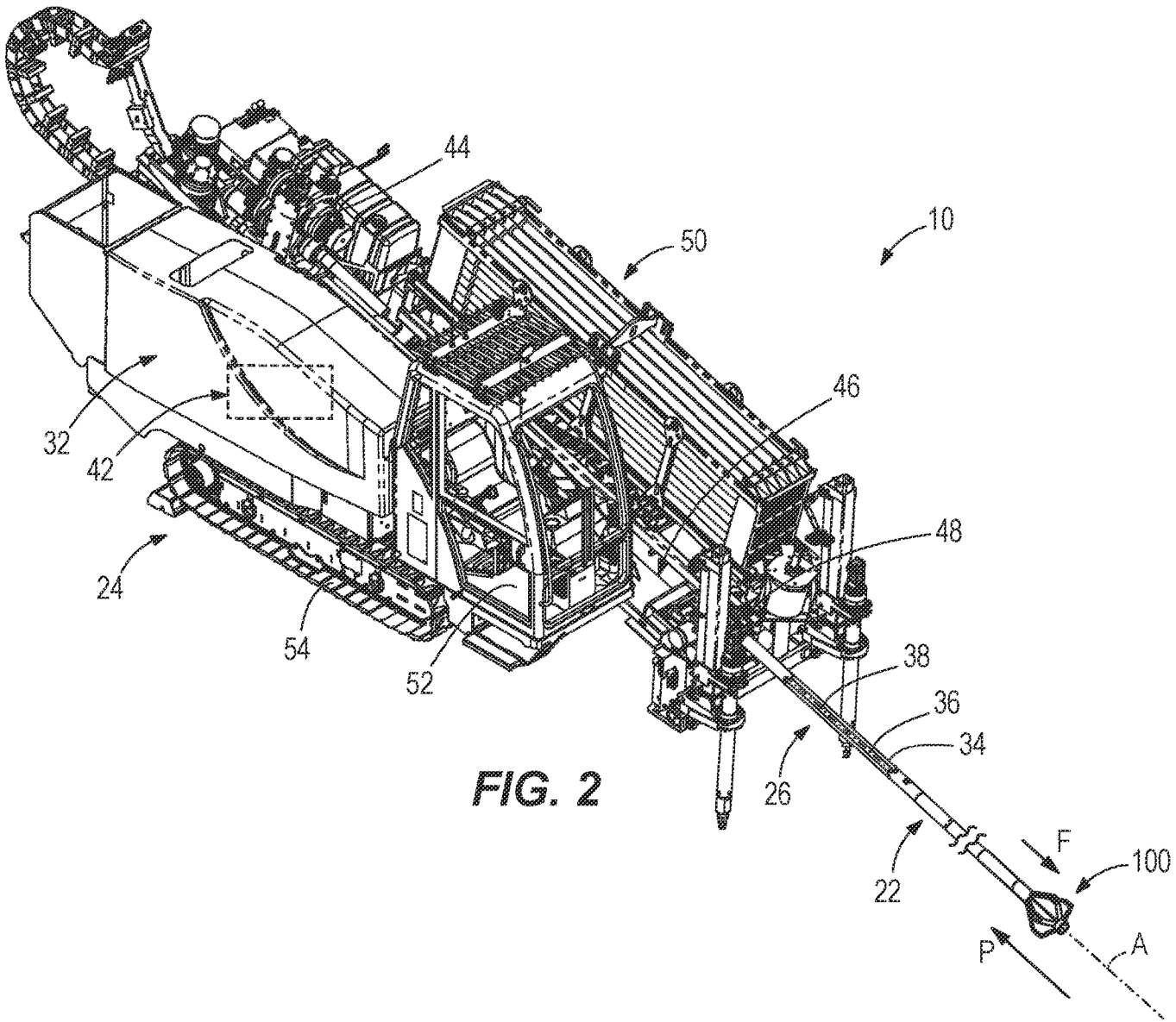
FIG. 2 is a perspective view of the drilling system of FIG. 1.

FIGS. 1 and 2 illustrate a horizontal directional drilling (HDD) system 10 including a drilling machine 24 operable to penetrate a sequentially-formed drill string (from a series of connectable drill rods) underground. The drilling system 10 includes a drill string 22 that is directed into the ground 21 by the drilling machine 24. An example drill string 22 is shown in FIG. 1. The drilling machine 24 includes a prime mover 42 (e.g., a diesel engine), gearbox 44, a rack 46, and a break out mechanism 48 (e.g., a vise system). Optionally, the drilling machine 24 can include a drill rod storage box 50, an operator's station 52, and a set of tracks or wheels 54. The drill string 22 consists of individual sections of drill rod assemblies 26 that are connected to the drilling machine 24 at an uphole end 28 and a drill head (not shown) at a downhole end 32. Each drill rod assembly 26 includes a downhole end and an uphole end. The drill rod assemblies 26 are strung together end-to-end to form the drill string 22, which can extend significant distances in some drilling applications.

In a dual rod drilling system, each drill rod assembly 26 includes an outer tubular drill rod 34 having external threads on one end and internal threads on the opposite end. Each drill rod assembly 26 further includes a smaller, inner drill rod 36. The inner drill rod 36 fits inside the tubular outer drill rod 34. As an alternative to a dual rod drilling system, rock can be drilled and reamed with single rod machines with use of air hammers, mud motors or even soft rock bits. The inner drill rod 36 of each drill rod assembly is interconnected to the adjacent inner drill rods by an inner rod coupling 38. In some examples, each inner rod coupling 38 is affixed to each inner drill rod 36 at the uphole end of each drill rod assembly 26. A coupler is not required for threaded inner rods.

During a drilling operation, the drilling machine 24 individually removes drill rod assemblies 26 from the drill rod storage box 50 and moves each drill rod assembly 26 onto the rack 46. Once positioned on the rack 46, both the break out mechanism 48 and the gearbox 44 engage the drill rod assembly 26 and couple the drill rod assembly with an immediately preceding downhole drill rod assembly 26. Once coupled, the gearbox 44 is configured to travel longitudinally on the rack 46 toward the break out mechanism 48, while simultaneously rotating one or both of the outer and inner drill rods 34, 36 of the drill rod assembly 26. When the gearbox 44 reaches the break out mechanism 48 at the end of the rack 46, the gearbox 44 is de-coupled from the drill rod assembly 26, and thereby the drill string 22, and retracts up the rack 46 so that another drill rod assembly 26 can be added to the drill string 22. This process is repeated until the drilling operation is complete, and then reversed during a pullback operation in which the drilling machine 24 removes the drill rod assemblies 26 from the ground 21 (i.e., direction P). A reaming assembly or reamer 100 can be attached to the drill string 22 upon completion of pilot hole drilling so that the underground drilled passage is reamed by the reamer 100 during pullback. In other words, the leading end of the reamer 100 faces the drilling machine 24 when connected to the drill string 22 for use. This is the normal direction for reaming, although the description below further addresses one or more reamers configured for push reaming (away from the drilling machine, opposite the pullback direction P). The term "hole opener" is also used in the field of horizontal directional drilling, and also refers to a reamer as used herein. A hole opener or "rock reamer" may sometimes be used to designate a reamer configured to cut through ground consisting at least partially of rock, whereas other reamers may be better suited for softer ground. Aspects of the present disclosure can apply to many if not all current styles of HDD reamers as well as those not yet conceived.

FIGS. 3A to 3H better illustrate the reamer 100. The reamer 100 is an assembly that includes a shaft or shaft portion 104 defining a central rotational axis A (to be aligned with the central axis of the drill string 22), a plurality of vanes 108 raised radially from an outer surface of the shaft portion 104, and a plurality of removable and replaceable cutter teeth 112, 114 mounted onto the plurality of vanes 108. In some constructions, the vanes 108 are monolithically formed with the shaft portion 104 (e.g., machined from a single billet of steel or other metal). In other constructions, the vanes 108 are separately formed from the shaft portion 104 and permanently affixed thereto, e.g., by welding. In either case, the shaft portion 104 and the vanes 108 form a reamer base or body for supporting the various cutter teeth 112, 114. Each cutter tooth 112, 114 is removably coupled to the respective vane 108 via one or more fasteners 116 to orient cutting tips or features 118 (e.g., polycrystalline diamond compact (PDC) inserts) for reaming an underground hole (i.e., a pre-drilled pilot hole) upon rotation of the drill string 22 with the reamer 100 during pullback of the drill string 22 in the direction P toward the drilling machine 24. PDC inserts can be manufactured separately from a cutter tooth body portion 113, 115 of the respective cutter teeth 112, 114 and joined therewith, such as by bonding (e.g., brazing) and/or pressing. The body portion 113, 115 can include a pocket that receives a portion of the cutting features 118. Front faces and forward edges of the cutting features 118 are left exposed or protruded from the body portion 113, 115. The front face of each cutting feature 118 defines a normal surface vector N, discussed in further detail below. As illustrated, each vane 108 supports seven first cutter teeth 112 and one second or transition cutter tooth 114. All of the cutter teeth 112, 114 include PDC cutting features 118, which are described in additional detail below. The fastener(s) 116 for each cutter tooth 112, 114 can be a threaded bolt. The fastener(s) 116 for each cutter tooth 112, 114 can extend with a radially inward component through a through hole in the cutter tooth body toward the axis A and into the vane 108. As shown in the reamer 100, and applicable to the other reamers disclosed herein, there are five evenly-spaced vanes 108 about the circumference of the shaft portion 104, and each vane 108 has a row of multiple (e.g., axially-aligned) cutter teeth 112, 114 mounted thereon—although the reamer can be modified to have alternate numbers and/or arrangements of vanes 108 and respective cutter teeth 112, 114. Because the cutter teeth 112, 114 are individually mounted and replaceable independently, damage or wear to certain cutting features 118 need not be met with replacement of an entire vane 108 or worse yet, the entire reamer 100. Instead, only the cutter teeth 112, 114 having wear or damage can be replaced, and this can be accomplished quickly and simply in the field, leading to low cost and minimum downtime.

Each vane 108 has a first angled surface 122 oriented at an angle α (e.g., less than 90 degrees, and in some embodiments a non-zero angle of 75 degrees or less) from the axis A and defining a first tooth base surface. The first tooth base surface 122 increases in radius away from a first end 104A of the shaft portion and toward a second end 104B of the shaft portion 104. A plurality of first cutter teeth 112 are mounted to the first tooth base surface 122. Each vane 108 further has a second surface or plateau surface extending from a radially outer end of the first tooth base surface 122 to define a second tooth base surface 124. The second tooth base surface 124 can be parallel to the axis A, or at least less angled with respect to the axis A than the angle α of the first tooth base surface 122. A single second cutter tooth 114 on each vane 108 is a transition cutter tooth that resides on the second tooth base surface 124 and also extends onto the outermost portion of the first tooth base surface 122. A further angled surface 126 extends from the second tooth base surface 124 to the outer surface of the shaft portion 104. In some embodiments, the surface 126 forms a steeper angle (e.g., over 45 degrees) than the angle α of the first tooth base surface 122.

The PDC cutting features 118 of the first and second cutter teeth 112, 114 have a generally cylindrical shape or "wafer," at least on the exposed or outside portions thereof. Although this is typical for PDC cutting features due to manufacturing processes, other PDC cutting features may be used that are only partially cylindrical (e.g., semi-cylindrical sections) or non-cylindrical. The PDC material is a composite comprising synthetic diamond grit formed (i.e., sintered) into a diamond table with tungsten carbide and metallic binder. The diamond table is a thin layer that forms the front face of the cutting feature 118 that contacts the formation to be reamed. The diamond table is supported on a substrate of the cutting feature 118. The substrate can be tungsten carbide with metallic binder. The front faces (e.g., flat, circular surfaces) of the PDC cutting features 118 are generally oriented toward a tangential cutting direction T. However, each of the cutting features 118 is in fact provided so that the normal surface vector N is angled or skewed so as to not be directly aligned with the tangential cutting direction T. The normal surface vector N has a (non-zero) side rake angle Θ (FIG. 3A) configured to move material in a direction relative to the longitudinal axis of the reamer 100, and a (non-zero) back rake angle Φ (FIG. 3C) configured to move material in the radial direction. These rake angles are described further below with respect to FIGS. 4 and 5. The side rake angle Θ can be 0 degrees to 30 degrees, or more particularly, 10 degrees to 20 degrees, e.g., 15 degrees. The back rake angle Φ can be 0 degrees to 30 degrees, or more particularly, 10 degrees to 30 degrees, e.g., 15 degrees. Greater side rake and back rake angles Θ, Φ increase cutter life, but lead to less aggressive (slower) cutting. In particular, a larger back rake angle Φ allows more forgiving shearing of the rock with less chance to chip or damage the cutting feature 118, and a larger side rake angle Θ accommodate the forward motion of the reamer without wearing the back sides. Lower side rake and back rake angles Θ, Φ have the inverse relationship. Due to the individually replaceable nature of the cutter teeth 112, 114, some or all of the cutter teeth can be swapped on the reamer body for similar cutter teeth that have an alternate side and/or back rake angle (e.g., simply by the non-destructive removal and replacement of the fastener(s) 116). In this way, a reamer assembly can be modified, either at an equipment preparation location or even directly at the drilling site, to have rake angles for specific types of ground conditions. Although not shown, the vanes 108 can be angled and/or tilted relative to the tangential direction T of rotation, and the vanes 108 can be straight or curved. Although the cutter teeth 112, 114 may still have non-zero side and/or back rake angles, these may be adjusted or lessened in the presence of angled and/or tilted vanes 108. Because the reamer 100 operates in a pilot hole, its cutting features 118 do not extend to the central axis like a drill bit, but rather are spaced radially outward.

Figure 3B:
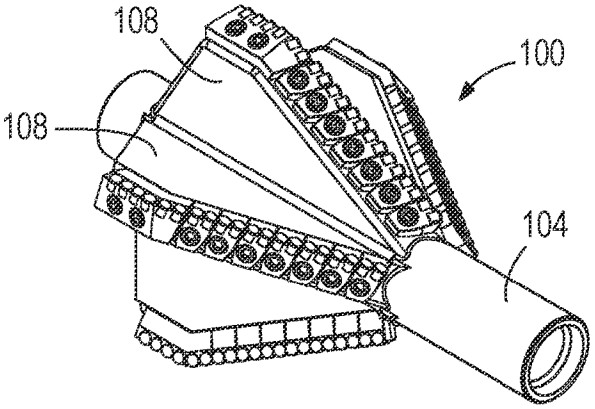
FIGS. 3A to 3H illustrate the reamer of FIGS. 1 and 2.
Figure 3A:
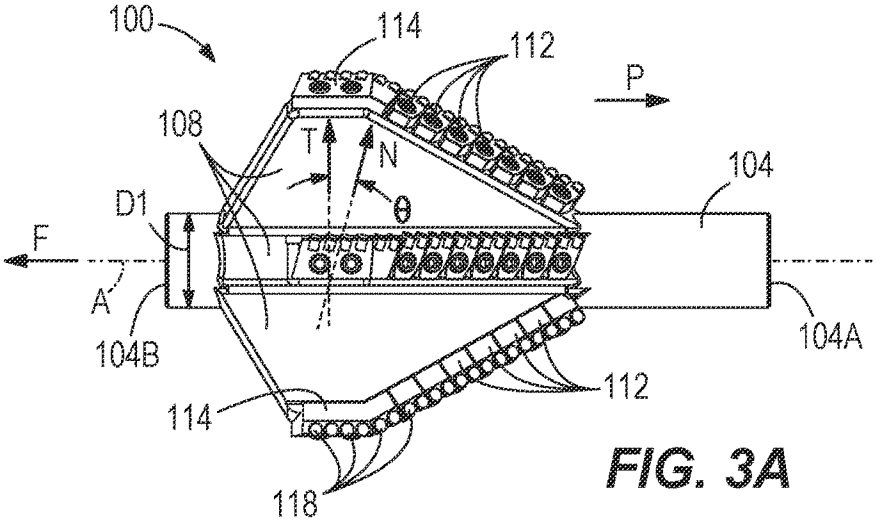
Figure 3E:
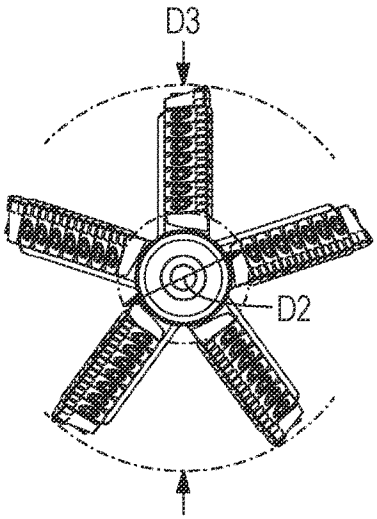
Figure 3D:
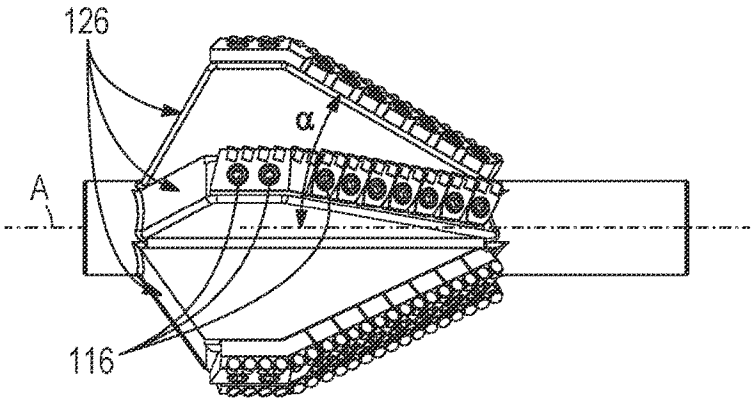
Figure 3C:
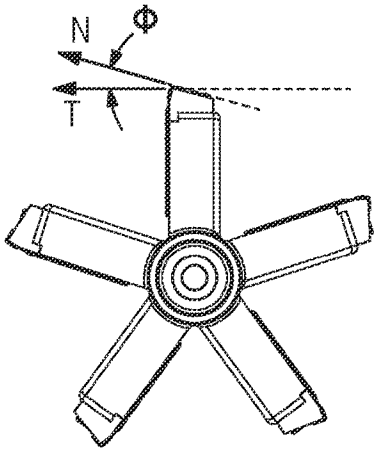
Figure 3F:
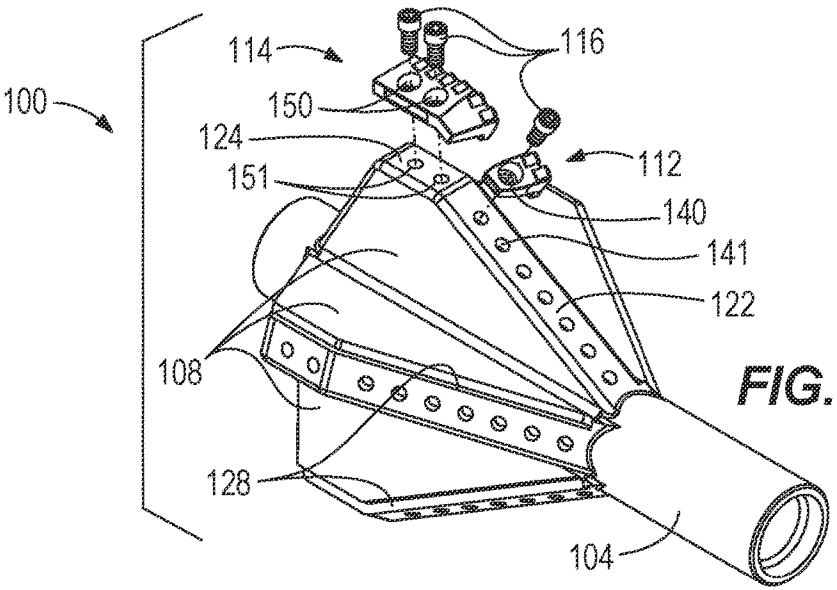
Figure 3H:
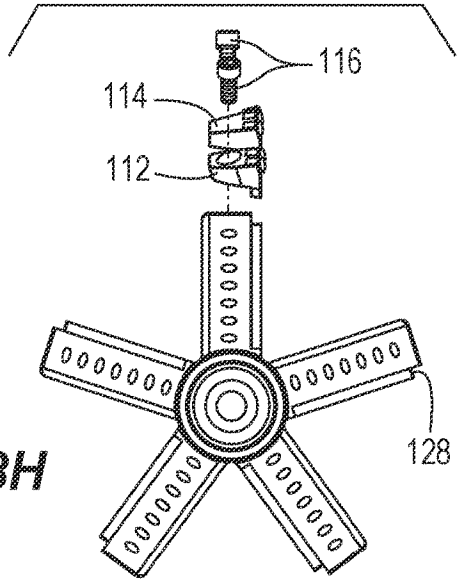
Figure 3G:
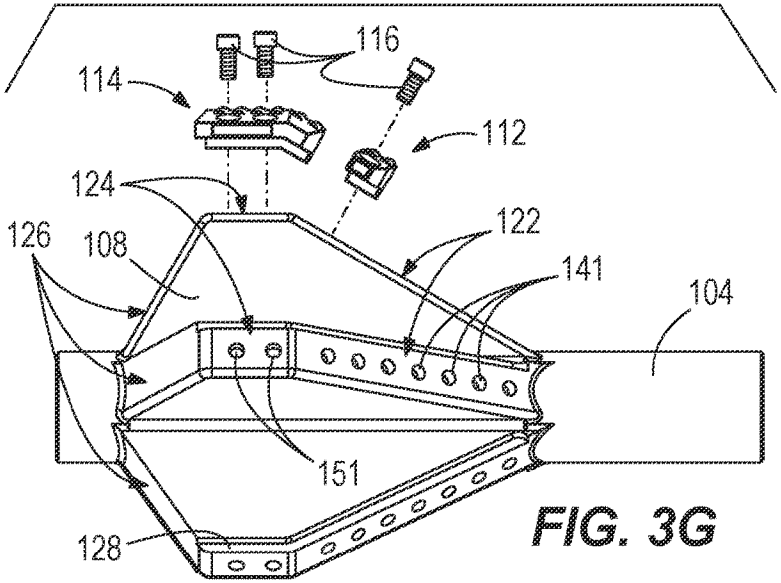

As shown in the exploded assembly views of FIGS. 3F to 3H, a leading radially-outer edge of each vane 108 is provided with an axially-extending notch or recess providing an additional cutter tooth support surface 128. The surface 128 faces the tangential direction T and provides support to back surfaces 132 of radially-inward extending flanges or feet 134 of the respective first cutter teeth 112, which are better illustrated in FIGS. 4A to 4G. Similarly, the second cutter teeth 114 (FIGS. 5A to 5G) also include radially-inward extending flanges or feet 144 having respective back surfaces 142 that abut the support surfaces 128 of the respective vanes 108. In the cases of both cutter teeth 112, 114, the back surfaces 132, 142 are oriented perpendicular to respective bottom surfaces 136, 138 that mate with the radially outer tooth base surfaces 122, 124. Although the back surfaces 132, 142 and the bottom surfaces 136, 138 are each flat, the second or transition cutter tooth 114 further has an additional or secondary bottom surface 139 that is angled with respect to the bottom surface 138 to match the angle between the first tooth base surface 122 and the second tooth base surface 124, and the additional bottom surface 139 (e.g., absent any fastener aperture) is configured to engage the outermost portion of the first tooth base surface 122. The flange or foot 134, 144 in each case forms a boss protruding from a plane(s) defined by the bottom surface(s) 136, 138, 139.

Figure 4A:
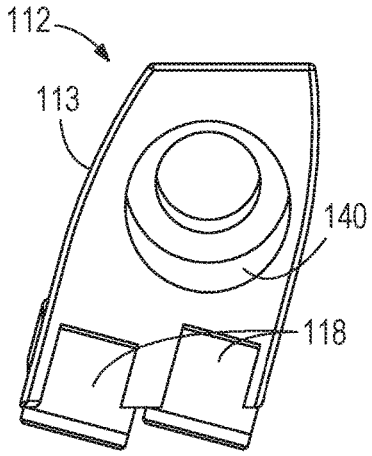
FIGS. 4A to 4G illustrate a first type of removable cutter tooth of the reamer of FIGS. 3A to 3H.
Figure 4B:
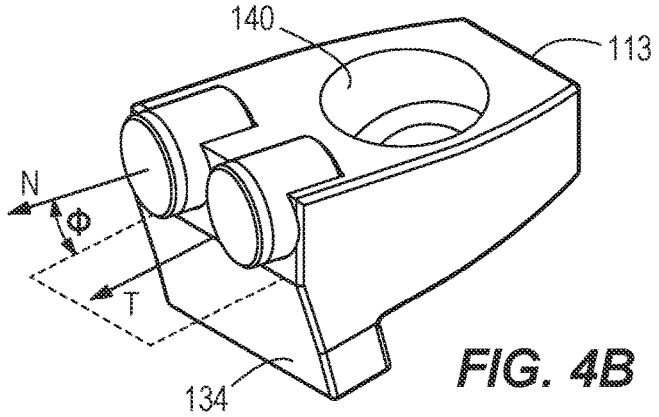
Figure 4C:
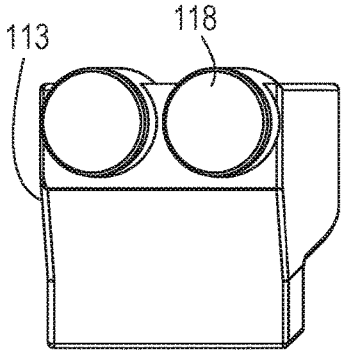
Figure 4D:
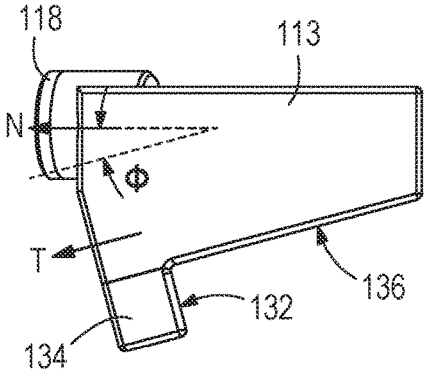
Figure 4E:
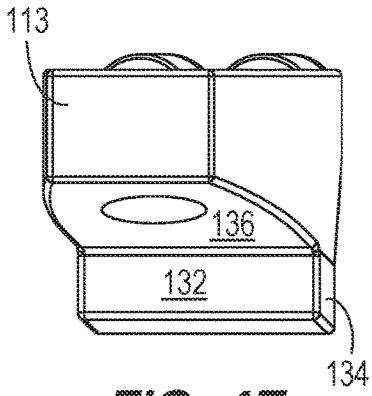
Figure 4F:
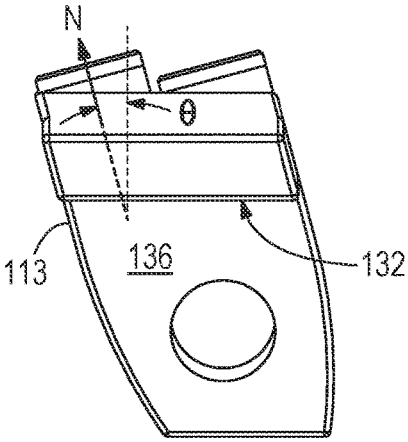
Figure 4G:
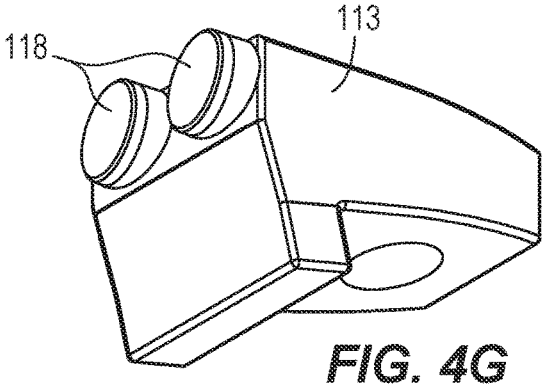
Figure 5A:
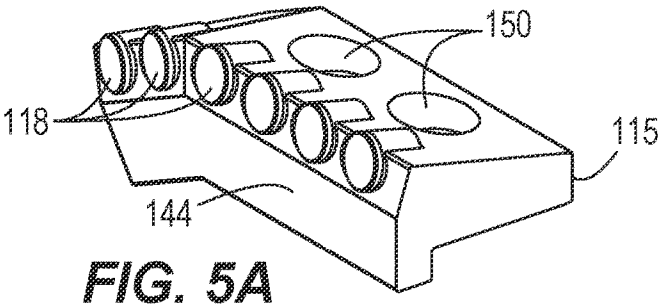
FIGS. 5A to 5G illustrate a second type removable cutter tooth of the reamer of FIGS. 3A to 3H.
Figure 5E:
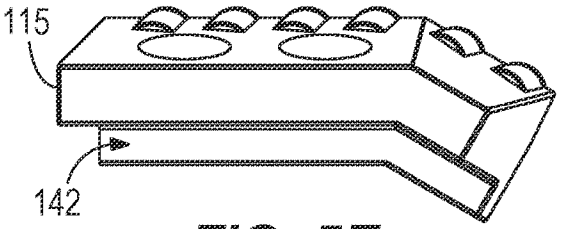
Figure 5G:
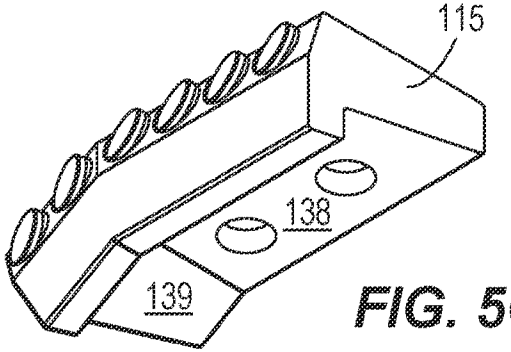
Figure 5D:
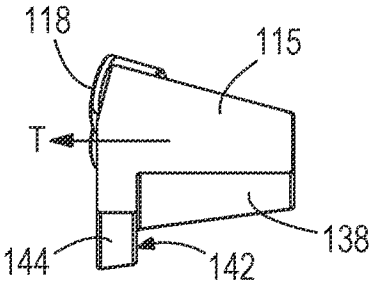
Figure 5B:
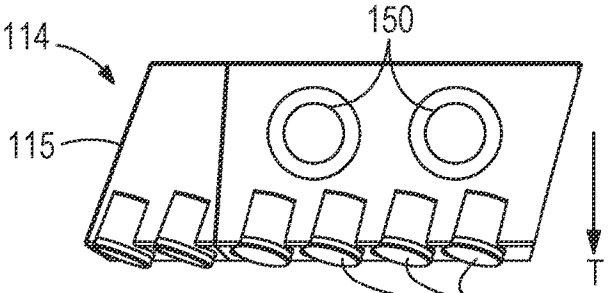
Figure 5C:
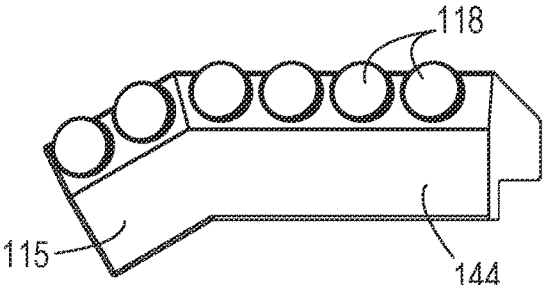
Figure 5F:
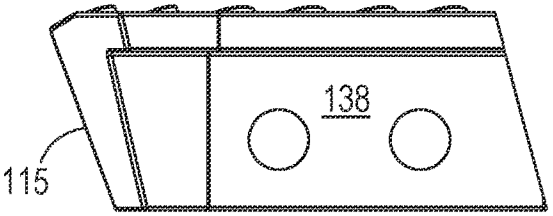
Figure 6A:
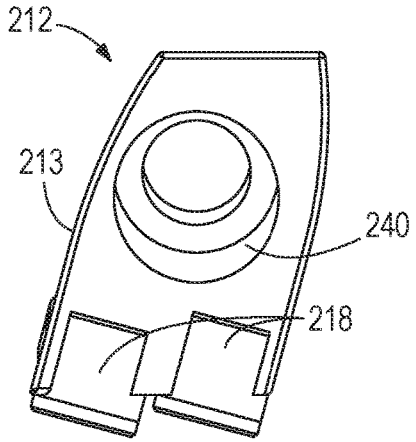
FIGS. 6A to 6G illustrate a first type of removable cutter tooth of second and third reamers shown in FIGS. 7A to 7H and 8A to 8E.
Figure 6B:
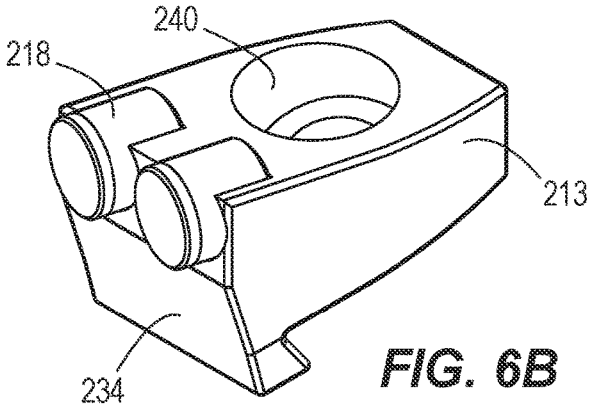
Figure 6C:
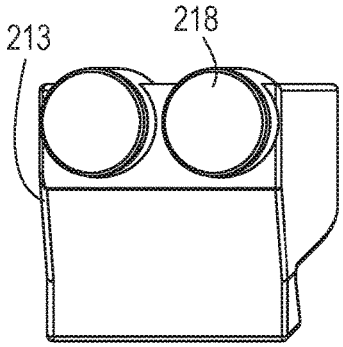
Figure 6D:
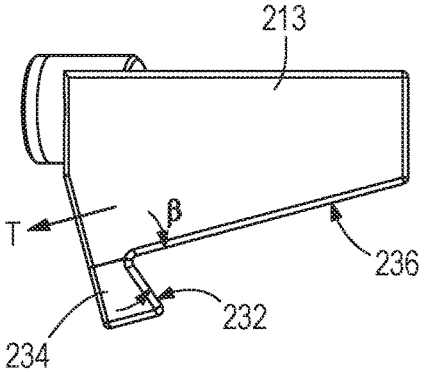
Figure 6E:
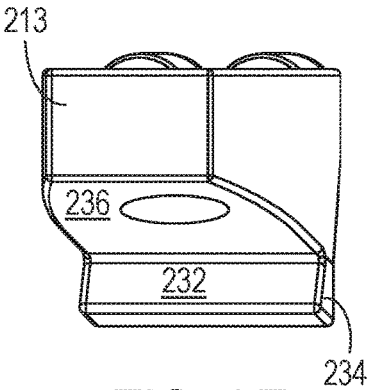
Figure 6F:
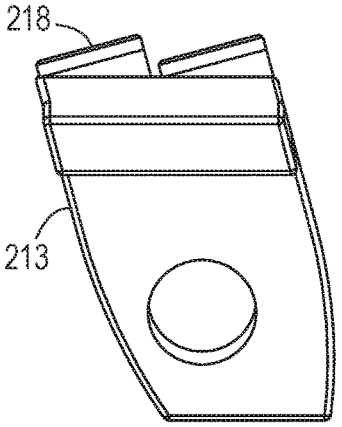
Figure 6G:
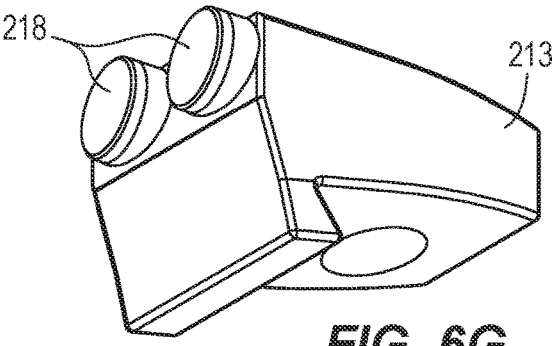
Figure 7B:
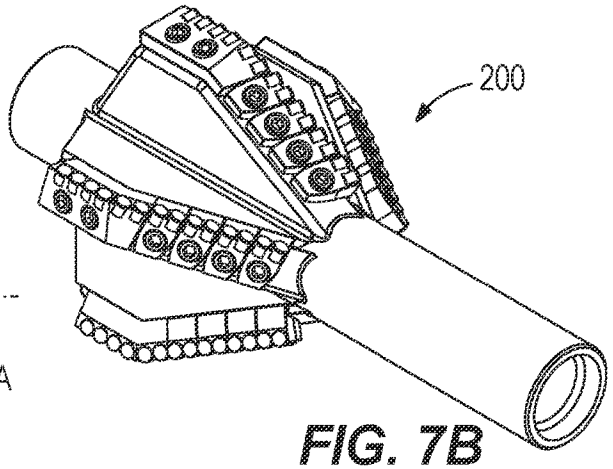
FIGS. 7A to 7H illustrate a reamer of a second embodiment that is similar to the reamer of FIGS. 3A to 3H, but having a reduced size and number of cutter teeth.
Figure 7A:
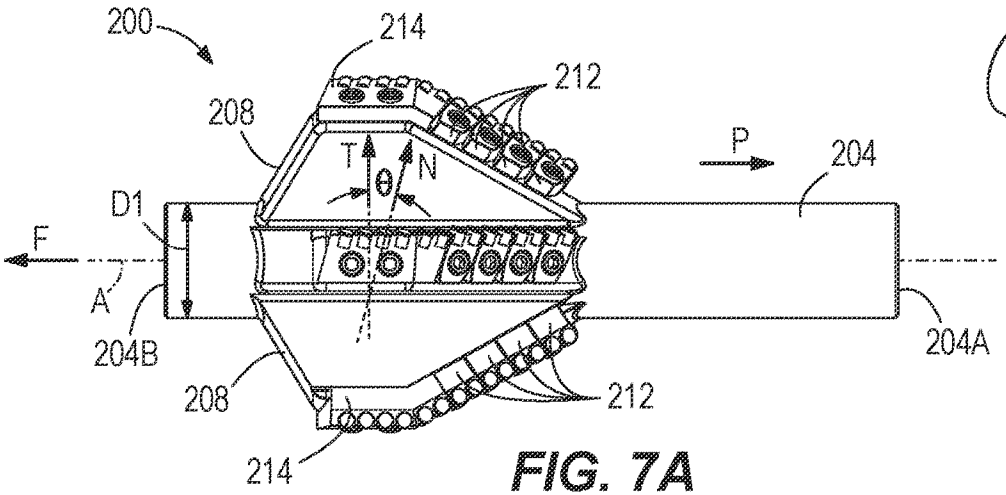
Figure 7E:
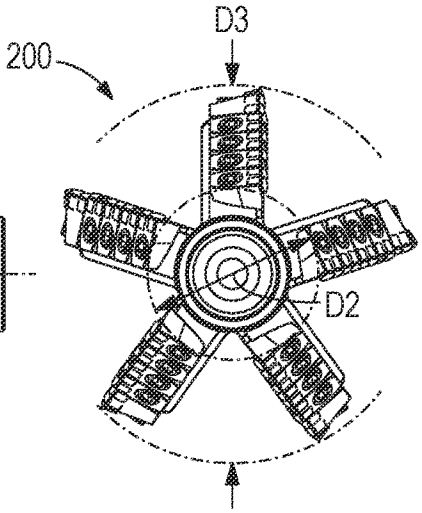
Figure 7D:
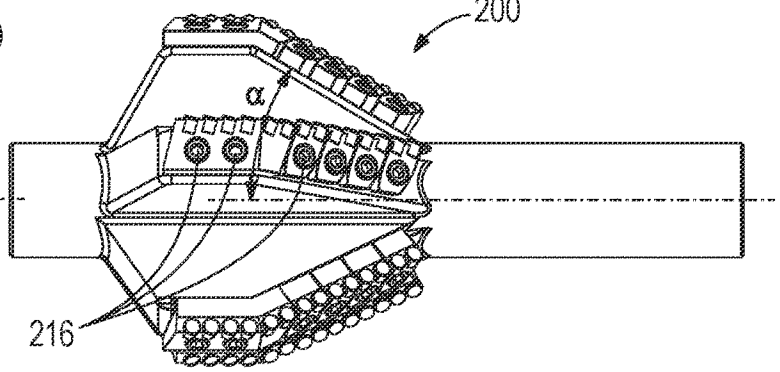
Figure 7C:
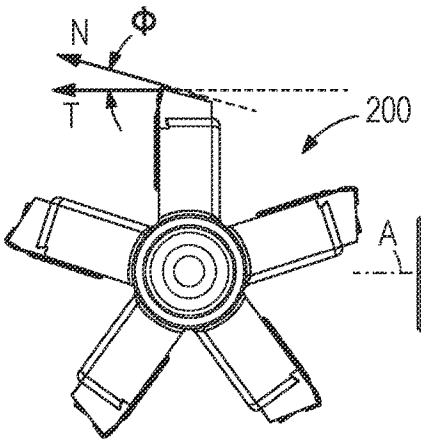
Figure 7F:
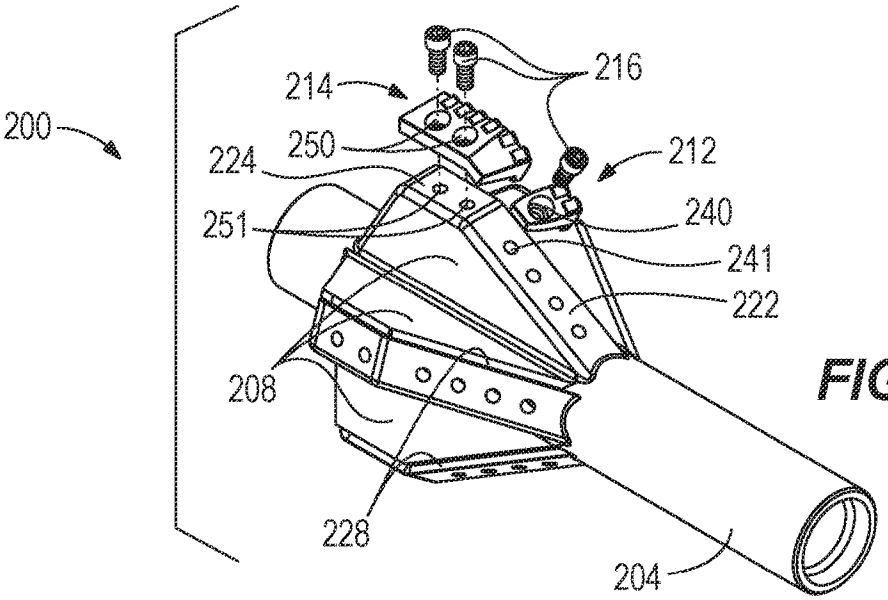
Figure 7H:
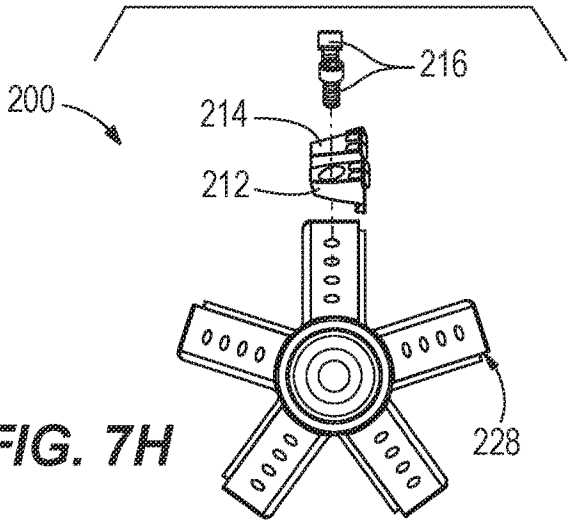
Figure 7G:
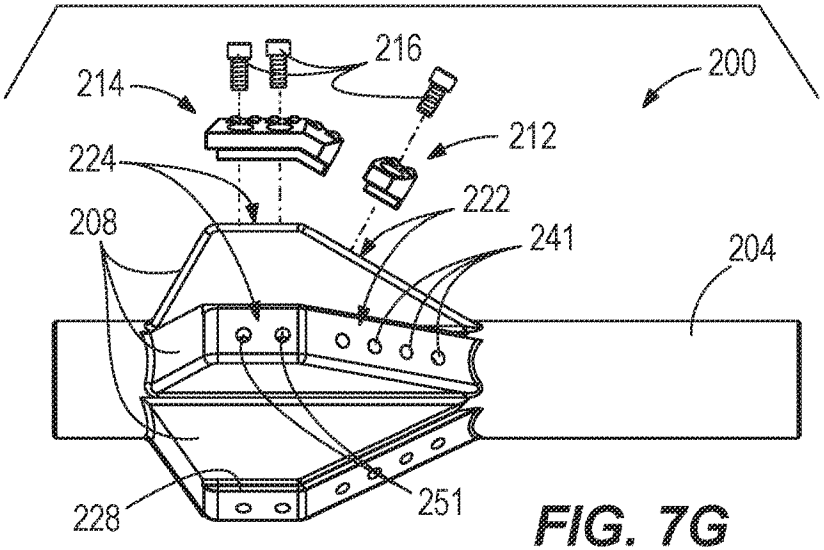
Figure 8B:
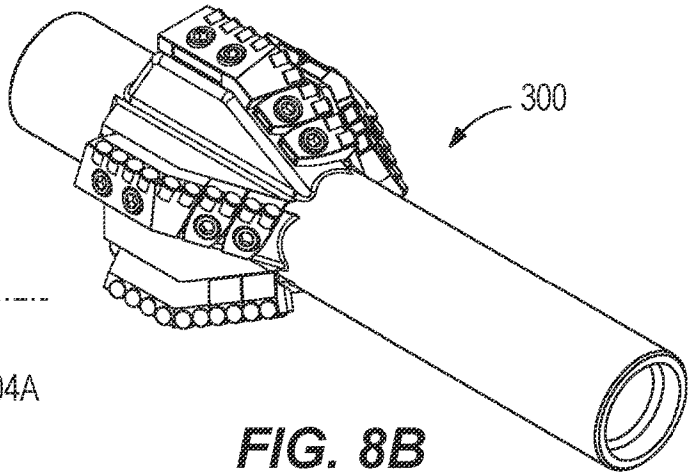
FIGS. 8A to 8E illustrate a third reamer that is similar to the reamers of FIGS. 3 and 7, but having a further reduced size and number of cutter teeth.
Figure 8A:
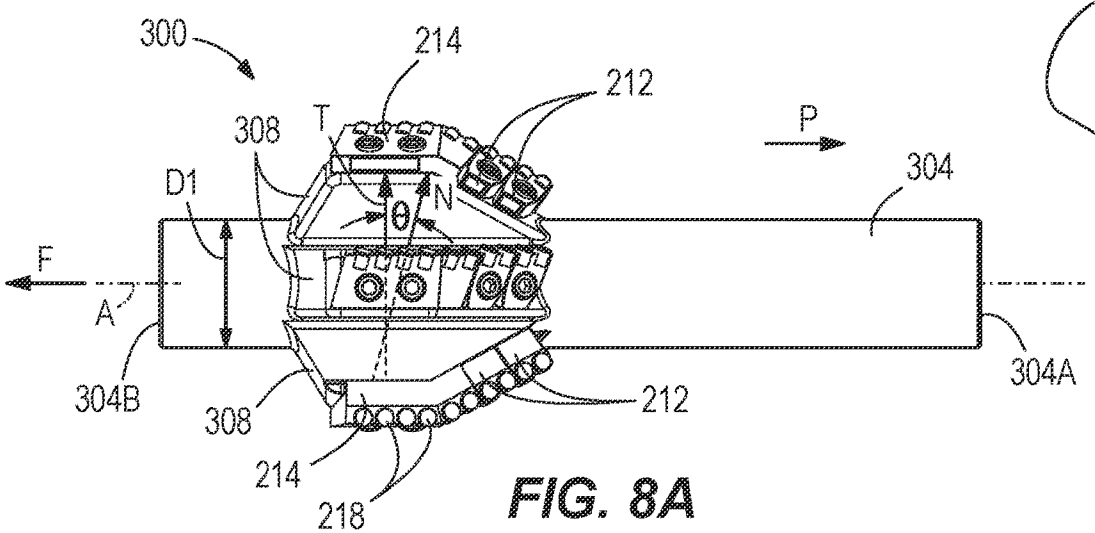
Figure 8E:
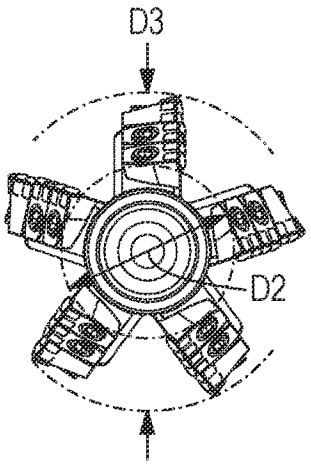
Figure 8D:
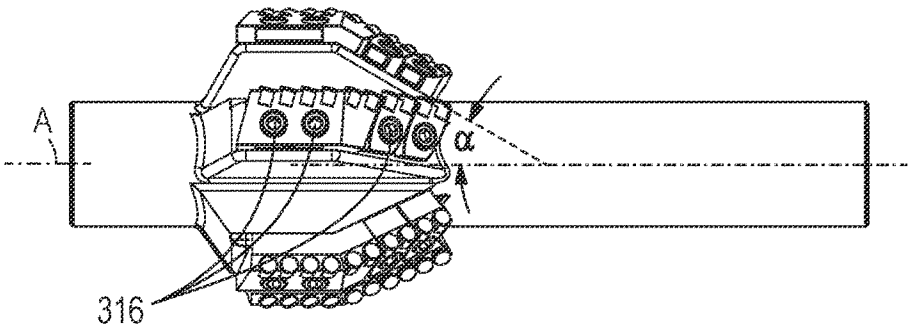
Figure 8C:
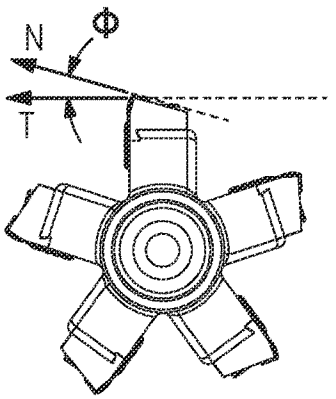

Returning to the rake angles of the cutting features 118, the side rake angle Θ can be defined as the angle formed between the normal surface vector N and a reference line perpendicular to the back surface 132 as viewed from below in FIG. 4F, in which the viewing plane is along the front cutting surface of the cutting features 118. The reference line here may represent a plane perpendicular to the back and bottom surfaces 132, 136. As such, the plane contains the tangential cutting direction T. The same relationships may apply for the side rake angle Θ of the cutter 114 of FIG. 5, in which case directional reference is taken from the back surface 142. The back rake angle Φ is the angle formed between the normal surface vector N and a reference line perpendicular to the back surface 132 as viewed from the side (see FIG. 4D, although it is noted that the view is arranged such that the normal surface vector N has a component into the page). The reference line here may represent a plane (FIG. 4B) perpendicular to the back surface 132 and parallel to the bottom surface 136. As such, the plane contains the tangential cutting direction T. The same relationships may apply for the side rake angle Θ of the cutter 114 of FIG. 5, in which case directional reference is taken from the surface(s) 138, 142. Although the normal surface vector N for only one cutting feature 118 is illustrated, it will be understood that the two cutting features 118 have parallel normal surface vectors N, and this may be the case, even where more cutting features 118 are provided in a single cutter tooth 112. In the case of a cutter tooth like the cutter tooth 114 of FIG. 5, all the cutting features 118 within each defined segment or body portion may define parallel normal surface vectors, with the cutting features 118 of the separate body portions having the respective side and back rake angles defined in relation to the back surface 142 and the separate bottom surfaces 138, 139.

Countersunk apertures 140, 150 in the respective cutter teeth 112, 114 receive the heads of the respective fasteners 116 that connect the cutter teeth 112, 114 to the vanes 108. In the case of the first cutter tooth 112, there is a single countersunk aperture 140 that extends through the bottom surface 136. Each aperture 140 aligns with a corresponding threaded aperture 141 (e.g., blind hole) in the first tooth base surface 122. In the case of the second cutter tooth 114, there are a plurality of countersunk apertures 150 (e.g., two) that extend through the bottom surface 138. The apertures 150 align with corresponding threaded apertures 151 (e.g., blind holes) in the second tooth base surface 124. Although not shown in the illustrated construction, the reamer 100 may have ports/jets for within the reamer base (shaft portion 104 and/or vanes 108) for discharging drilling fluid to facilitate cutting and removal of cuttings. A minimum cutting diameter D2 (FIG. 3E) is defined by the innermost circumscribed circle of the cutting feature 118 nearest the shaft portion 104 on the first one of the first cutter teeth 112 on each of the vanes 108 in the pullback direction P. As shown, the minimum cutting diameter D2 is slightly larger than the outer diameter D1 of the shaft portion 104. However, it is possible to position cutter teeth such that cutting features are adjacent the outer diameter D1 of the shaft portion 104, or even countersunk into the shaft portion 104 (e.g., by machining a groove into the shaft portion 104). A maximum cutting diameter D3 (FIG. 3E) is defined by the outermost circumscribed circle of the cutting feature 118 furthest from the shaft portion 104 on the second cutter tooth 112 on each of the vanes 108. The maximum cutting diameter D3 is larger than the outer diameter D1 of the shaft portion 104 (e.g., D3=m*D1, where m is a factor 2 or above, and less than 5). The factor m is between 3.5 and 4.0 as illustrated.

FIGS. 6A to 6G illustrate an alternate first cutter tooth 212 that is similar in most regards to the first cutter tooth 112. For example, the cutter tooth 212 can include a steel body 213 and a plurality of (e.g., two) forward-facing cutting features 218 (e.g., PDC inserts). The cutter tooth 212 can further include a radially-inward extending flange or foot 234 along with a bottom surface 236 and a countersunk aperture 240 extending through the cutter body and the bottom surface 236 to receive a fastener 216. However, the cutter tooth 212 of FIGS. 6A to 6G includes adjacent mounting surfaces 232, 236 that, in combination with a complementary vane notch (see for example vanes 208, 308 of FIGS. 7A to 7H and FIGS. 8A to 8E), form a half-dovetail interface or joint. The back surface 232 of the radially-inward extending flange or foot 234 forms a less-than-90-degree angle β with the bottom surface 236. In the illustrated construction, both surfaces 232, 236 are flat surfaces.

Figure 9:
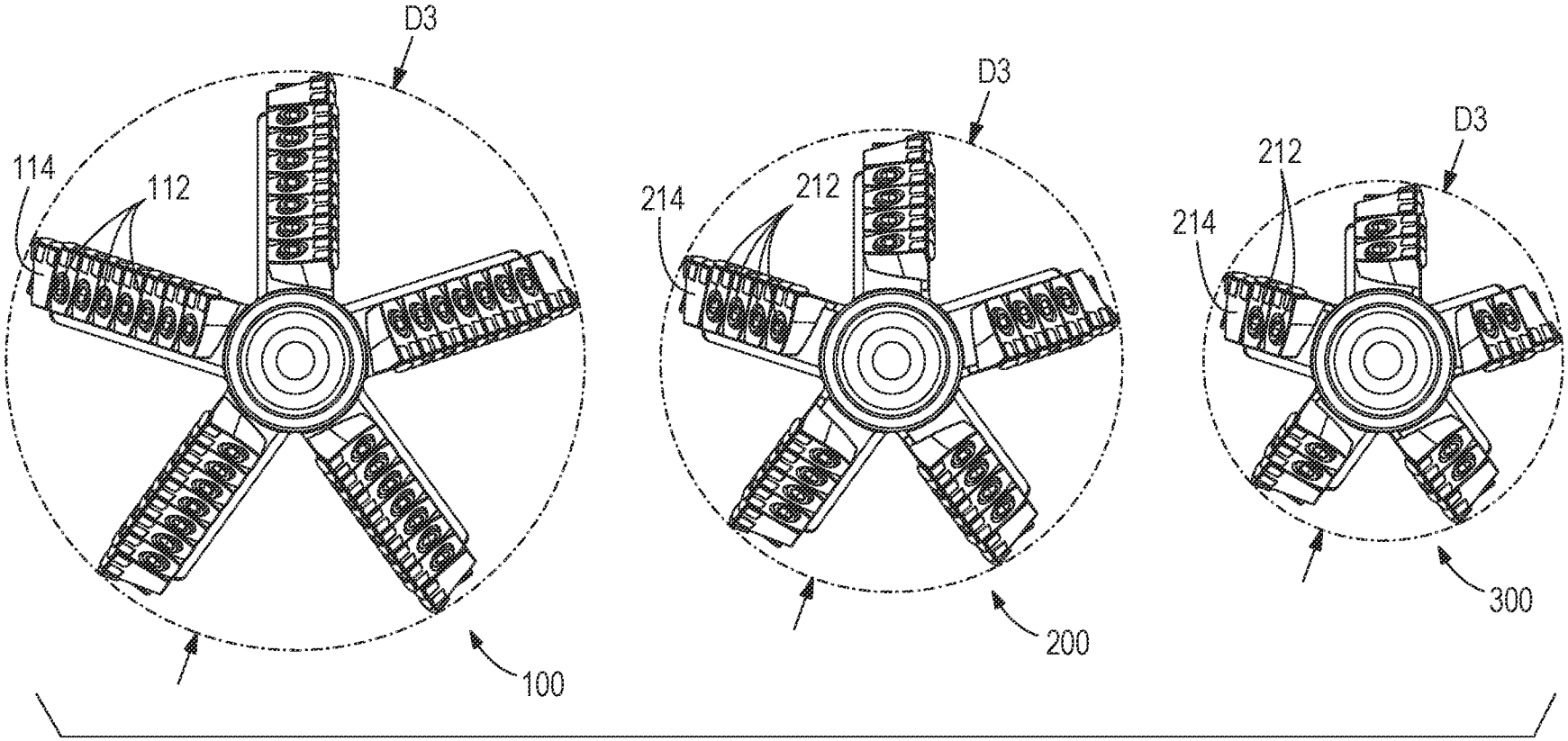
FIG. 9 illustrates an end view of the reamer of FIGS. 3A to 3H alongside two similar but differently-sized reamers of FIGS. 7 and 8.
Figure 10A:
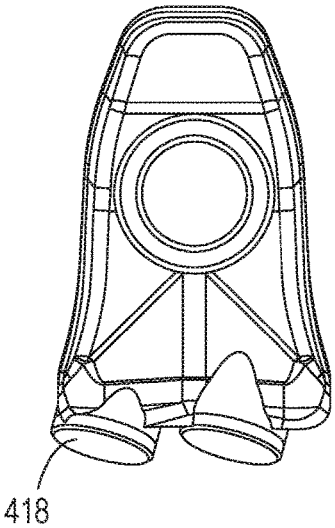
FIGS. 10A to 10G illustrate a first type of removable cutter tooth of a fourth reamer shown in FIGS. 11A to 11H.
Figure 10B:
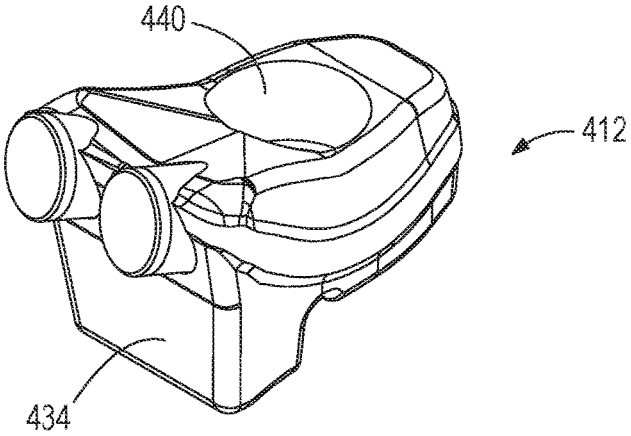
Figure 10C:
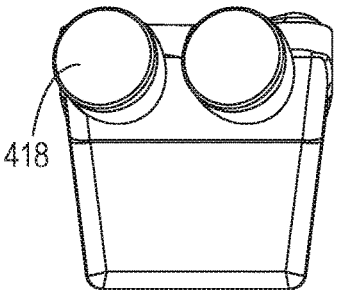
Figure 10D:
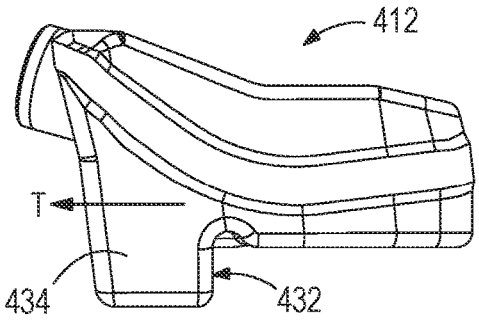
Figure 10E:
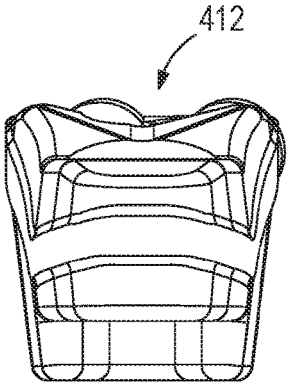
Figure 10F:
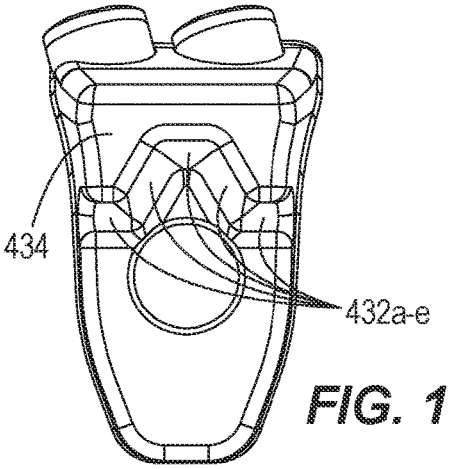
Figure 10G:
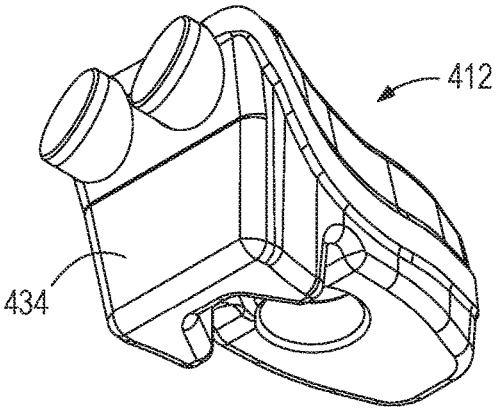

In the reamer 200 of FIGS. 7A to 7H, four of the first cutter teeth 212 are provided on each vane 208. The vanes 208 are thus smaller in size (e.g., in both length along axis A and radius from axis A) as compared to the vanes 108 of the reamer 100 having the seven first cutter teeth 112 per vane. Each vane 208 of the reamer 200 also includes one second or transition cutter tooth 214 on each vane 208. Although not separately illustrated in its own figure set, the second cutter tooth 214 can be identical to the second cutter tooth 214 with the exception of having an acute angle β formed by the bottom and back surfaces for making a half-dovetail joint with the notch or recess providing the additional cutter tooth support surface 228. Unlike the additional cutter tooth support surface 128, which faces in the tangential direction T, the additional cutter tooth support surface 228 faces "downward," or radially-inward, with respect to the tangential direction T. Due to the smaller size of the vanes 208, the reamer defines a maximum cutting diameter D3 that is substantially smaller than the maximum cutting diameter of the reamer 100 (see FIGS. 7E and 9). With the exception of the features noted above, the first and second reamers 100, 200 are otherwise similar, and it should be noted that other features of 100 described above may apply also to the second reamer 200 (where applicable, reference numbers are maintained consistent, although incremented from the 100's to the 200's). It is also noted that the half-dovetail cutter-to-vane interface of the reamer 200 can be used in the first reamer 100, and the square cutter-to-vane interface of the reamer 200 can be used in the second reamer 200 in alternate embodiments. In general, features amongst all the disclosed embodiments may be exchanged or otherwise put together in different combinations from those explicitly disclosed.

The reamer 300 of FIGS. 8A to 8E is an example of another reamer that is similar in most regards to the first and second reamers 100, 200, although providing yet another configuration of cutter teeth and different maximum cutting diameter D3. Again, where applicable, reference numbers are maintained consistent with those established in the description of the first reamer 100, with incrementing to the 300's, and features not reiterated are understood to conform to the above description. As compared to the vanes 208 of the second reamer 200, the vanes 308 of the third reamer 300 are again reduced in size, and again a reduced number of first cutter teeth 212 are provided (e.g., two). However, owing to the vanes 208, 308 having identical notches, the cutter teeth 212, 214 are the same as those in the second reamer 200, and the cutter teeth 212, 214 can even be exchangeable between two different reamer bases. End views of the first, second, and third reamers 100, 200, 300 are all shown side-by-side in FIG. 9 as a comparison of size amongst them. The outer diameter D1 of the shaft portions 104, 204, 304 can be consistent among all three reamers 100, 200, 300. The minimum cutting diameters D2 can be the same or different among the three reamers 100, 200, 300. However, numerous alternate constructs may be achieved using the same basic configuration set forth among the three disclosed reamers 100, 200, 300.

Figure 11B:
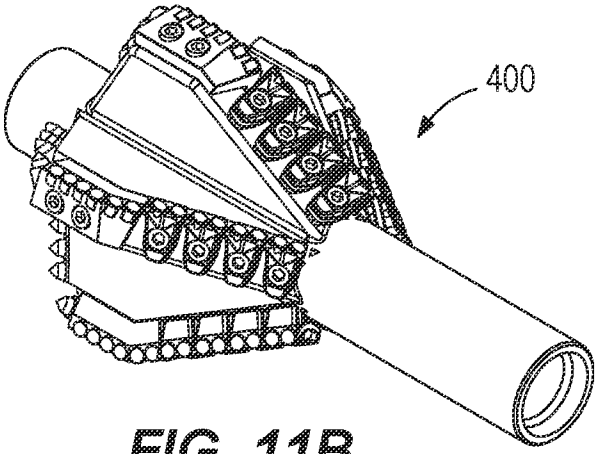
FIGS. 11A to 11H illustrate the fourth reamer having a plurality of removable cutter teeth for cutting in the pullback direction and a plurality of fixed cutting teeth for cutting in the advancing direction.
Figure 11A:
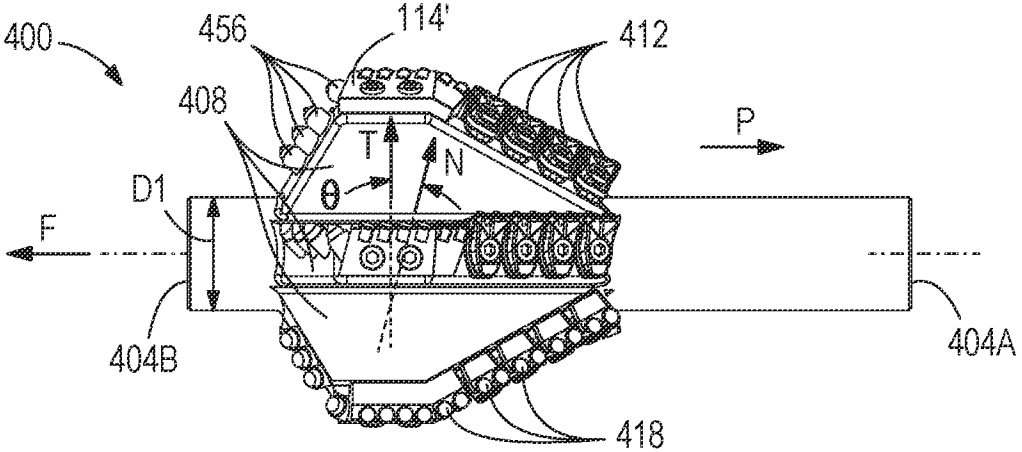
Figure 11E:
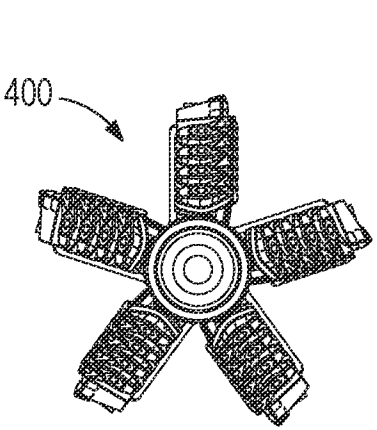
Figure 11D:
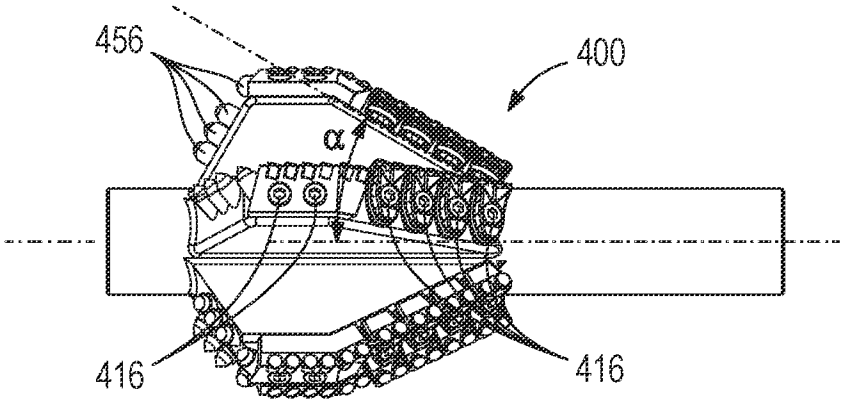
Figure 11C:
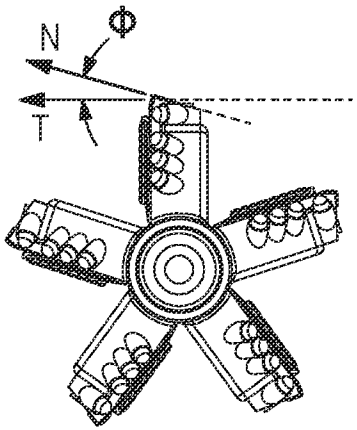
Figure 11F:
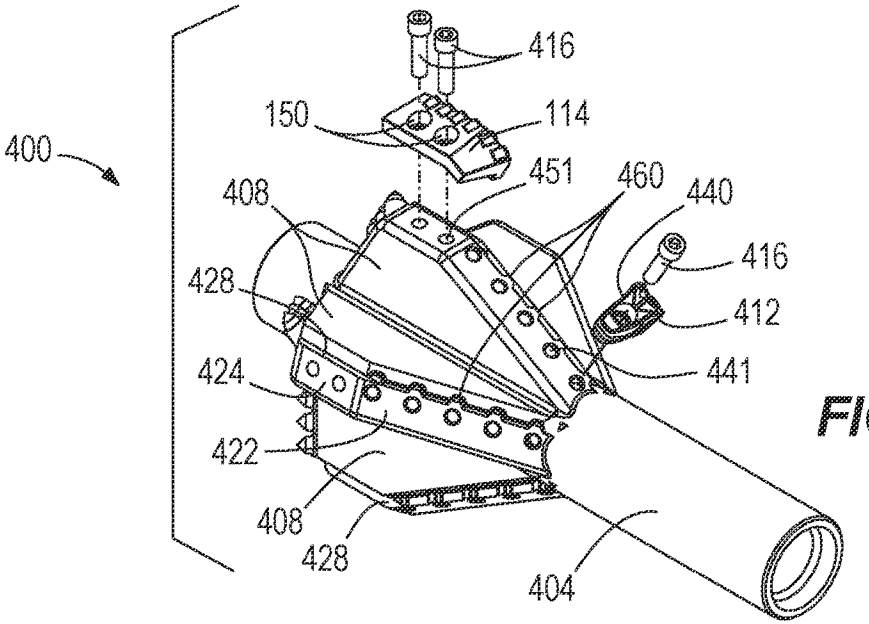
Figure 11H:
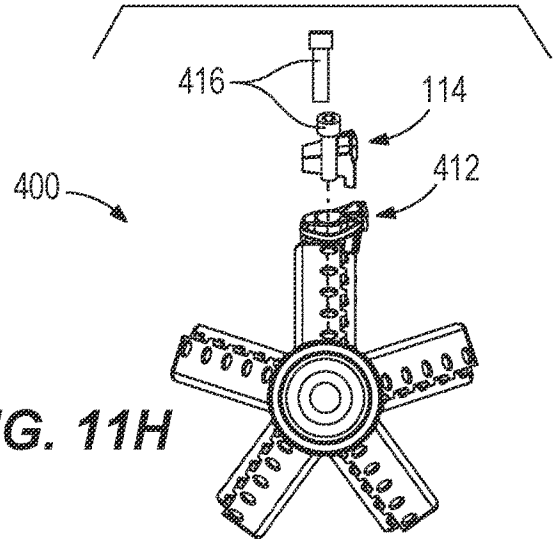
Figure 11G:
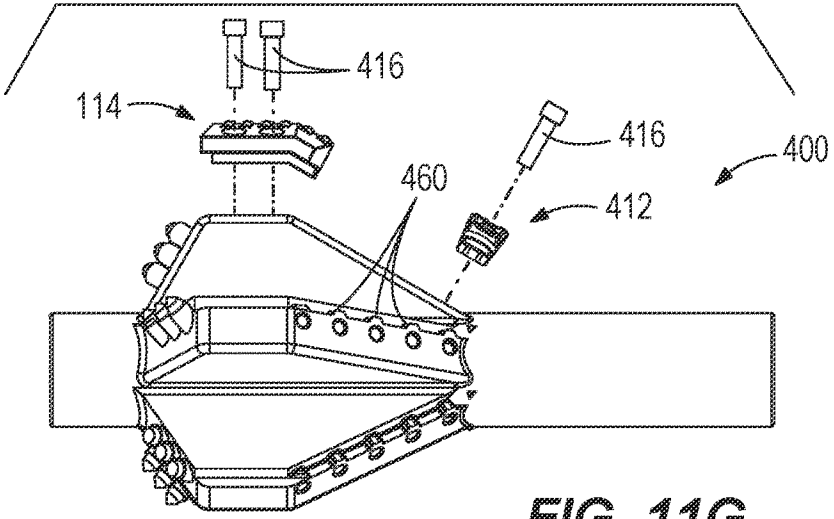
Figure 12B:
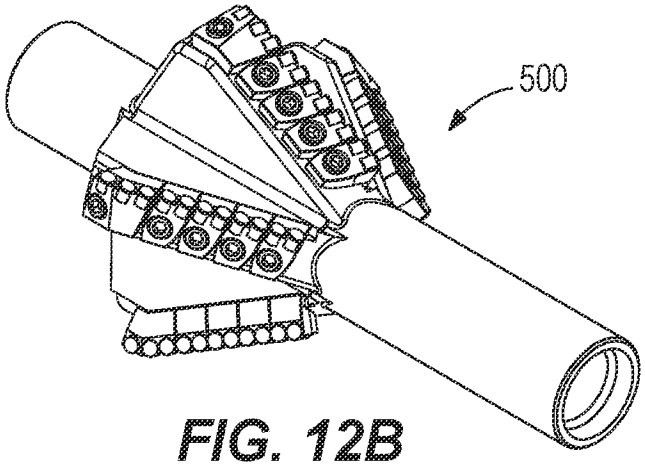
FIGS. 12A to 12H illustrate a fifth reamer of the present disclosure.
Figure 12A:
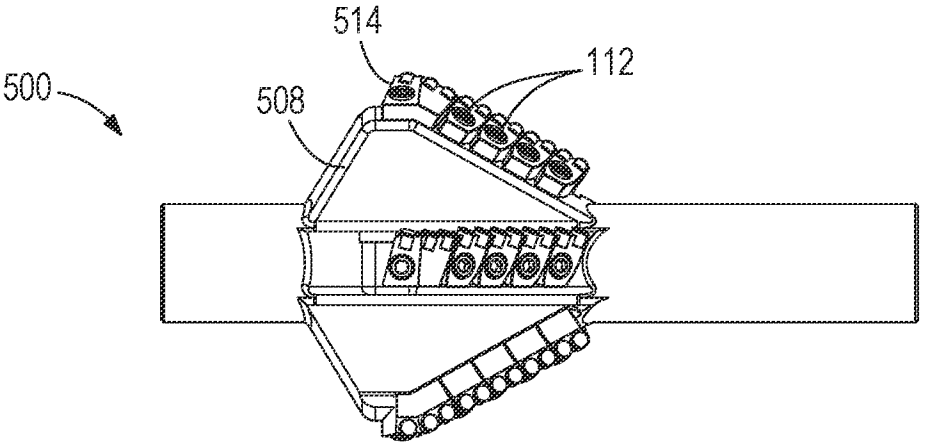
Figure 12E:
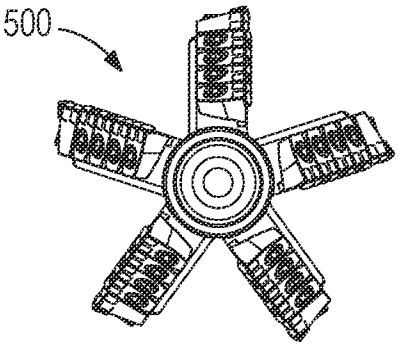
Figure 12D:
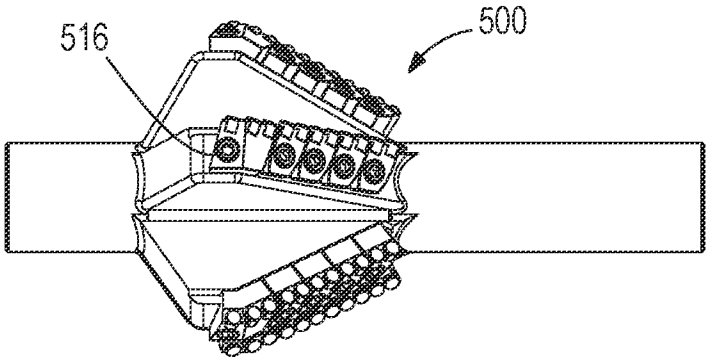
Figure 12C:
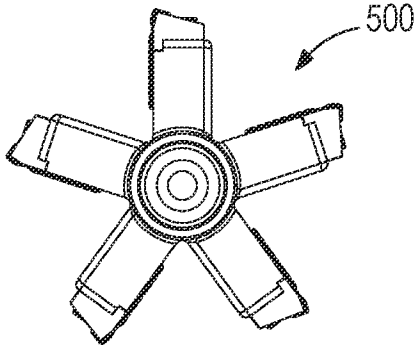
Figure 12F:
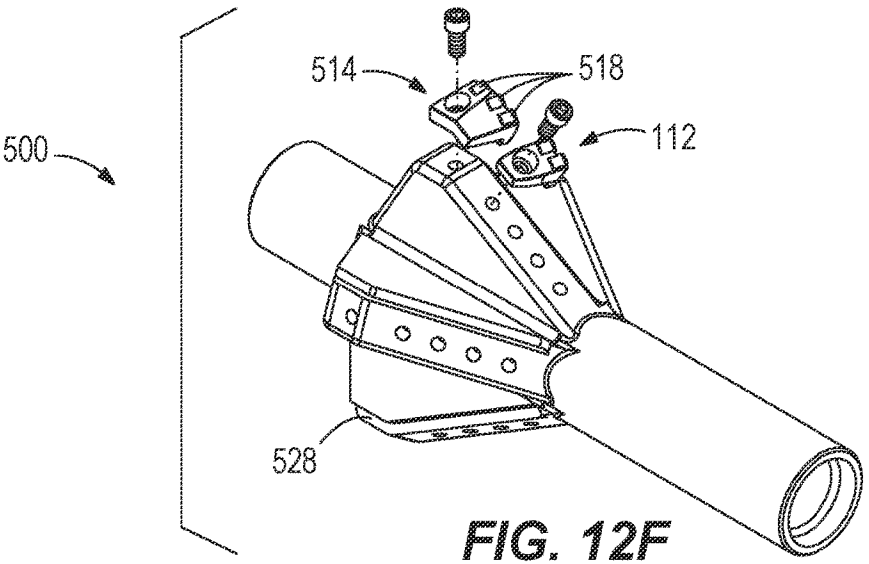
Figure 12G:
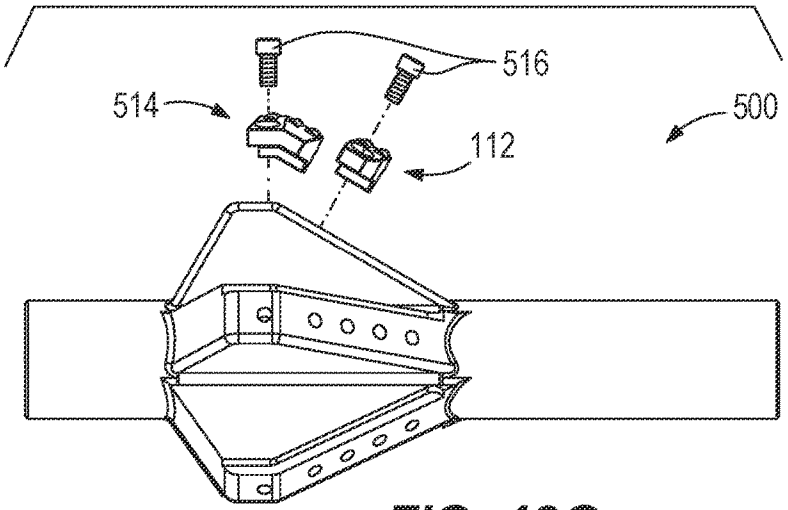
Figure 12H:
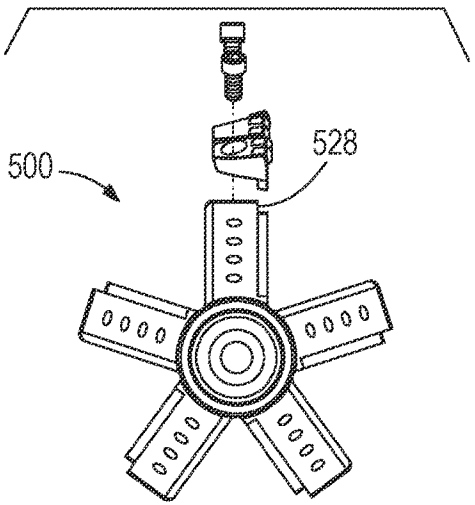
Figure 13A:
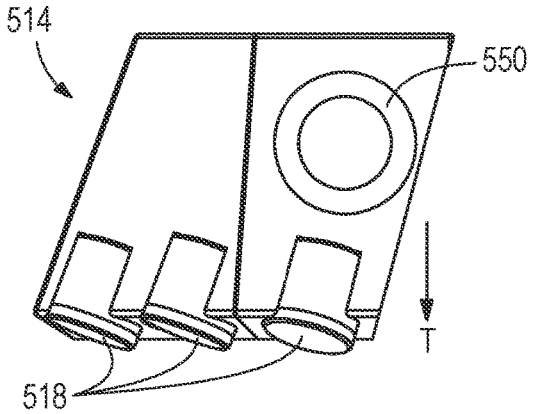
FIGS. 13A to 13G illustrate a second type of removable cutter tooth of the reamer of FIGS. 12A to 12H.
Figure 13B:
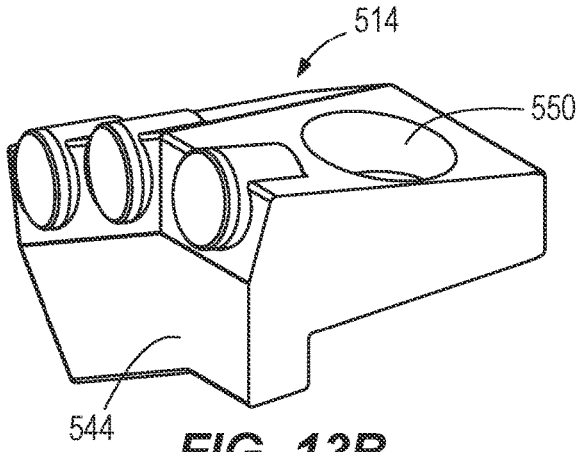
Figure 13C:
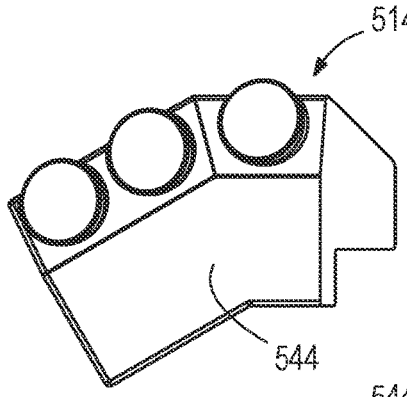
Figure 13D:
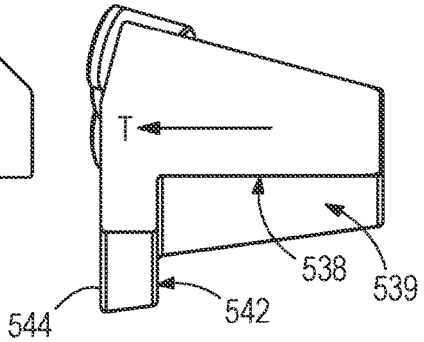
Figure 13E:
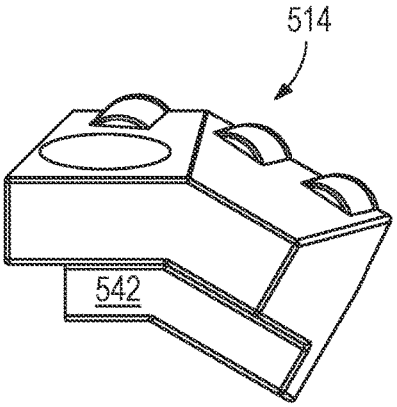
Figure 13F:
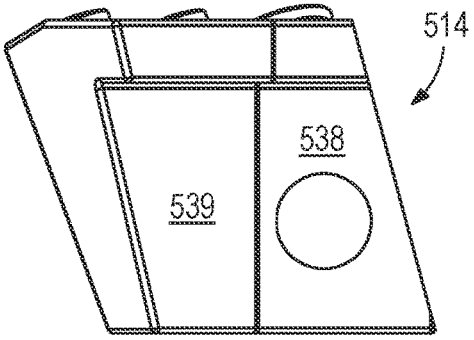
Figure 13G:
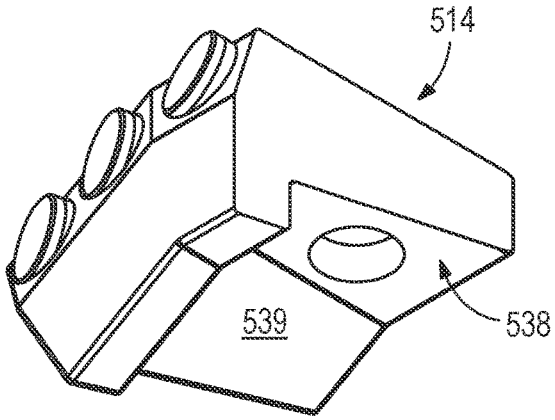
Figure 14B:
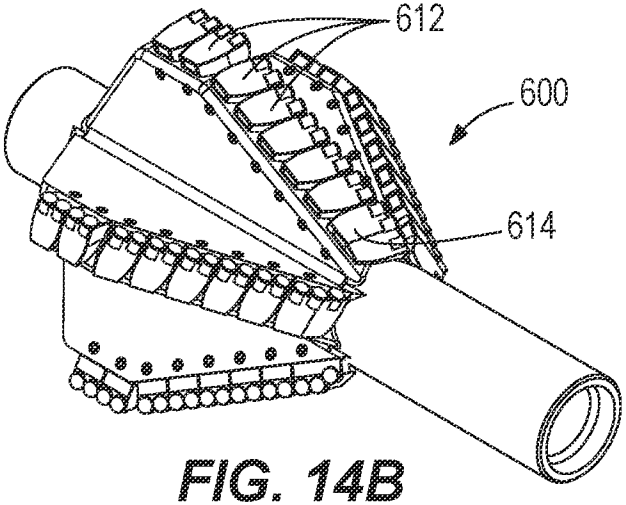
FIGS. 14A to 14H illustrate a sixth reamer of the present disclosure.
Figure 14A:
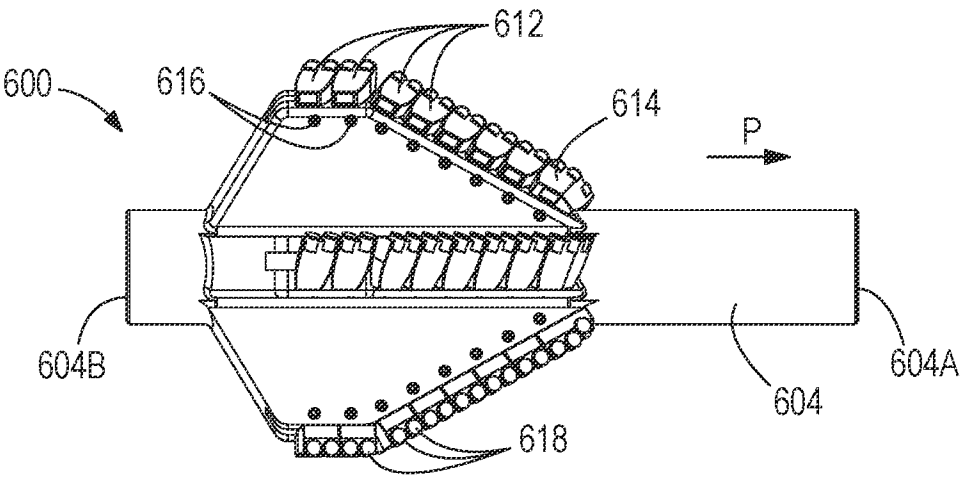
Figure 14E:
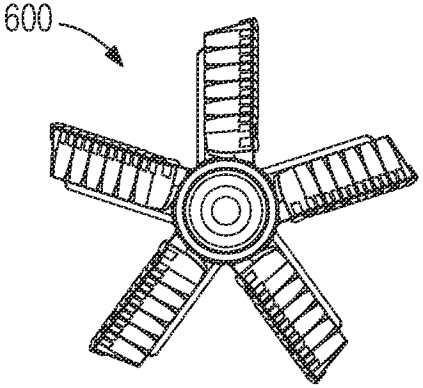
Figure 14D:
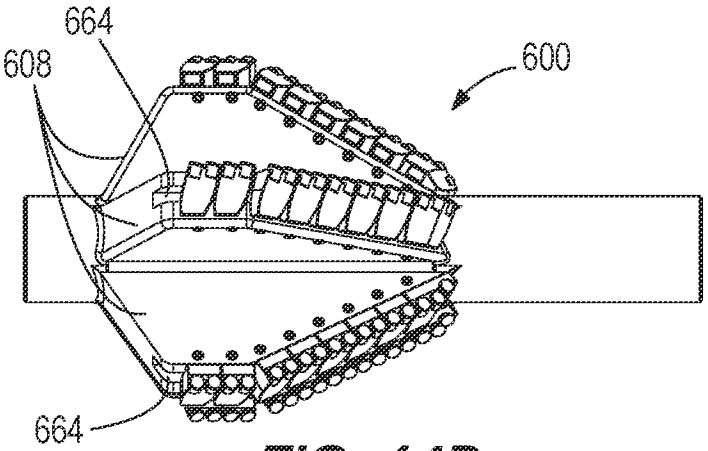
Figure 14C:
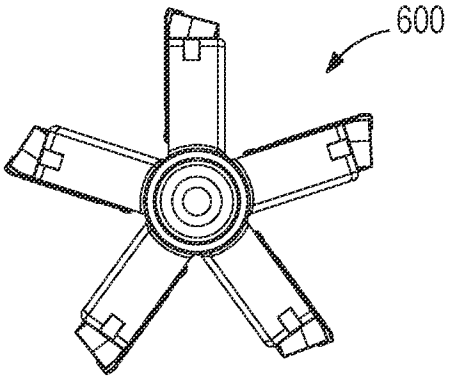
Figure 14F:
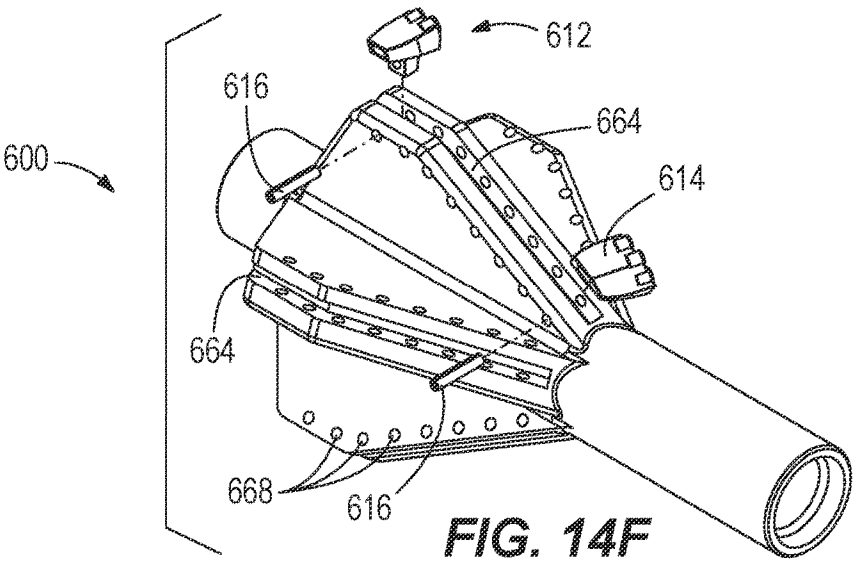
Figure 14H:
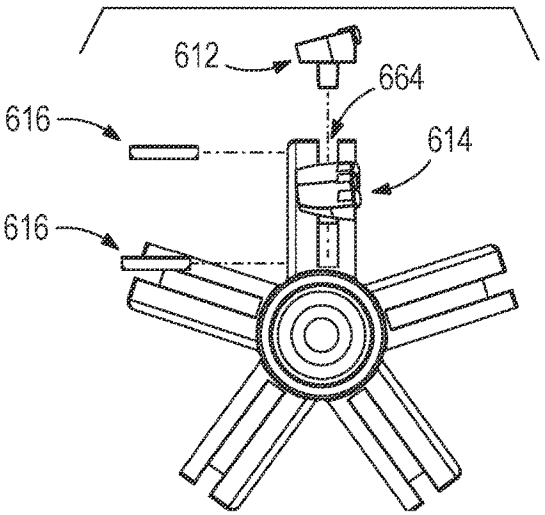
Figure 14G:
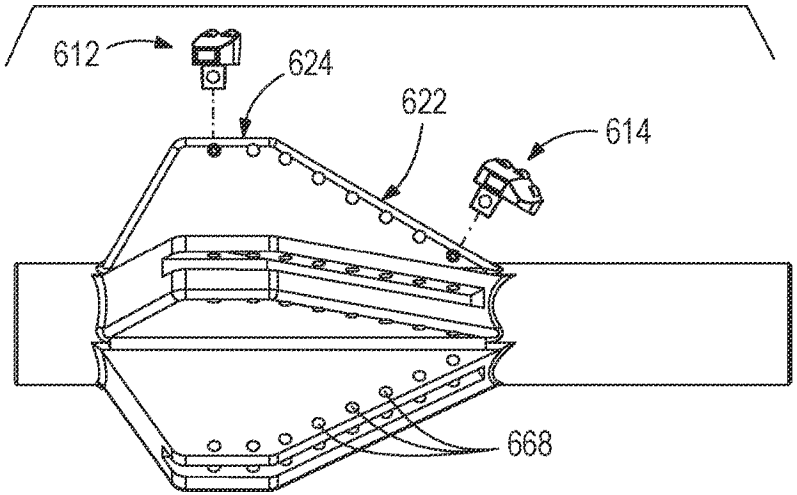
Figure 15A:
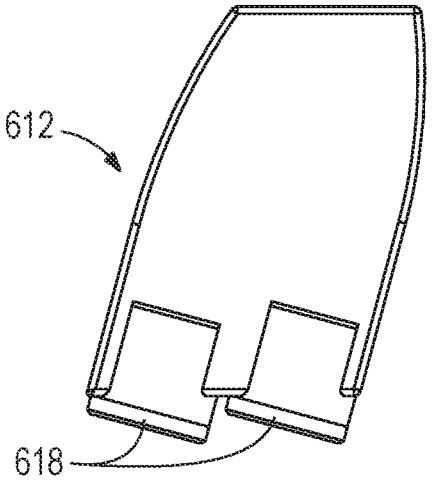
FIGS. 15A to 15F illustrate a first type of removable cutter tooth of the reamer of FIGS. 14A to 14H.
Figure 15B:
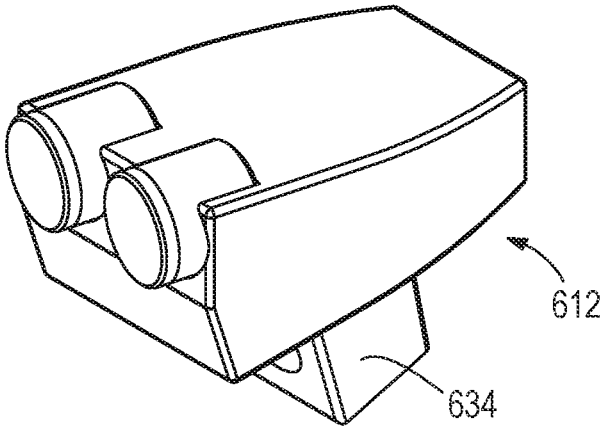
Figure 15C:
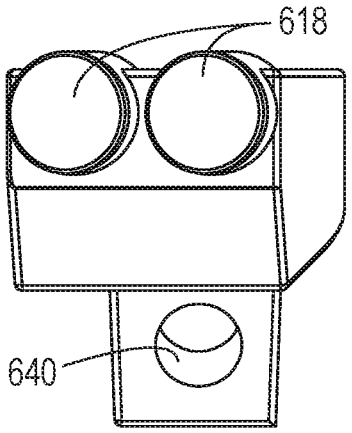
Figure 15D:
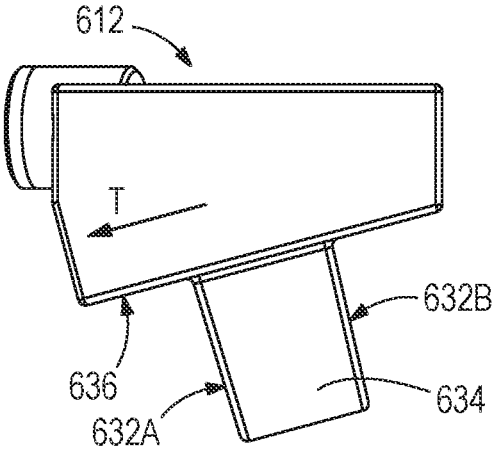
Figure 15E:
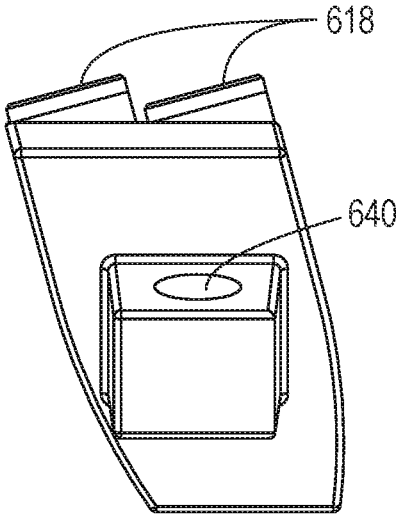
Figure 15F:
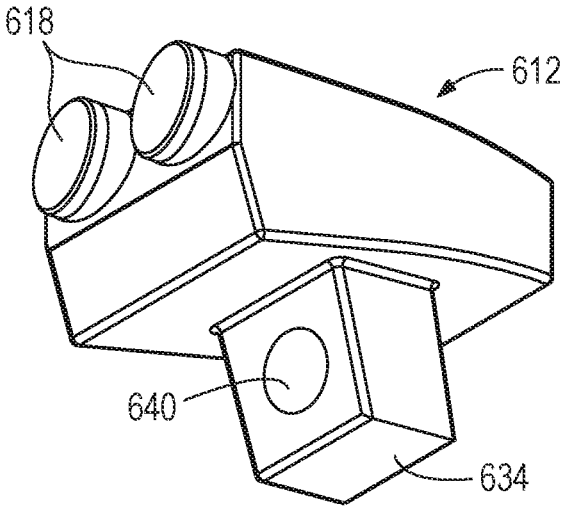

A first cutter tooth 412 of yet another construction is shown in FIGS. 10A to 10G, and a fourth reamer 400 utilizing these cutter teeth 412 is illustrated in FIGS. 11A to 11H. Again, where applicable, reference numbers are maintained consistent with those established in the description of the first reamer 100, with incrementing to the 400's, and features not reiterated are understood to conform to the above description. Although the first cutter teeth 412 of the fourth reamer 400 define a significantly different interface with the reamer base vanes 408, which is described in further detail below, the second or transition cutter tooth 114 can be identical to that of the first reamer 100, or provided as a modified form 114' (FIGS. 11A to 11E) manufactured from the cutter tooth 114. Unlike the reamers of the preceding description, the fourth reamer 400 includes additional cutter teeth 456 on a (sloped) surface of the vanes 408 that faces the forward direction F, and opposite the pullback direction P to enable bi-directional reaming, or "swabbing." The cutter teeth 456 can be welded onto the vanes 408. As shown in the modified second or transition cutter tooth 114', a similar cutter tooth 456 may be welded onto a forward-facing surface of the cutter tooth 114', or integrally-formed therewith so that the cutter tooth 114' itself is a bi-directional reaming tooth. FIGS. 11F to 11H show the second cutter tooth 114 without the additional forward cutter tooth 456.

The cutter-to-vane interface for the first cutter teeth 412 is modified as shown, and the vane notch providing each additional cutter tooth support surface 428 is shaped with humps or lugs 460 along the axial direction, rather than being straight or unchanging along the length. Thus, the underside of each first cutter tooth 412 is shaped with complementary mating surfaces to engage the respective lugs 460. The engagement and interface can be the same as or similar to the microtrencher disclosed in U.S. Provisional Patent Application No. 62/790,530, filed Jan. 10, 2019, a copy of which is appended hereto, and/or similar to that of the cutter wheel system disclosed in PCT/US2019/017029, filed Feb. 7, 2019, a copy of which is appended hereto. For example, the back surface 432 is made up of a plurality of reaction surface sections 432*a-e* that define a pocket. In some constructions, cutter teeth may be interchangeable between different kinds of machines (e.g., microtrencher and directional drilling machine). As illustrated, the cutter tooth 412 is similar to the microtrencher cutter tooth, with the addition of the side and back rake angles Θ, Φ as a portion of the tooth base must be normal to the direction of rotation to fit on the axially-extending vane. Also, the illustrated cutter tooth 412 has angled transition surfaces that are formed on bosses that are interconnected with each other, rather than separate.

The fifth reamer 500 is shown in FIGS. 12A to 12H, and a modified second or transition cutter tooth 514 is shown in FIGS. 13A to 13G. Again, where applicable, reference numbers are maintained consistent with those established in the description of the first reamer 100, with incrementing to the 500's, and features not reiterated are understood to conform to the above description. Although the vanes 508 have square notches defining the additional cutter tooth support surfaces 528, the half-dovetail shape may be substituted in alternate constructions. The fifth reamer 500 features the same first cutter teeth 112 as the first reamer 100, but shortened second cutter teeth 514. As shown, each second cutter tooth 514 includes fewer cutting features 518 (e.g., three). Furthermore, each second cutter tooth 514 includes a single countersunk aperture 550 for mounting to the vane 508 with a single fastener 516.

The sixth reamer 600 is shown in FIGS. 14A to 14H. A first cutter tooth 612 of the reamer 600 is shown in FIGS. 15A to 15F, and a second or transition cutter tooth 614 is shown in FIGS. 17A to 17G. Again, where applicable, reference numbers are maintained consistent with those established in the description of the first reamer 100, with incrementing to the 600's, and features not reiterated are understood to conform to the above description. The vanes 608 of the reamer 600 are each formed with a slot or groove 664 extending along the radial outer edge thereof. The groove 664 is spaced between leading and trailing edges of the vane 608 (e.g., centrally) rather than being at the leading edge thereof. The groove 664 functions with the cutter teeth 612, 614 to establish a tongue-and-groove interface, whereby each tooth 612, 614 has a "tongue" formed by a respective radially-inward extending flange or foot 634, 644. Unlike prior-described cutter teeth, the flange or foot 634, 644 in each tooth 612, 614 is not located at a leading end of the cutter body, but rather is located centrally. Also, there is no aperture through the top (radially outer) surface of the cutter teeth 612, 614. Instead, an aperture 640, 650 is provided through the foot 634, 644 (e.g., in the tangential direction T). Each aperture 640, 650 aligns with one or more apertures 668 in the corresponding vane 608 to cooperatively receive a pin (e.g., single roll pin) to secure the cutter 612, 614 to the vane 608. Due to the configuration for interfacing with the grooves 664, each cutter tooth foot 634, 644 includes both front 632A, 642A and back 632B, 642B support surfaces. The same type of first cutter tooth 612 is used throughout each vane 608 (on both tooth base surfaces 622, 624), with the exception of the forwardmost location in the pullback direction P, where a second or transition cutter tooth 614 is provided. The second cutter tooth 614 has cutting features 618 that are angled to transition to the shaft portion 604 (although the base surface 638 is flat), and may abut the shaft portion 604. Whether abutting or not, this arrangement allows moving cutting portions 618 closer to the axis A, thus bringing the minimum cutting diameter D2 closer to the outer diameter D1 of the shaft portion 604.

Figure 16A:
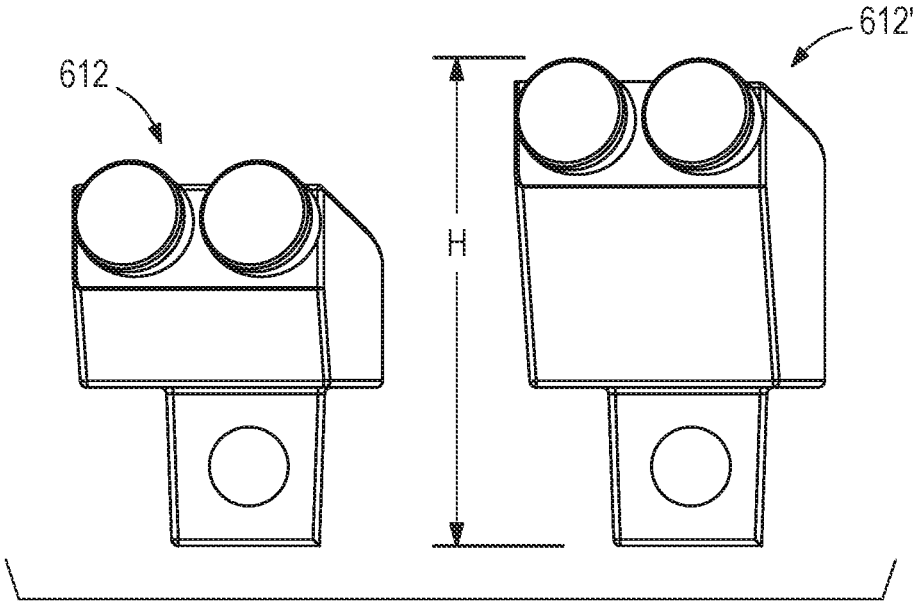
FIGS. 16A and 16B illustrate an alternate removable cutter tooth, similar to that of FIGS. 15A to 15F, but having an increased radial height resulting in an increased reaming diameter in the reamer of FIGS. 14A to 14H.
Figure 16B:
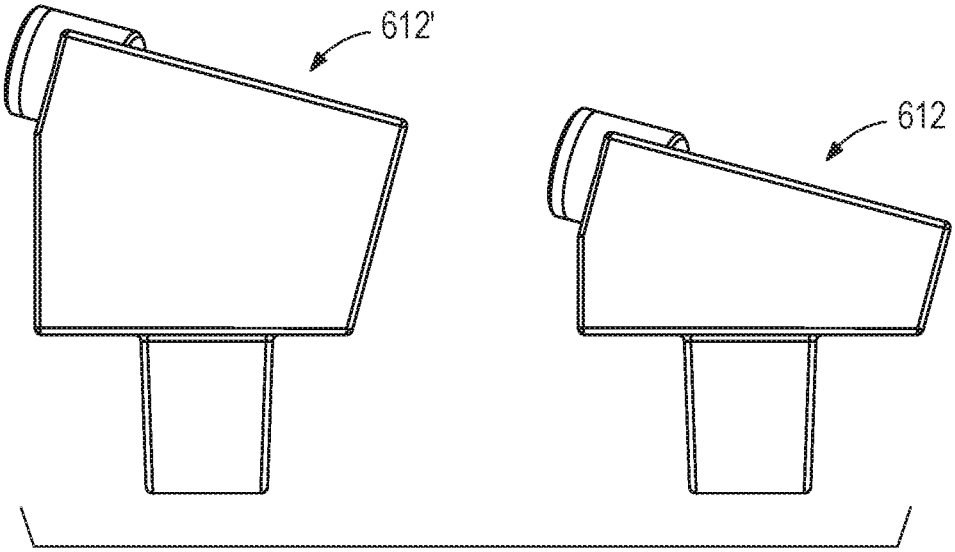
Figure 17A:
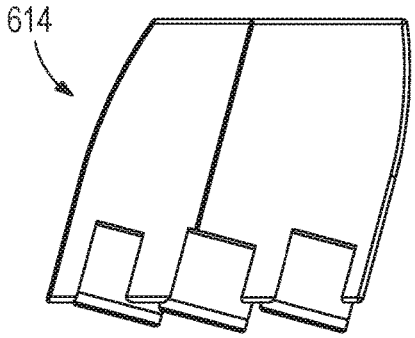
FIGS. 17A to 17G illustrate a second type of removable cutter tooth of the reamer of FIGS. 14A to 14H.
Figure 17B:
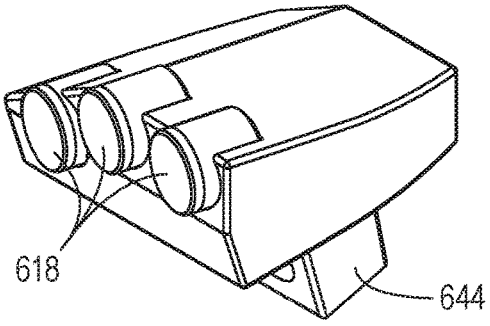
Figure 17C:
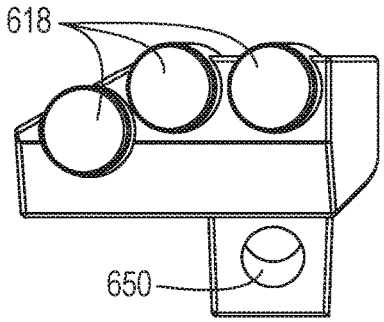
Figure 17D:
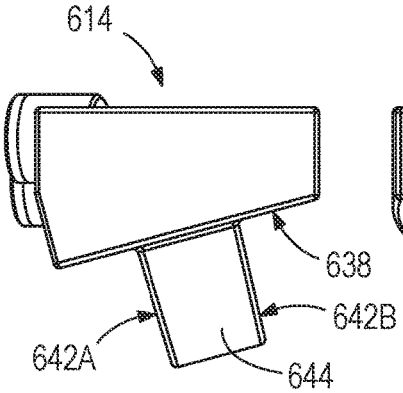
Figure 17E:
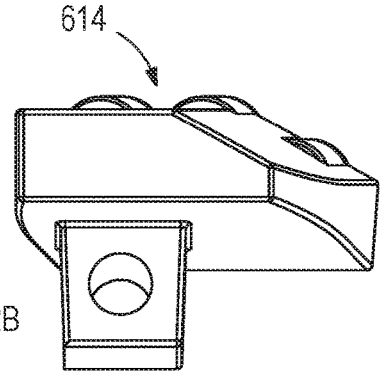
Figure 17F:
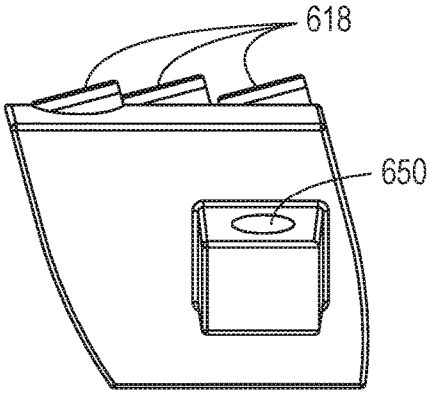
Figure 17G:
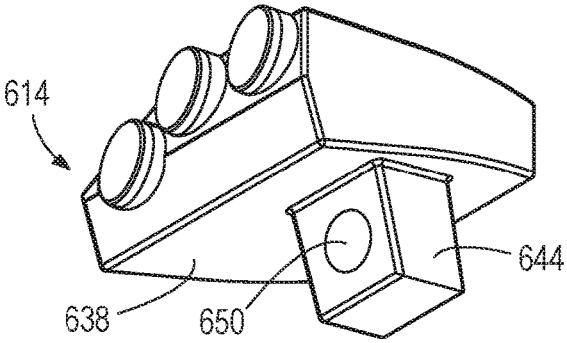
Figure 18B:
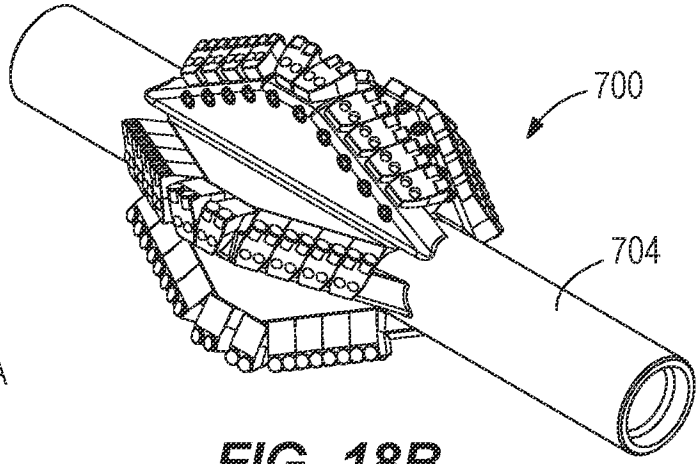
FIGS. 18A to 18I illustrate a seventh reamer of the present disclosure.
Figure 18A:
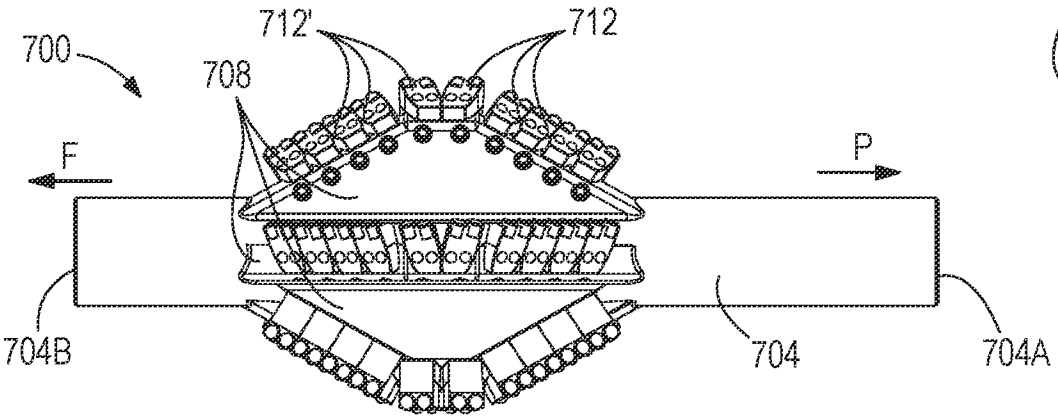
Figure 18D:
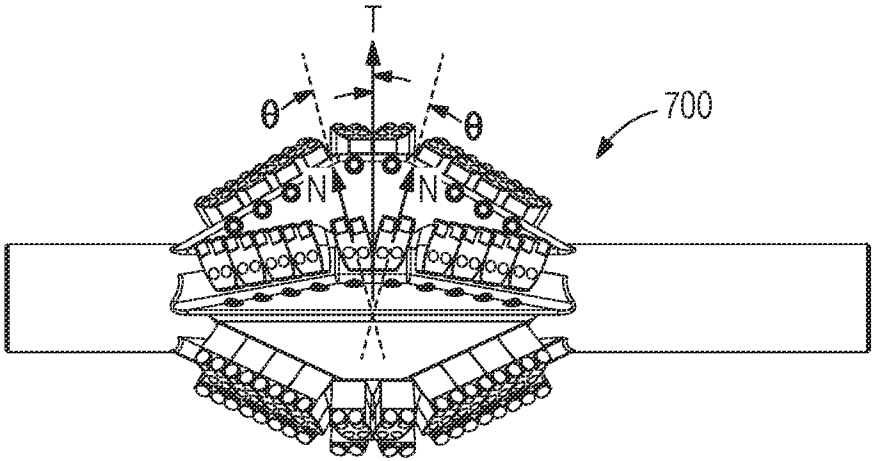
Figure 18E:
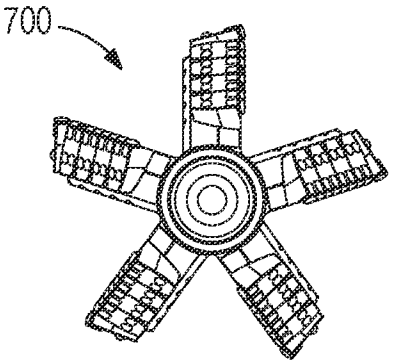
Figure 18C:
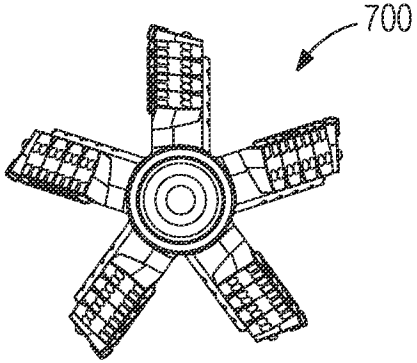
Figure 18G:
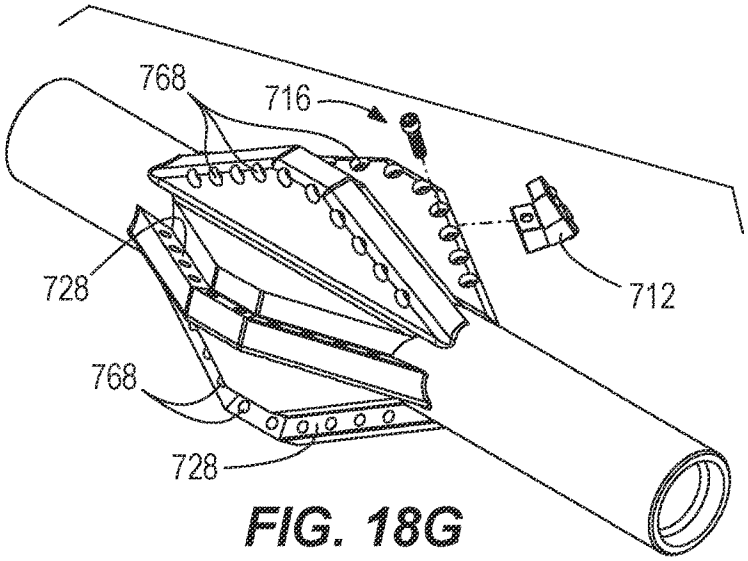
Figure 18I:
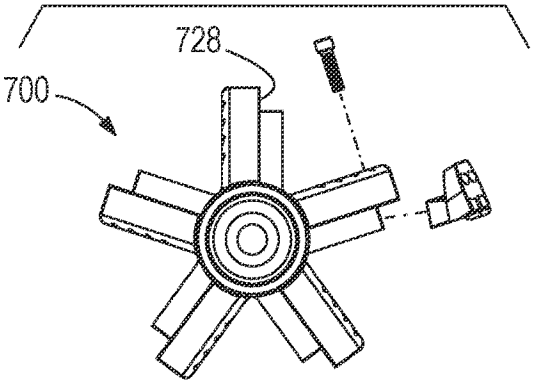
Figure 18F:
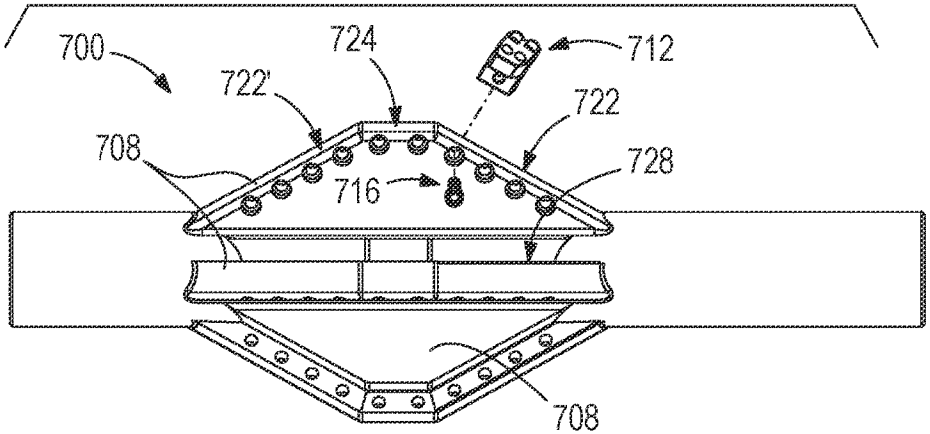
Figure 18H:
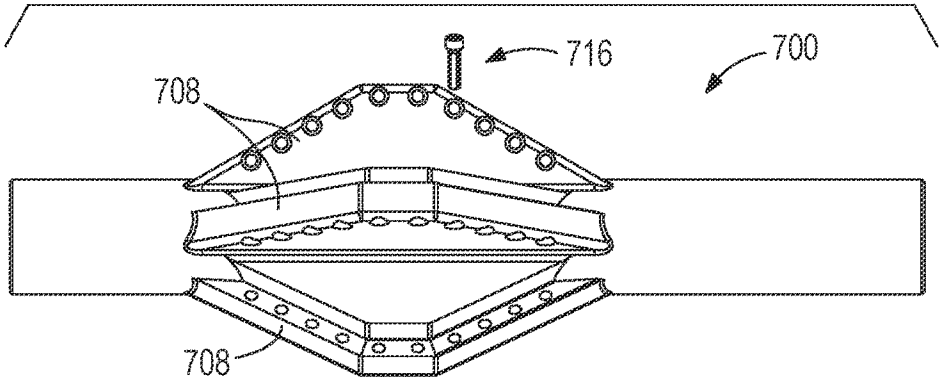
Figure 19A:
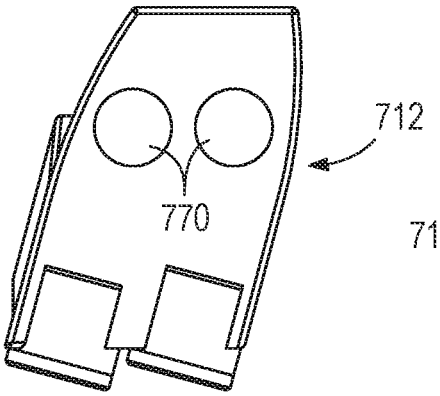
FIGS. 19A to 19G illustrate a first type of removable cutter tooth of the reamer of FIGS. 18A to 18I.
Figure 19B:
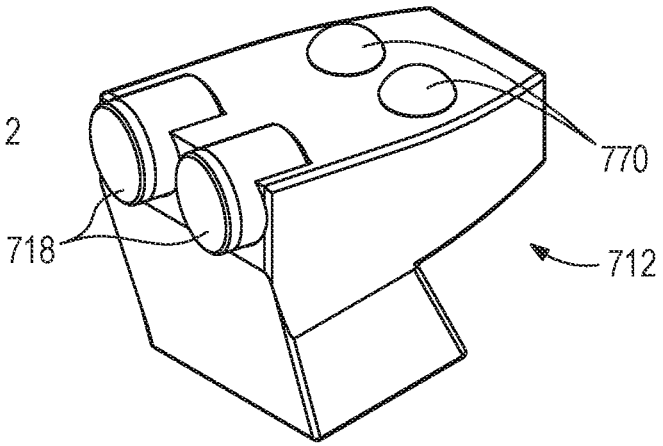
Figure 19C:
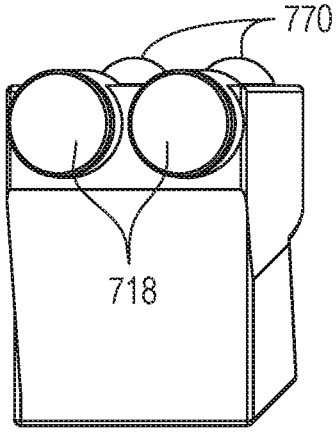
Figure 19D:
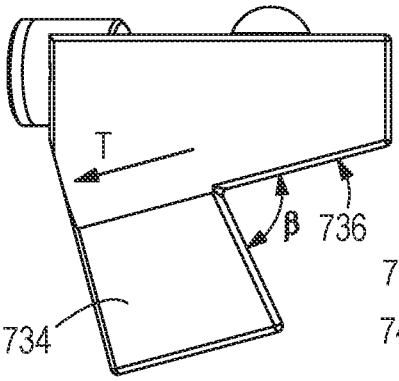
Figure 19E:
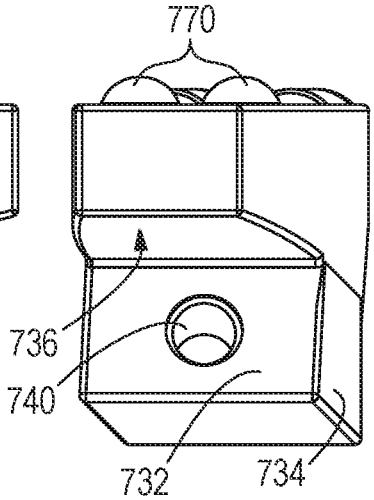
Figure 19F:
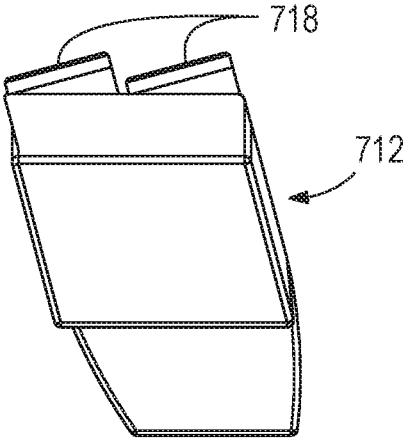
Figure 19G:
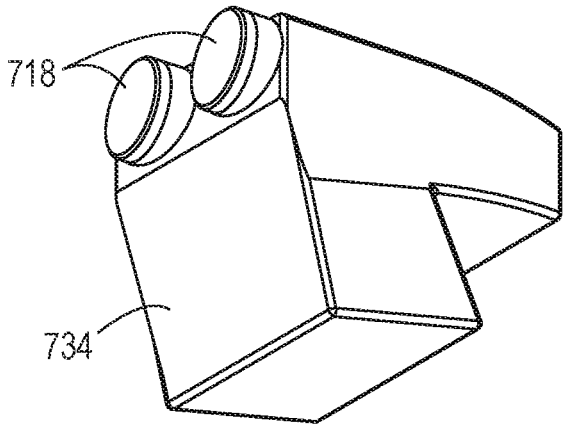
Figure 20B:
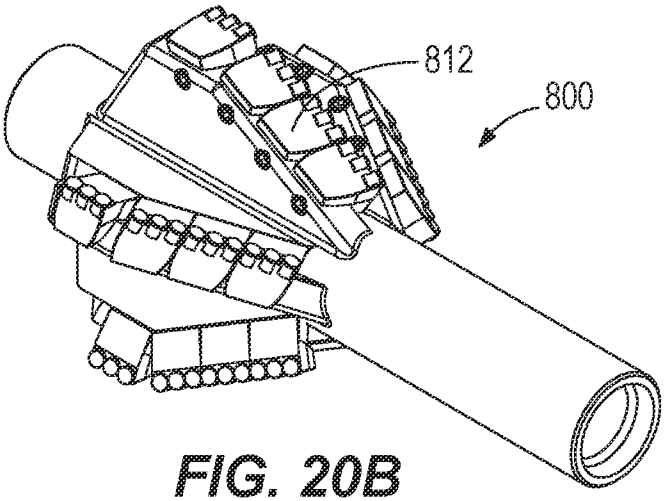
FIGS. 20A to 20J illustrate an eighth reamer of the present disclosure.
Figure 20A:
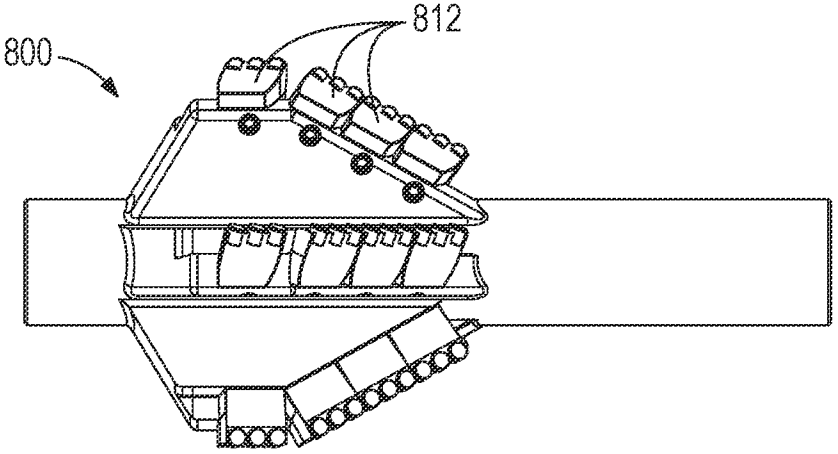
Figure 20E:
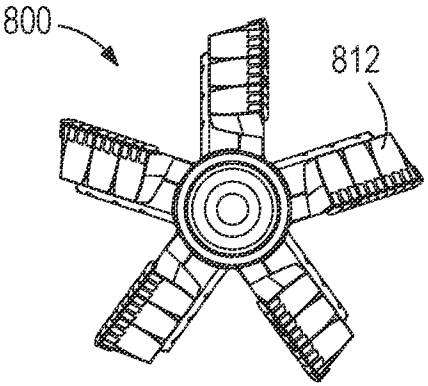
Figure 20D:
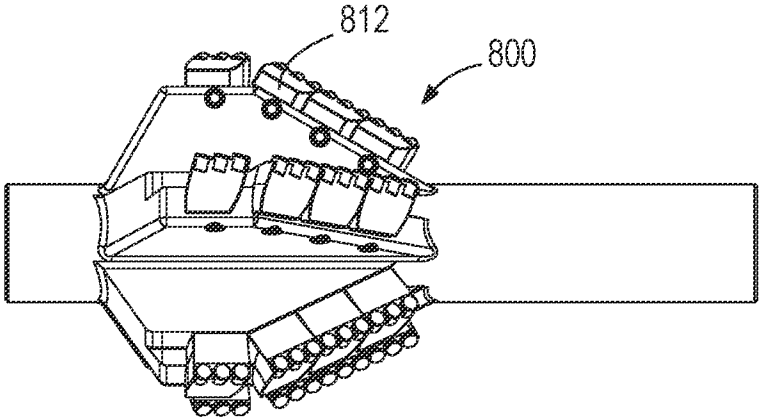
Figure 20C:
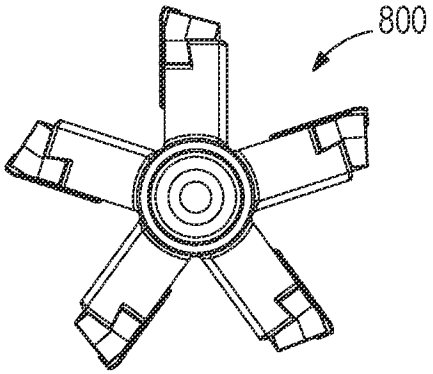
Figure 20G:
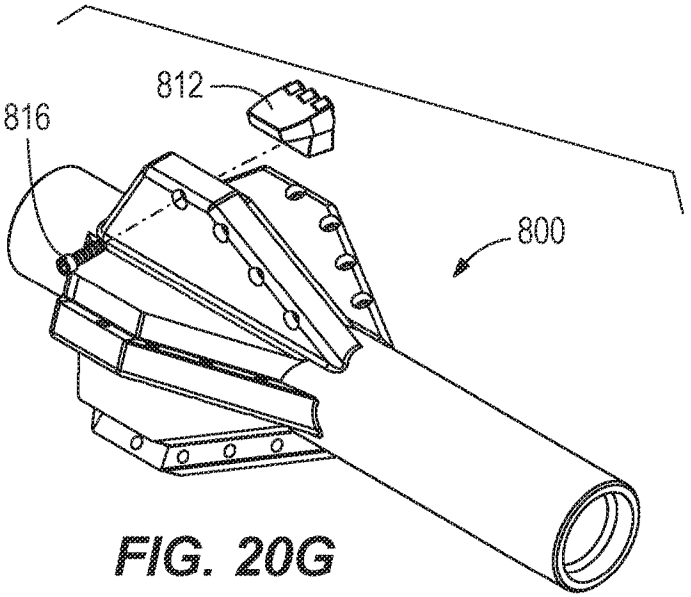
Figure 20F:
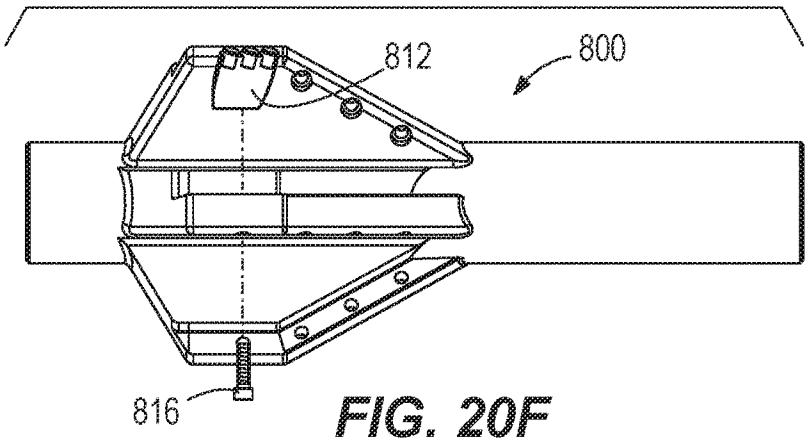
Figure 20J:
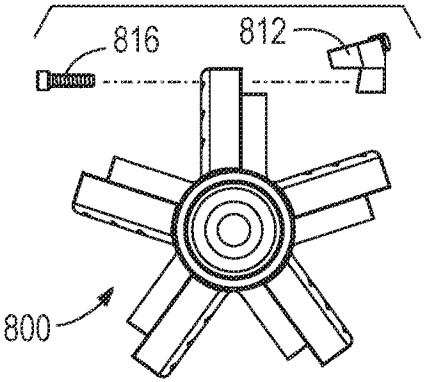
Figure 20I:
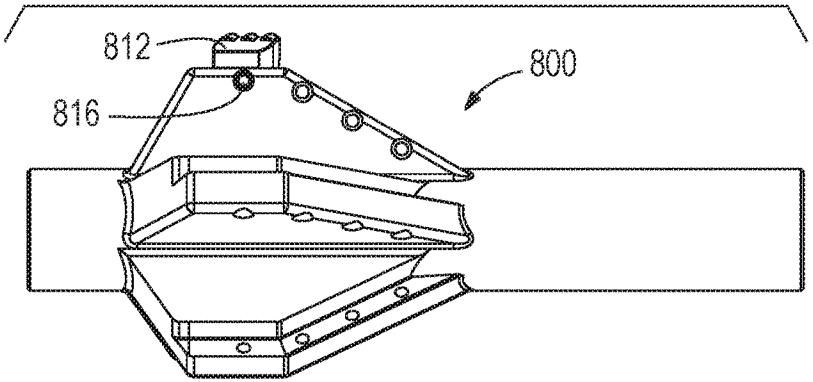
Figure 20H:
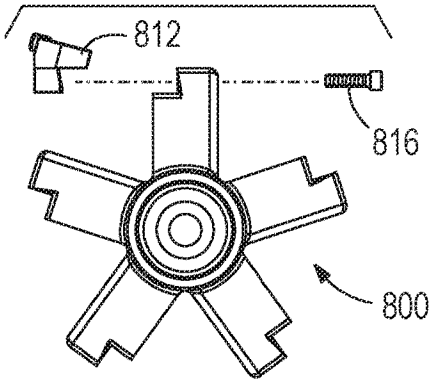
Figure 21A:
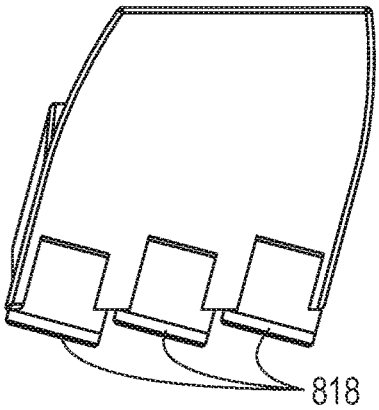
FIGS. 21A to 21G illustrate a removable cutter tooth used throughout the reamer of FIGS. 20A to 20J.
Figure 21B:
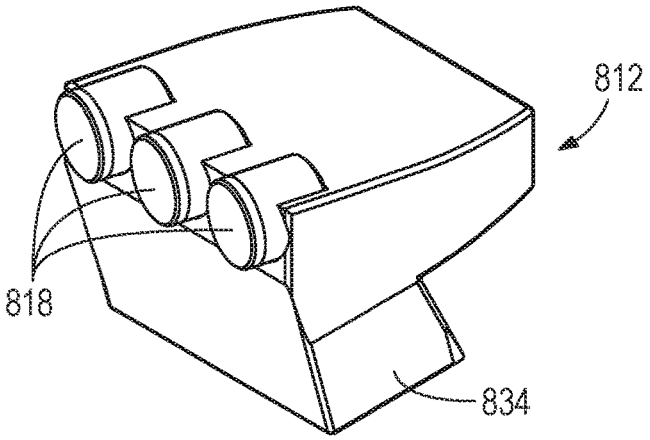
Figure 21C:
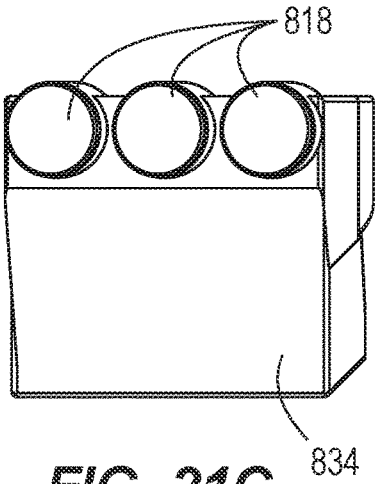
Figure 21D:
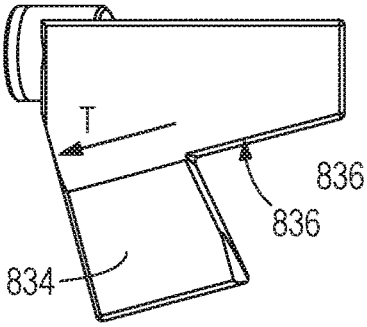
Figure 21E:
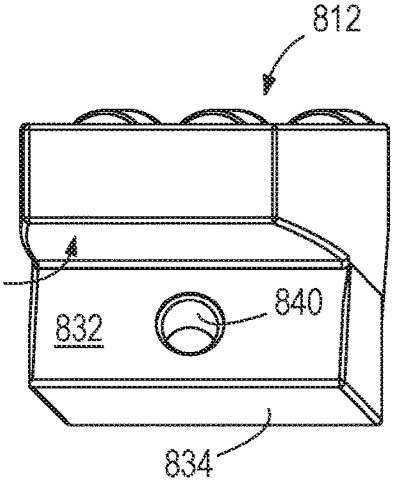
Figure 21F:
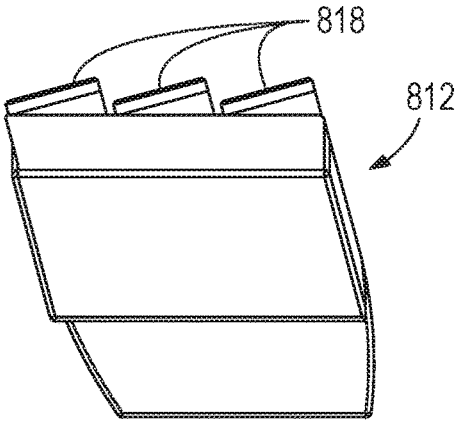
Figure 21G:
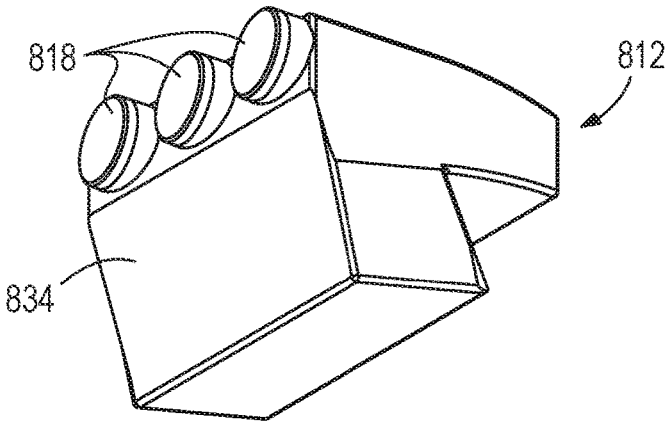
Figure 22A:
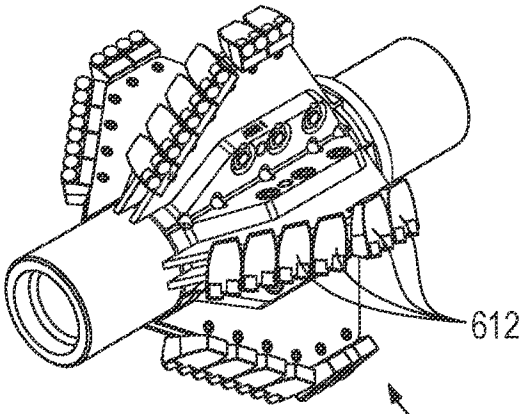
FIGS. 22A to 22J illustrate a ninth reamer of the present disclosure.
Figure 22B:
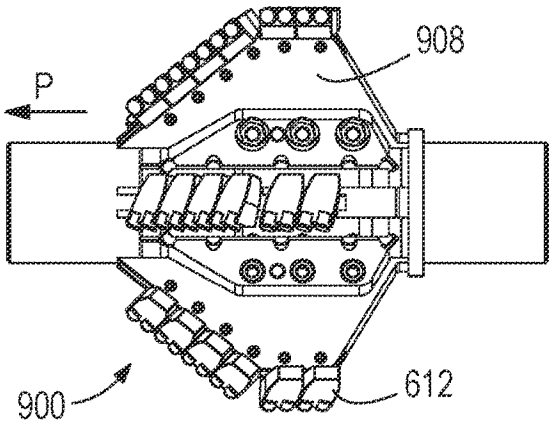
Figure 22C:
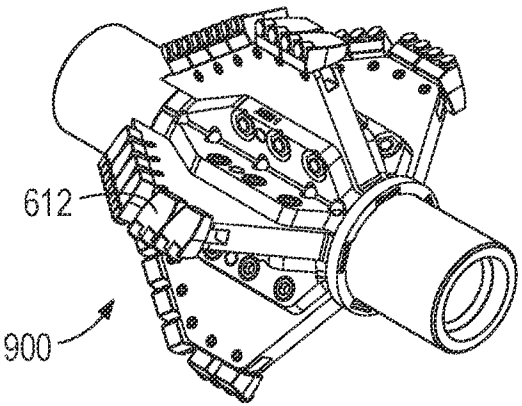
Figure 22D:
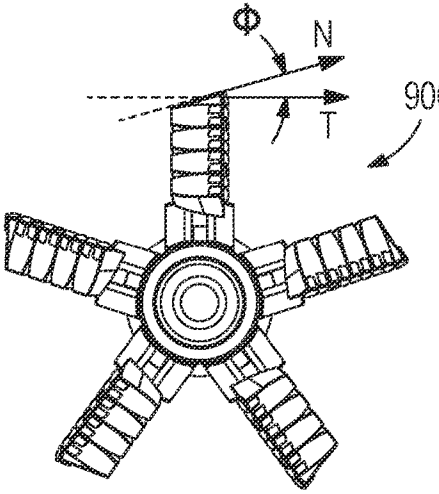
Figure 22E:
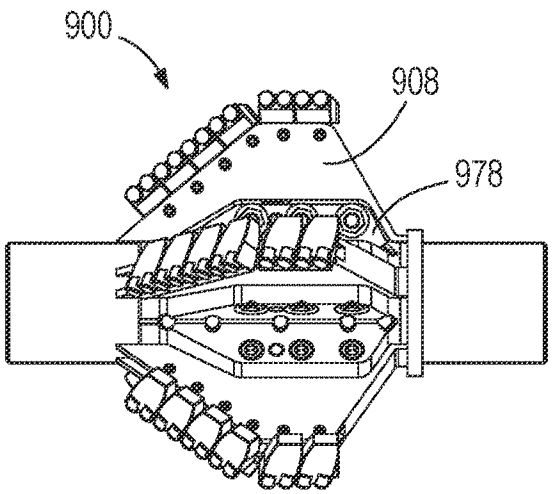
Figure 22F:
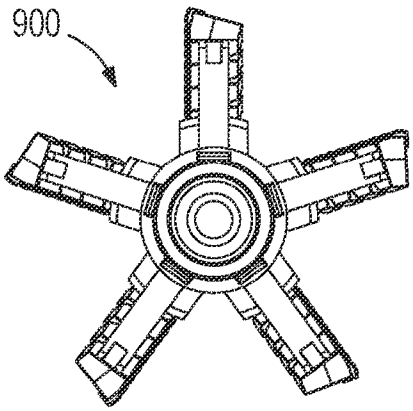
Figure 22G:
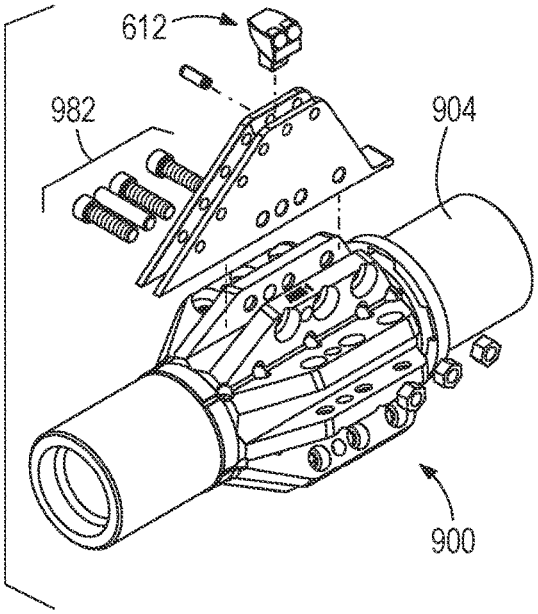
Figure 22H:
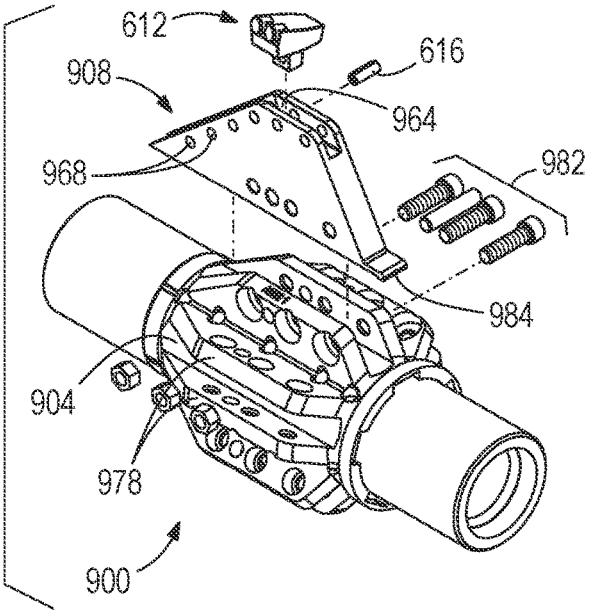
Figure 22I:
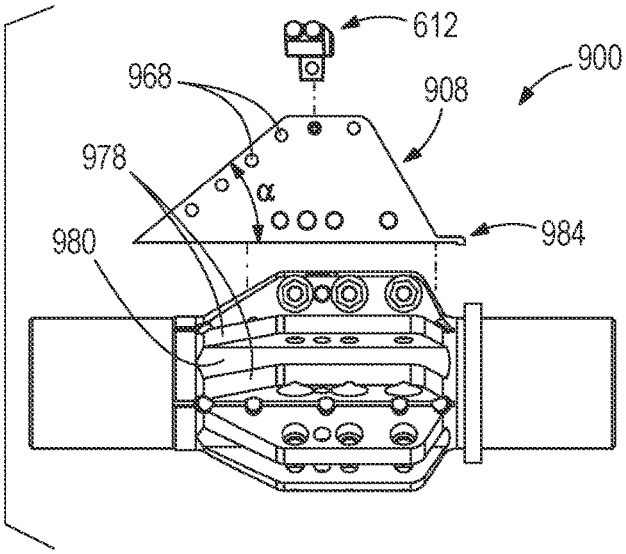
Figure 22J:
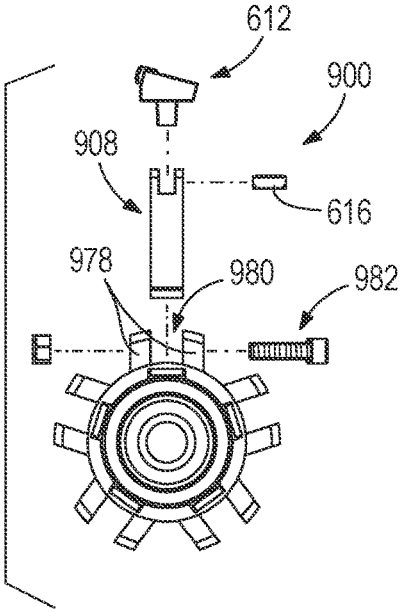

FIGS. 16A and 16B illustrate a modified first cutter tooth 612' having an increased radial height H to set the cutting features 618 further out from the axis A and increase the maximum cutting diameter D3. Such cutter teeth 612' can be used at some or all of the locations along the vanes 608. Although not shown, some or all of the transition cutter teeth 614 can be similarly modified for additional height.

The seventh reamer 700 is shown in FIGS. 18A to 18I. A first cutter tooth 712 of the reamer 700 is shown in FIGS. 19A to 19G. Again, where applicable, reference numbers are maintained consistent with those established in the description of the first reamer 100, with incrementing to the 700's, and features not reiterated are understood to conform to the above description. The reamer 700 is a bi-directional reamer, featuring a plurality of the first cutter teeth 712 along the first tooth base surface 722 and a portion of the second tooth base surface 724, and a plurality of second cutter teeth 712' along another portion of the second tooth base surface 724 and along a third tooth base surface 722'. The second cutter teeth 712' can have a side rake angle that is reversed in direction from the side rake angle Θ of the first cutter teeth 712. The cutter teeth 712, 712' can be mirror-images of each other. Each cutter tooth 712 has a radially-inward extending flange or foot 734 (e.g., at a leading end of the cutter body) having a tangential aperture 740 therethrough. The foot 734 is thicker in the tangential direction T than the other cutter tooth feet disclosed herein (e.g., over 25 percent or over 33 percent of the total cutter body tangential length, not including the cutting features 718). A back surface 732 of the foot 734 abuts a tangentially-facing additional cutter tooth support surface 728 formed by the notch or recess along the leading side of each vane 708. As shown, the back surface 732 can form an acute angle β with a bottom surface 736, thus providing for the half-dovetail joint described above. In other constructions, the surfaces 732, 736 are oriented square to each other. Securing each tooth 712 to the vane 708 is a fastener 716 (e.g., bolt) that extends tangentially through the foot 734 and through a single flange of the vane 708. A tooth aperture 740 or a vane aperture 768 can be threaded. Alternately, a nut may be provided to engage the fastener 716. Either or both of the apertures 740, 768 can be countersunk. At the top surface of each tooth 712, wear reducing elements, or "buttons," 770 may be provided. The buttons 770 can be constructed of a harder and/or more wear-resistant material than the body of the cutter tooth 712, and in some cases the buttons 770 can be carbide. The buttons 770 have a rounded profile. The buttons 770 can extend the useful life of the teeth 712. The teeth 712' facing toward the forward direction F can have the same features as the teeth 712.

The eighth reamer 800 is shown in FIGS. 20A to 20J. A cutter tooth 812 of the reamer 800 is shown in FIGS. 21A to 21G. Again, where applicable, reference numbers are maintained consistent with those established in the description of the first reamer 100, with incrementing to the 800's, and features not reiterated are understood to conform to the above description. The interface defined between the cutter teeth 812 and the reamer base is similar to that of the seventh reamer 700. In fact, the cutter teeth 812 can be similar to the cutter teeth 712, except that the cutter teeth 812 of FIGS. 21A to 21G are extended to accommodate three cutting features 818 rather than the two cutting features 718 of the teeth 712. Further, the cutter teeth 812 are shown without the wear reducing buttons 770, although similar buttons may be provided. The reamer 800 is also an example where the entire reamer is assembled including one and only one type of cutter tooth 812. Thus, there is exactly one type of cutter tooth provided throughout the entire reamer 800, further simplifying inventory and maximizing efficiency of design.

The ninth reamer 900 is shown in FIGS. 22A to 22J. Again, where applicable, reference numbers are maintained consistent with those established in the description of the first reamer 100, with incrementing to the 900's, and features not reiterated are understood to conform to the above description. Rather than being monolithic with the shaft portion 904, or otherwise integral or permanent, the vanes 908 are separable (e.g., bolt-on elements) from the shaft portion 904 in the reamer 900. A radially inner portion of each bolt-on vane 908 is received between two mounting flanges 978. The mounting flanges 978 are provided in radially-extending pairs to define respective vane-receiving channels 980 therebetween. Once positioned in the channel 980 between the mounting flanges 978, the vane 908 is secured to the reamer base by a plurality of fasteners 982 (e.g., bolt and nut pairs). Each vane 908 may further be provided with a hooked end 984 for engagement with a corresponding edge of the reamer base on or adjacent the shaft portion 904. In the illustrated construction, the vanes 908 are structured at their radially outer ends like the vanes 608 of the reamer 600 (e.g., having a slot or groove 964 and tangential apertures 968 extending therethrough). The vanes 908 can be configured to mount the same cutter teeth 612 as the reamer 600. However, the concept of detachable vanes, utilizing the mounting flanges 978 or similar structure, may also be applied to other vane constructions, and may be used with any of the cutter teeth disclosed herein, among others. Bolt-on vanes 908 can allow exchanging of vanes of different heights on the reamer base to change the maximum cutting diameter, with or without changing the type of cutter teeth. Damage to a given vane 908 also does not require scrapping or repair of the entire reamer base.

Figure 23:
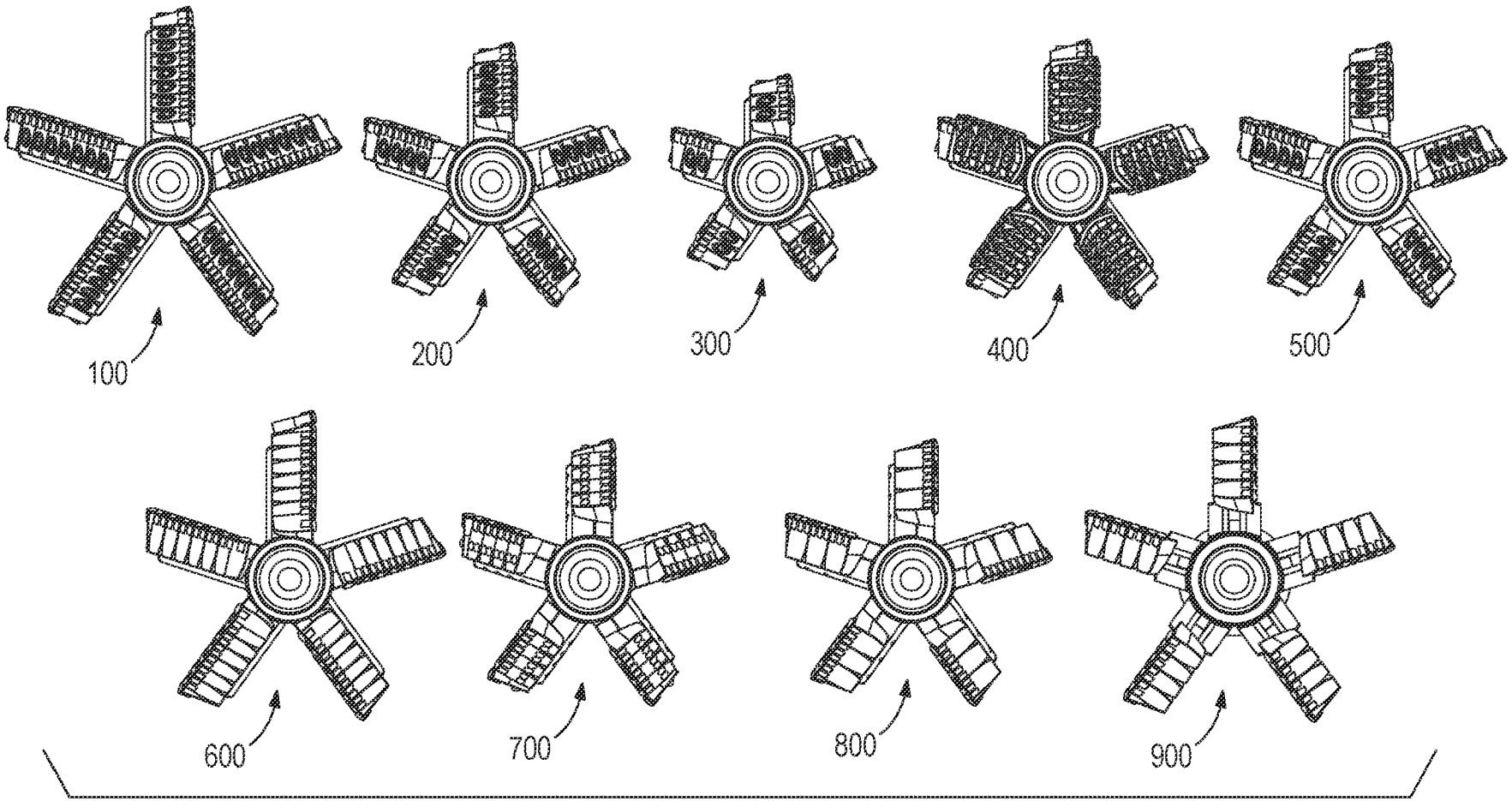
FIG. 23 illustrates side-by-side end views of the first through ninth reamers of the present disclosure.
Figure 24B:
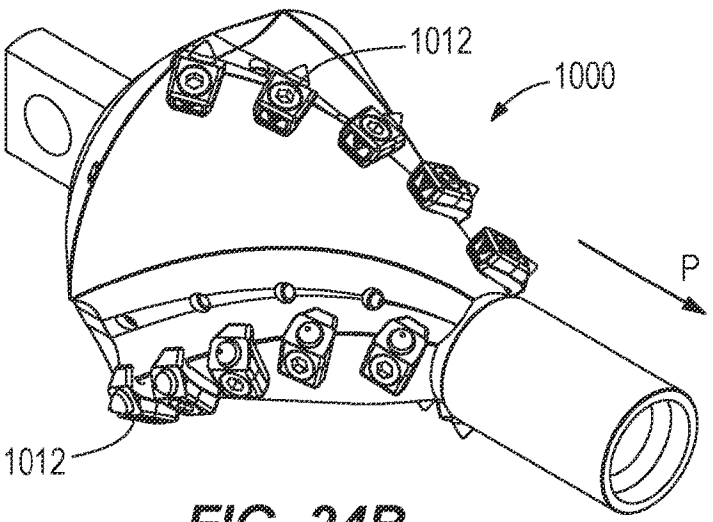
FIGS. 24A to 24D illustrate a tenth reamer of the present disclosure.
Figure 24D:
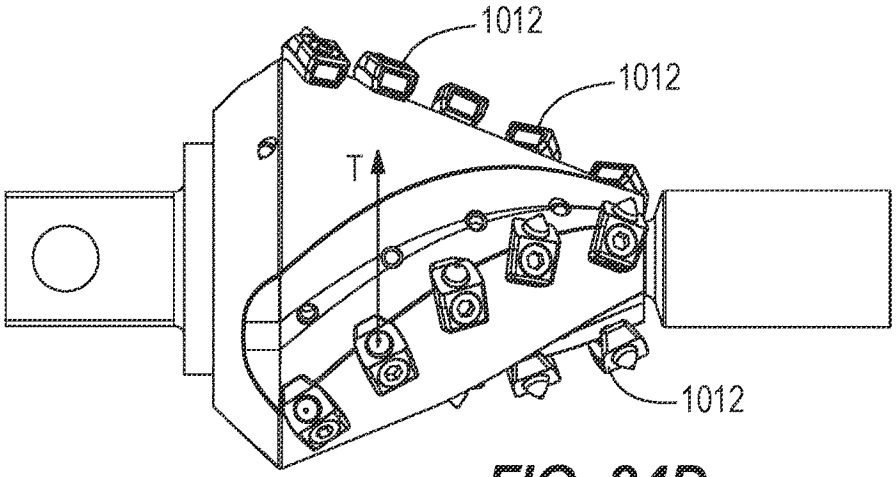
Figure 24A:
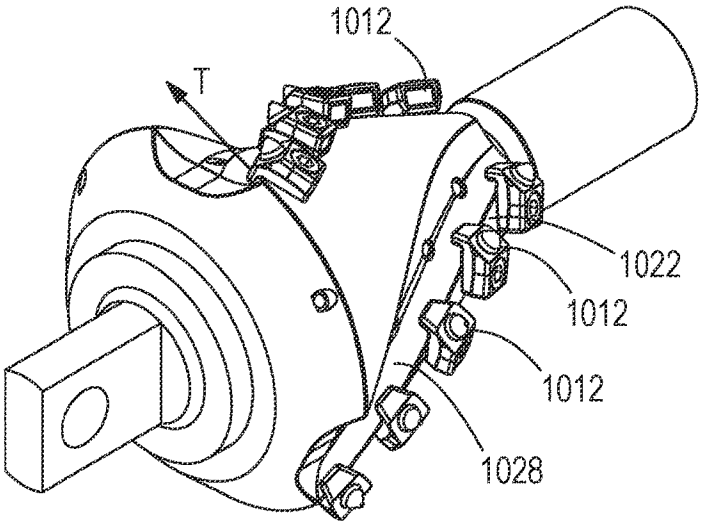
Figure 24C:
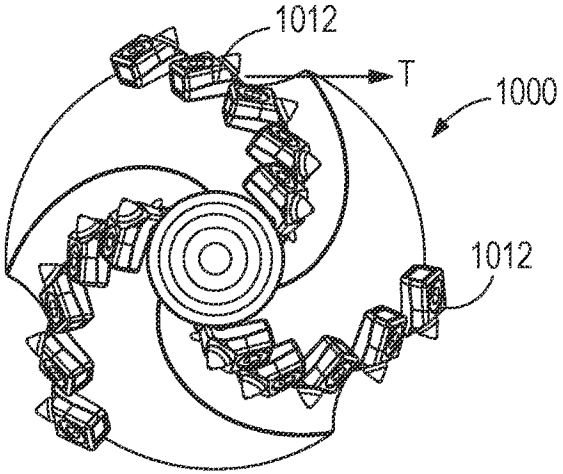

FIG. 23 represents side-by-side end views of all nine reamers 100, 200, 300, 400, 500, 600, 700, 800, 900 of the illustrated embodiments for the sake of comparison.

FIGS. 24A to 29B illustrate a number of additional HDD reamers that utilize removable cutter teeth, and many of the aspects of these reamers, the cutter teeth, and the mounting interfaces therebetween are similar to or the same as those already described with respect to the first nine embodiments. Thus, certain details are omitted below with the understanding that these aspects may conform to the preceding description. Although the first nine reamer embodiments cover a wide array of configurations and sizes, the reamer bodies have many similarities, and the focus of the additional six embodiments of FIGS. 24A to 29B is to illustrate an exemplary group of reamers having further divergent reamer base constructions, some of which may lack vanes altogether. Despite the drastically different reamer bases, these additional reamers 1000, 1100, 1200, 1300, 1400, 1500 each take advantage of individually-fastened, removable and replaceable cutter teeth where each cutter tooth has a cutting insert (e.g., polycrystalline diamond cutting inserts) manufactured separately from a cutter tooth body portion and joined therewith, such as by bonding and/or pressing.

In the construction of FIGS. 24A to 24D, the reamer 1000 has a reamer base that has a conical outer surface on which a plurality of helical interfaces are provided for a row of cutter teeth 1012. This style of reamer may be known in the industry as a "fluted" cutter, at least in terms of products made available from Vermeer Manufacturing Co. For example, the reamer 1000 has three flutes, but can have more or fewer in other constructions. The cutter tooth interfaces may be machined in the reamer base. The interfaces allow for the cutter teeth 1012 to fit along the individual flutes. Each cutter tooth 1012 is individually bolted to the reamer base. The fluted reamer base is a monolithic part in some constructions (e.g., a unitary casting with machined features). The radially outer first tooth base surfaces 1022 of the interface on the reamer base that support the teeth 1012 (i.e., bottom surface 1036 thereof, FIG. 30) are each formed by a continuous conical surface portion (following a helical path) rather than multiple flat, straight surfaces as in prior embodiments of the disclosure that feature straight, radially-projected vanes. Further, the second or forward-facing tooth base support surfaces 1028 on the reamer base that support the tooth back surfaces 1032 (FIG. 30) (which also follow the helical path) may have only a component facing in the tangential cutting direction T, as opposed to being arranged to face directly in the tangential cutting direction T. Because these cutter tooth support surfaces 1022, 1028 change orientation (both radial and circumferential position from tooth to tooth along the row) along the spiraling helix curve defining the flute, the tangential cutting direction T for each cutter tooth 1012 is not arranged in a straight row, but rather are staggered radially and circumferentially. The cutter teeth 1012 are shown in more detail in FIGS. 30A to 30G.

Figure 30A:
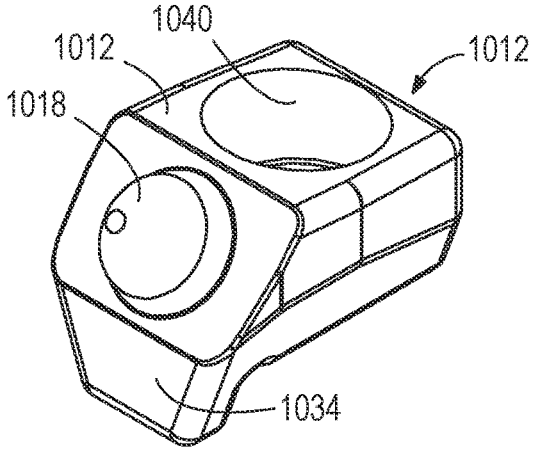
FIGS. 30A to 30G illustrate another type of removable cutter tooth used in the reamers of FIGS. 24 to 29.
Figure 30B:
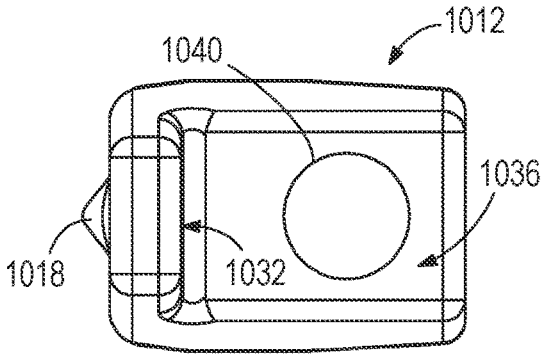
Figure 30C:
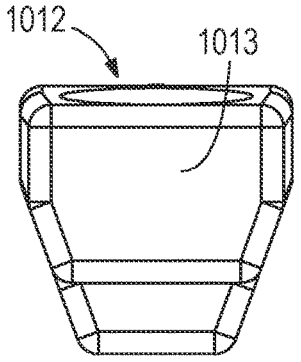
Figure 30D:
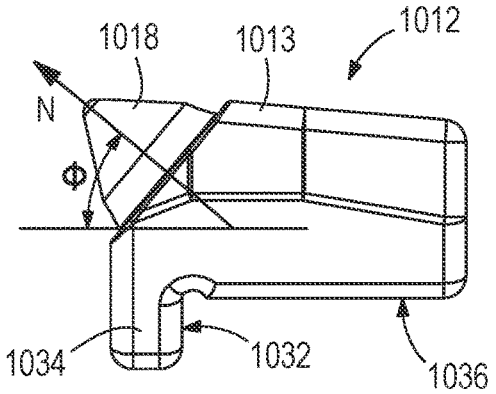
Figure 30E:
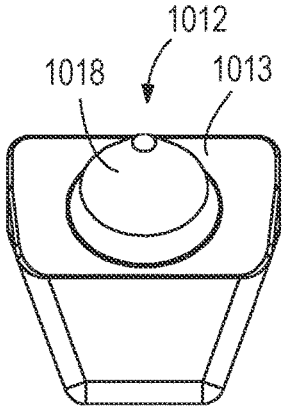
Figure 30F:
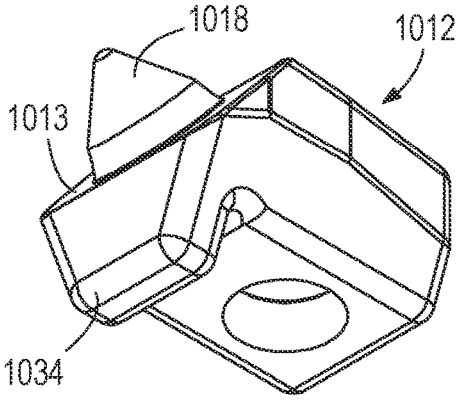
Figure 30G:
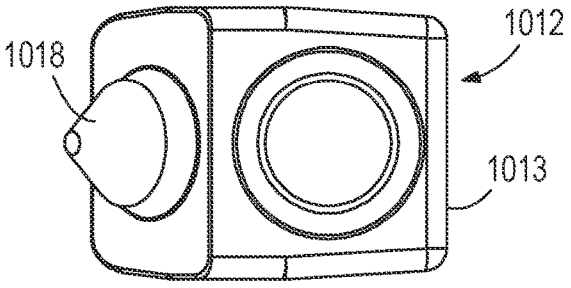
Figure 31A:
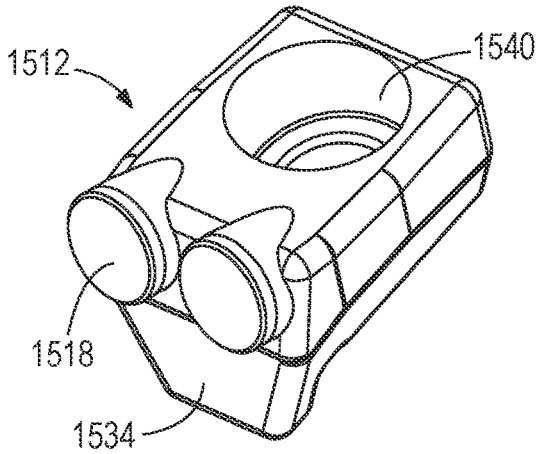
FIGS. 31A to 31F illustrate yet another type of removable cutter tooth used in the reamer of FIGS. 29A and 29B.
Figure 31B:
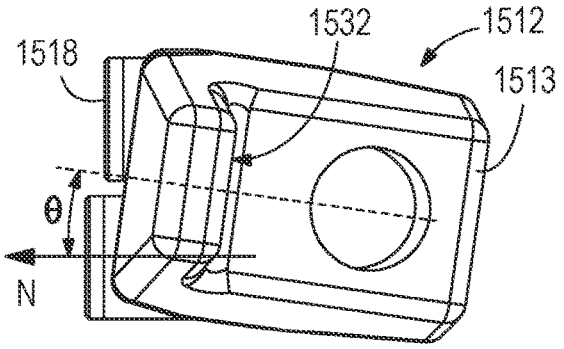
Figure 31C:
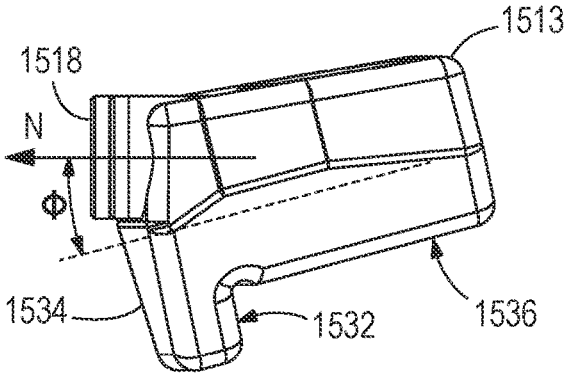
Figure 31D:
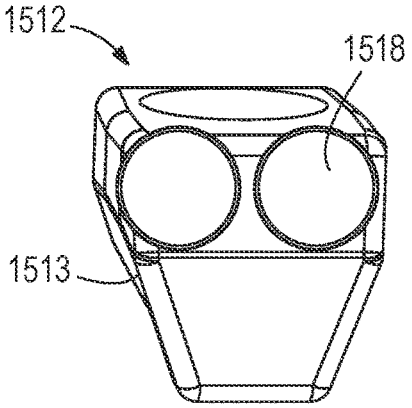
Figure 31E:
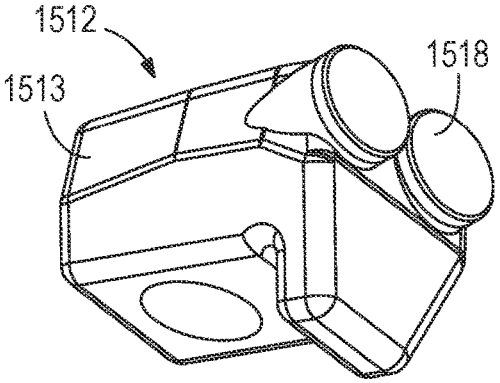
Figure 31F:
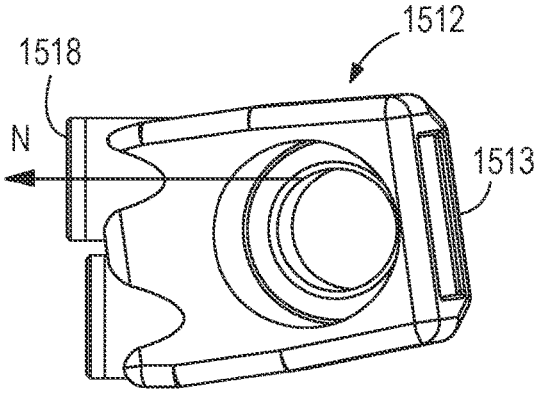

The cutter teeth 1012 have cutting portions 1018 formed as separate inserts on a cutter tooth body 1013. The cutting portions 1018 may be constructed of a harder material than a material of the cutter tooth body 1013. The inserts forming the cutting portions 1018 can be pointed carbide inserts (e.g., carbide "picks") although the fluted reamer base may alternately support one or more other types of cutter teeth. On the tooth body 1013, each cutting feature 1018 defines a normal surface vector N, taken at the tip such that the vector N is effectively the central axis of the conical shaped cutting portion. The normal surface vector N is arranged with a side rake angle Θ (FIG. 30A) and a back rake angle Φ (FIG. 30C). Without going into great detail and repeating portions of the preceding disclosure, the rake angles are defined similar to those of FIG. 4. However, it is noted that the cutting inserts 1018 are shown with a zero side rake angle. The side view of FIG. 30D is a true side view of both the body 1013 and the cutting insert, such that the normal surface vector N and the reference plane are accurately represented.

As will be appreciated from inspection of FIGS. 24A to 24D, the cutter teeth 1012 are mounted along the flutes of the reamer base such that some or all have unique effective side rake angle, despite the cutter teeth 1012 themselves having identical construction. Due to the continuously changing nature of the curve of the flute along the axial direction, each cutter tooth 1012 along a given flute has a side rake angle different from the adjacent cutter tooth or teeth 1012. As can best be seen in FIG. 24D, this results in side rake angles that are both positive and negative, or both forward and rearward with respect to the tangential cutting direction T, which is perpendicular to the central axis of rotation A at any given position along the flute. Depending on the nature of the surface 1028, effective back rake angles may also vary among the cutter teeth 1012 on a common flute.

Figure 25B:
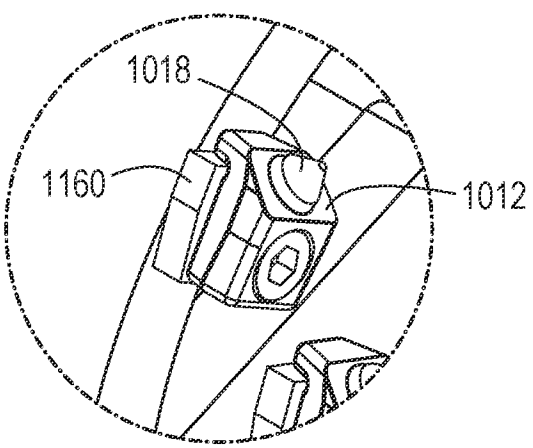
FIGS. 25A to 25D illustrate a eleventh reamer of the present disclosure.
Figure 25A:
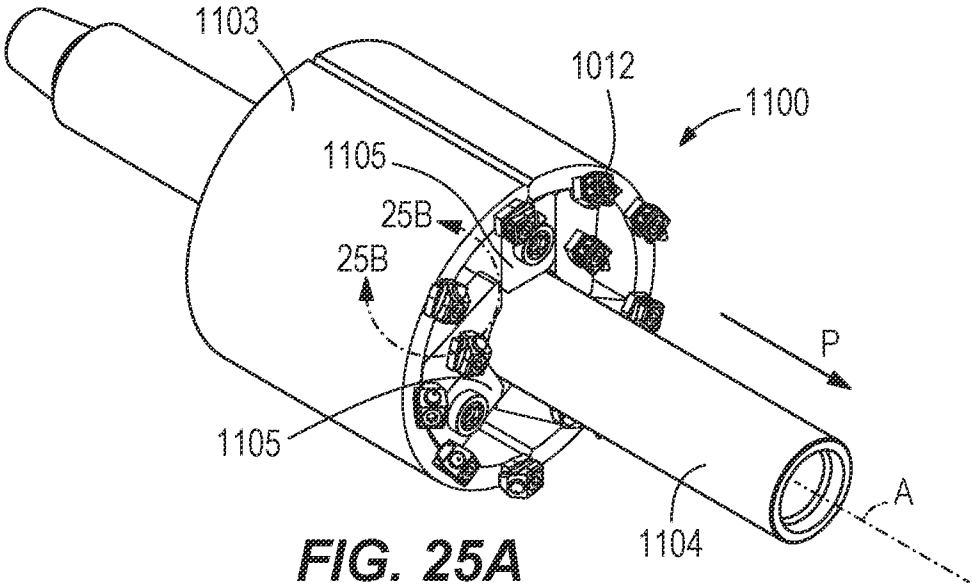
Figure 25D:
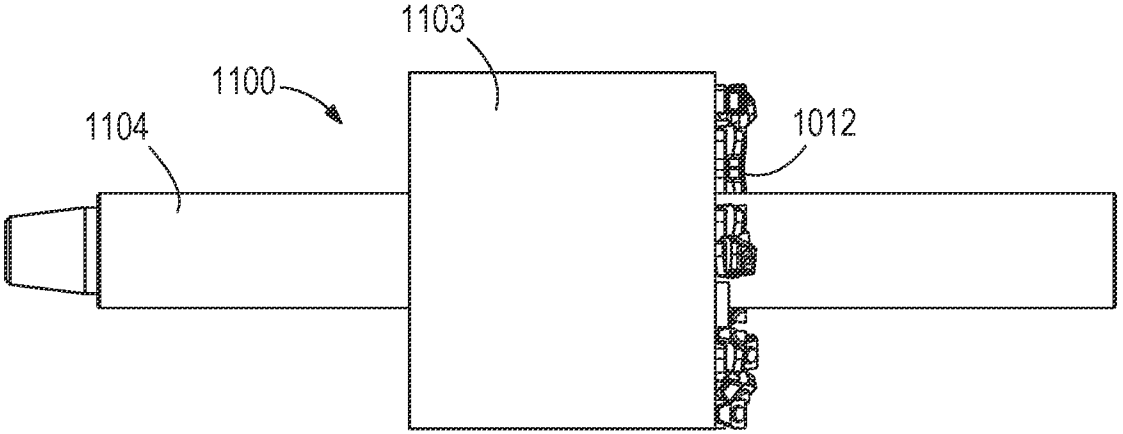
Figure 25C:
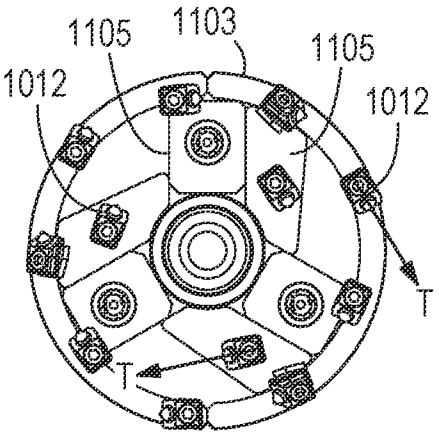
Figure 26A:
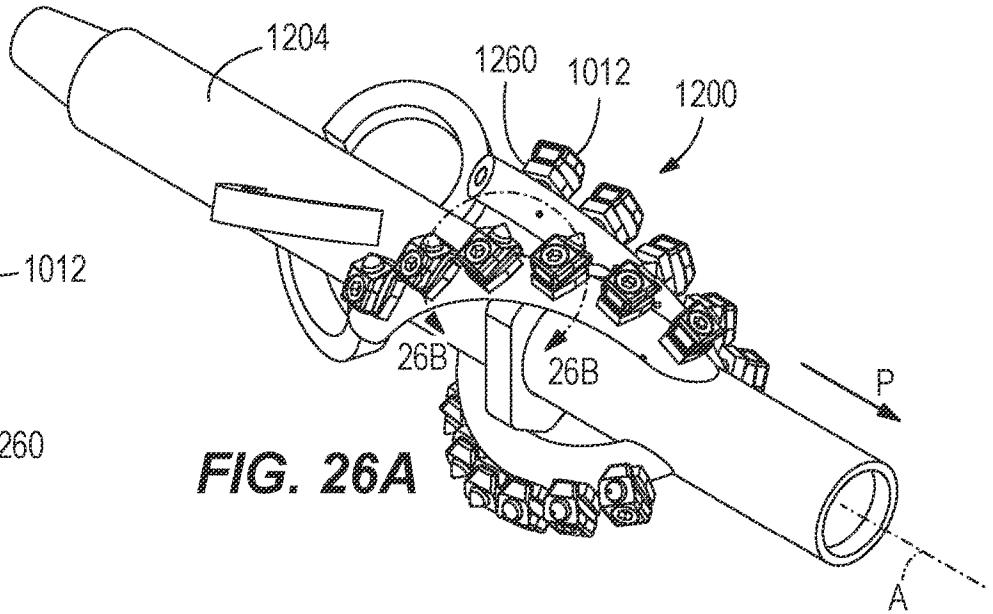
FIGS. 26A to 26D illustrate a twelfth reamer of the present disclosure.
Figure 26B:
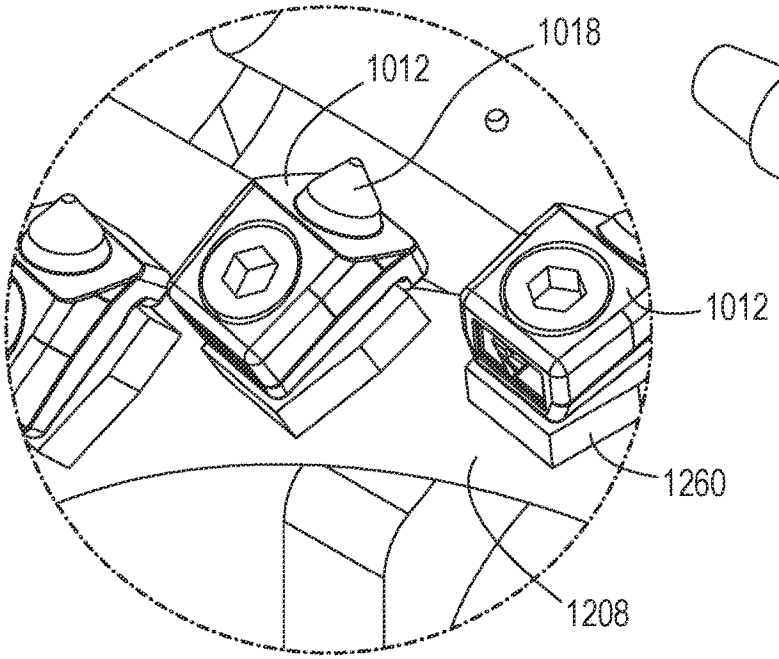
Figure 26D:
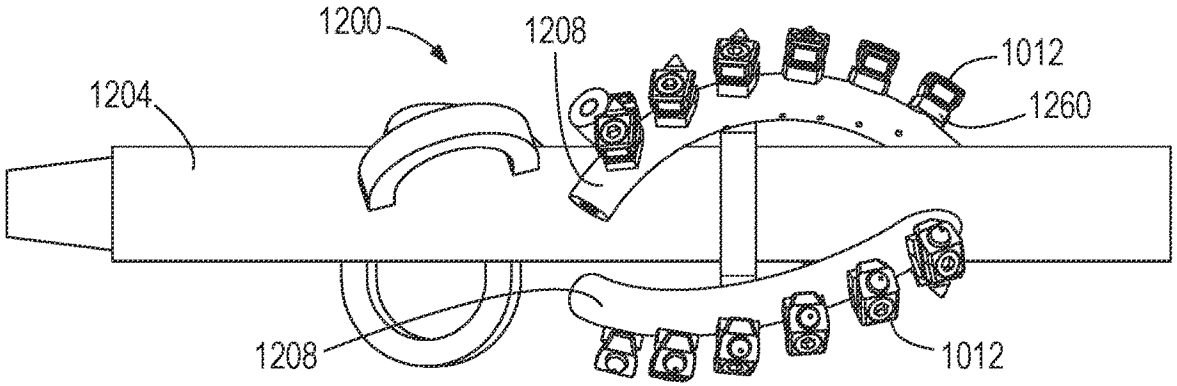
Figure 26C:
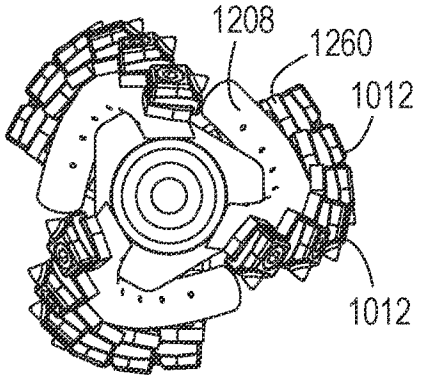
Figure 27A:
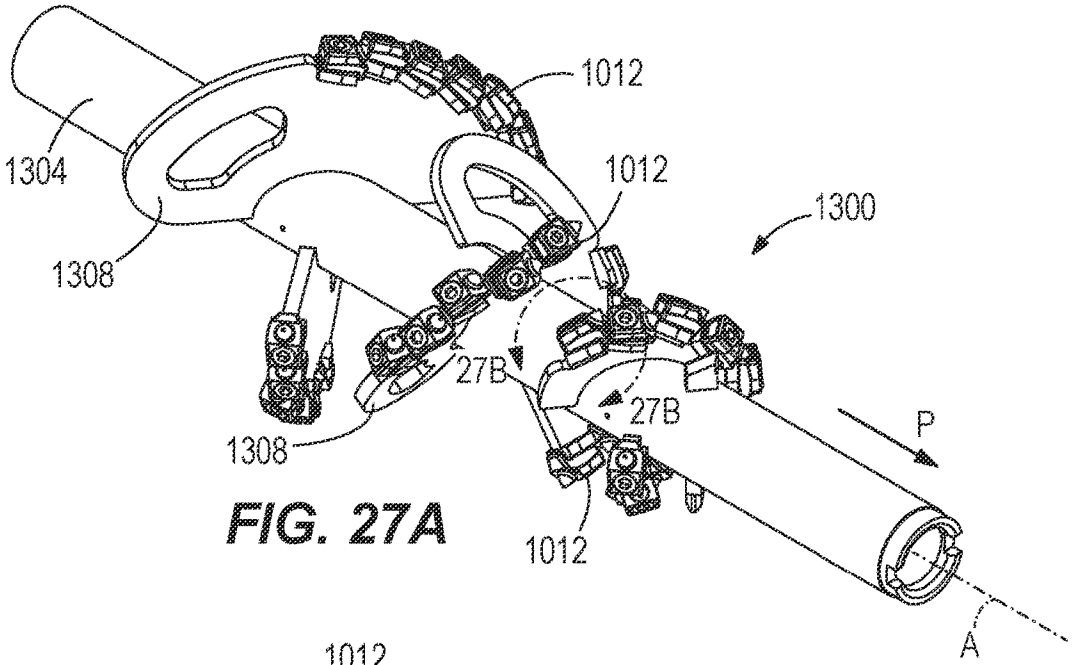
FIGS. 27A to 27D illustrate a thirteenth reamer of the present disclosure.
Figure 27B:
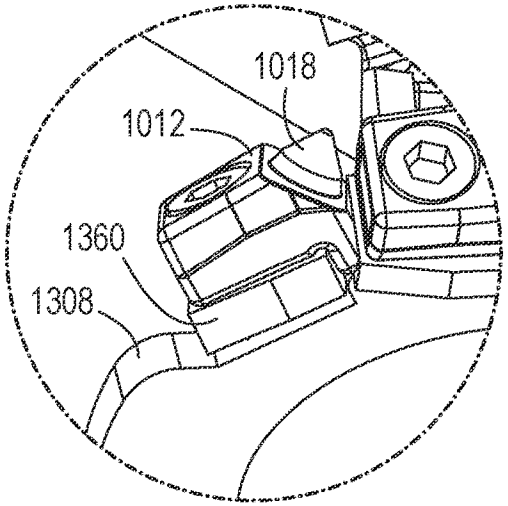
Figure 27D:
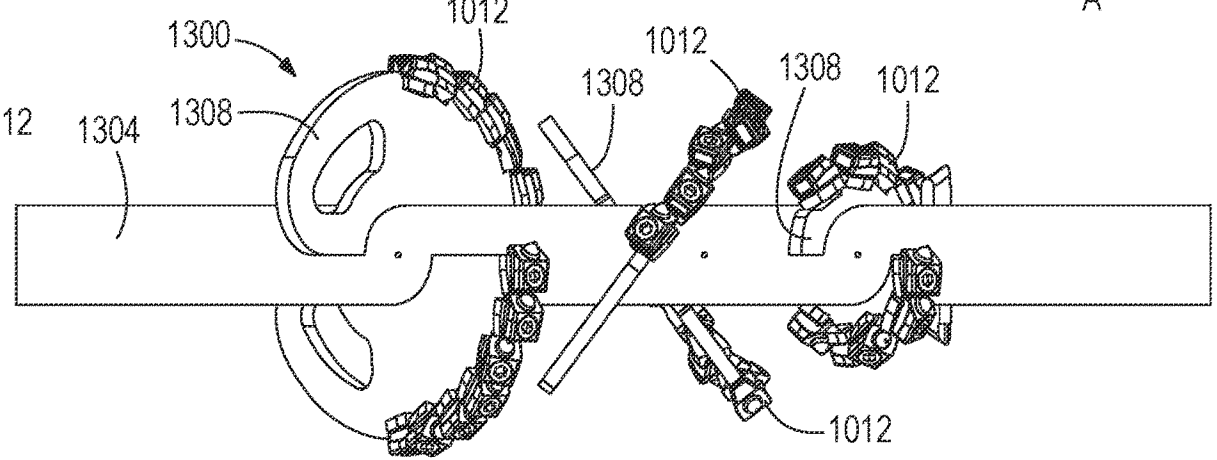
Figure 27C:
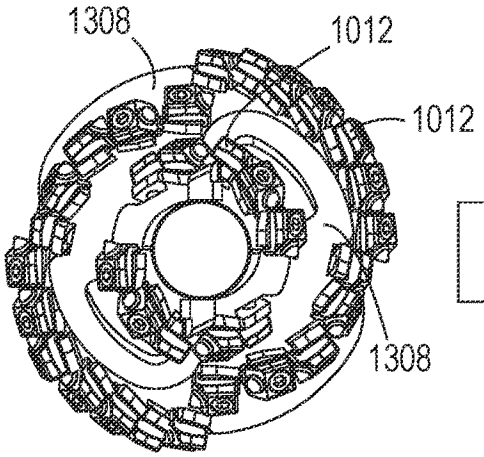

In the construction of FIGS. 25A to 25D, the reamer 1100 has face-mounted cutter teeth 1012 rather than tangential or perimeter-mounted cutter teeth. This style of reamer may be known in the industry as a "fly" cutter, at least in terms of products made available from Vermeer Manufacturing Co. The reamer 1100 provides yet another example of a replaceable cutting system where cutter teeth 1012 are fastened to the reamer body. The mounts 1160 may be welded on to the body of the reamer 1100. The mating interface for the cutter tooth 1012 is machined into the mount 1160. Each cutter tooth 1012 is independently bolted to a reamer body mount 1160. The fly cutter generally has a cylindrical outer portion 1103 attached to a central shaft 1104 by multiple plates 1105 (e.g., all these parts are welded together). The mounts 1160 can be provided on one or both of the cylindrical outer portion 1103 and the plates 1105 (forward surfaces thereof in the pullback direction P). As shown, the radial outer surface of the cylindrical outer portion 1103 is smooth and devoid of cutter teeth. As best shown in FIG. 25C, the outer cylindrical portion 1103 can be manufactured from two or more semi-cylindrical portions. Also, as shown in FIG. 25C, the cutter teeth 1012 can be mounted in a variety of orientations and dispersed across various radial positions. The cutter teeth 1012 can be mounted in any desired orientation, including some in which the cutting portions 1018 face tangentially (with or without back rake), and others at a positive or negative side rake angle with the tangential cutting direction T. Some or all of the cutter teeth 1012 can also be mounted with a side roll angle about the tangential cutting direction T (e.g., see every third cutter tooth 1012 mounted along the outer portion 1103). The cutter tooth 1012 can be the same as that described above with reference to FIGS. 24 and 30.

In the construction of FIGS. 26A to 26D, the reamer 1200 is yet another example of a replaceable cutter fastened to a reamer body. This style of reamer may be known in the industry as a "helical" cutter, at least in terms of products made available from Vermeer Manufacturing Co. The reamer 1200 can have a cutter tooth layout similar to the fluted reamer of FIG. 24, but may have mounts 1260 generally similar to the mounts 1160 of the fly cutter 1100 of FIG. 25. The reamer body of the helical cutter 1200 is unique from both the reamers 1000, 1100. The mounts 1260 may be welded on to the body of the reamer 1200. The mating interface for the cutter tooth 1012 is machined into the mount 1260, and the cutter tooth 1012 is bolted to the mount 1260. The helical reamer body is generally composed of bars 1208 shaped at least partially in a helical (e.g., spiraling or helix cone) configuration and welded to a central shaft 1204, with the cutter teeth 1012 mounted on the bars 1208 via the mounts 1260. The cutter tooth 1012 can be the same as that described above with reference to FIGS. 24 and 30.

In the construction of FIGS. 27A to 27D, the reamer 1300 is yet another example of a replaceable cutter fastened to a reamer body. This style of reamer may be known in the industry as a "Mix Master" cutter, at least in terms of products made available from Vermeer Manufacturing Co. The cutter teeth 1012 are secured to mounts 1360 generally similar to the mounts 1160 of fly cutter 1100 of FIG. 25, although the reamer body is significantly different as is the arrangement or layout of the cutter teeth 1012. The mount 1360 may be welded onto the body of the reamer 1300. The mating interface for the cutter tooth 1012 is machined into the mount 1360, and the cutter tooth 1012 is bolted to the mount 1360. The reamer body is generally made from a series of plates 1308 arranged in a helical pattern (e.g., spiraling helix) and welded to a central shaft portion 1304. The cutter teeth 1012 are mounted to the outer portion (e.g., peripheral edge) of each of the plates 1308. The plates 1308 are distributed along the axial direction so that they act progressively by having an increased radial dimension (right to left in FIG. 27D) for opening the pilot hole during pullback. At each axial position, there may be more than one plate 1308 (e.g., a pair of oppositely angled, crisscrossing plates). The cutter tooth 1012 can be the same as that described above with reference to FIGS. 24 and 30.

Figure 28A:
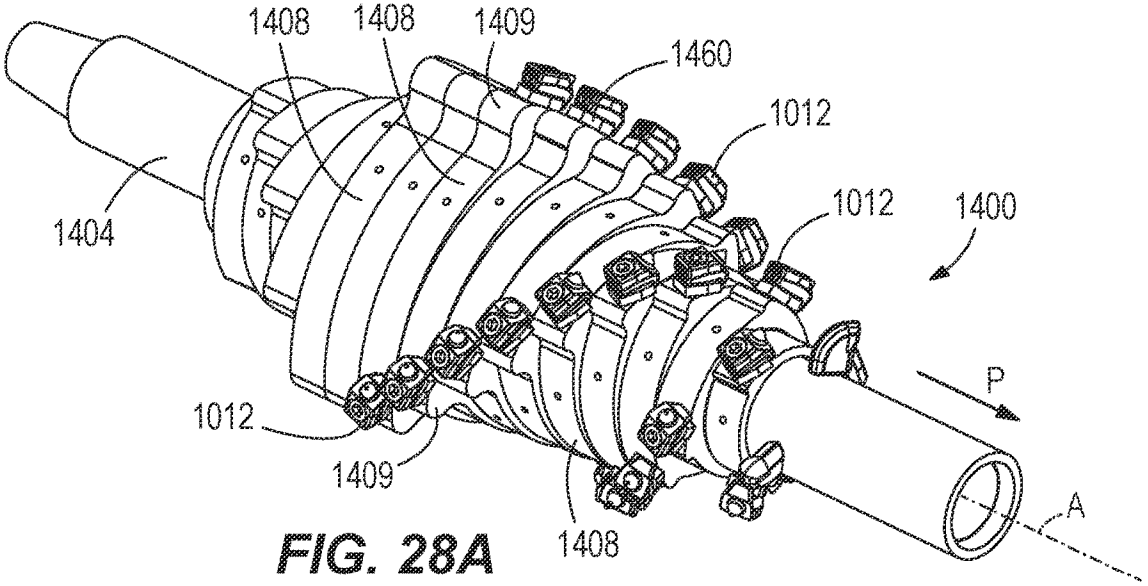
FIGS. 28A to 28C illustrate a fourteenth reamer of the present disclosure.
Figure 28B:
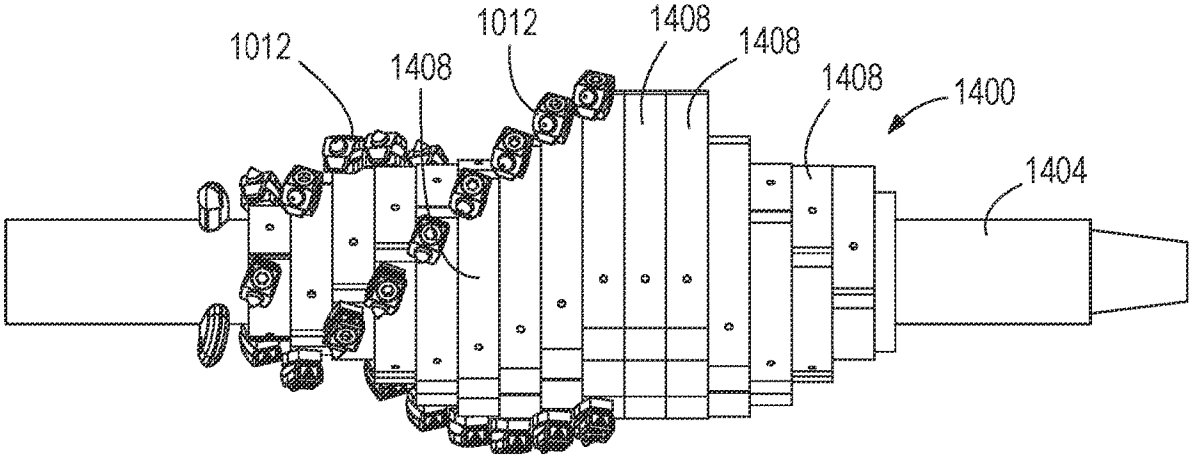
Figure 28C:
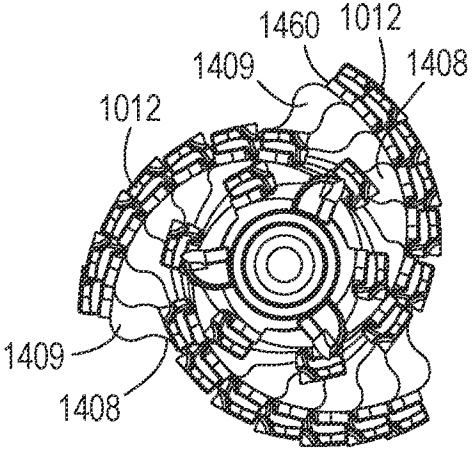

In the construction of FIGS. 28A to 28C, the reamer 1400 is yet another example of a replaceable cutter fastened to a reamer body. This style of reamer may be known in the industry as a "T-Rex" cutter, at least in terms of products made available from Vermeer Manufacturing Co. The cutter tooth layout is similar is some respects to those of preceding embodiments in that it defines a series (e.g., three) of helical tows of cutter teeth 1012. The reamer body is made from a series of axially-stacked plates 1408 that are welded to a central shaft 1404. The plates 1408 may be welded to each other. Each plate 1408 has one or more raised crown portions 1409 at a predetermined circumferential location(s), each raised crown portion 1409 including a cutter tooth mount 1460 similar to the mounts 1160 of the fly cutter 1100 of FIG. 25. Although the plates 1408 have a uniform axial thickness, without skew or side rake, side rake may be introduced by the orientation of the mount 1460 on some or all of the plates 1408. The cutter tooth 1012 can be the same as that described above with reference to FIGS. 24 and 30.

Figure 29A:
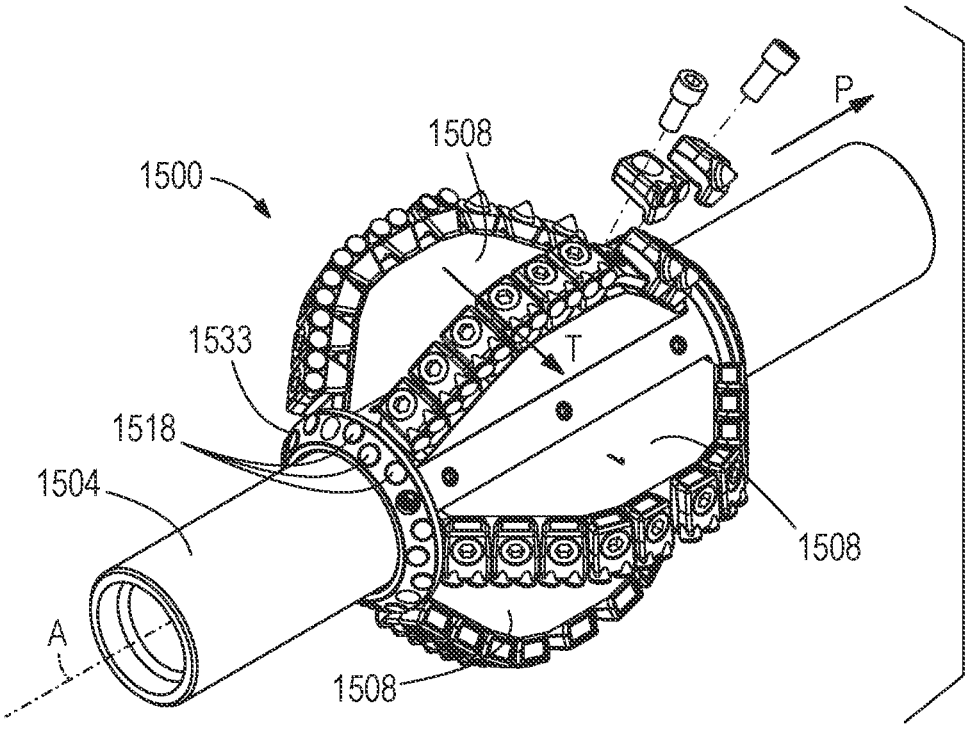
FIG. 29A is a perspective view of a fifteenth reamer of the present disclosure.
Figure 29B:
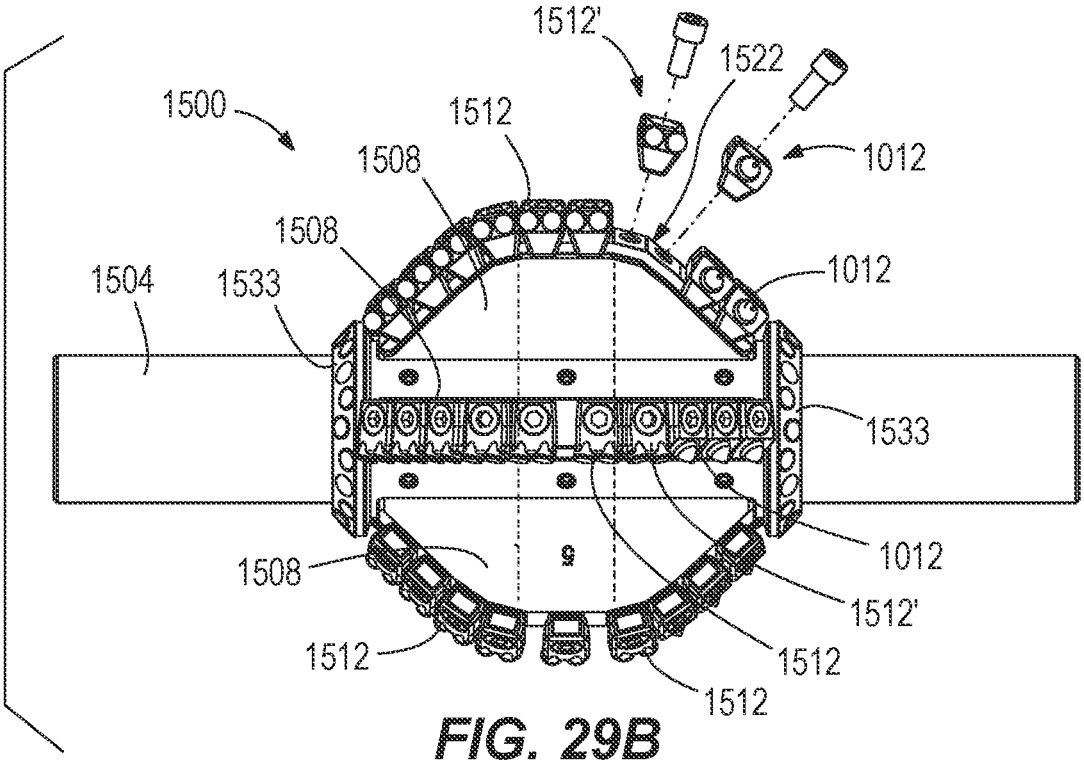
FIG. 29B is a side view of the reamer of FIG. 29A.

In the construction of FIGS. 29A and 29B, the reamer 1500 is yet another example of a replaceable cutter fastened to a reamer body. In the reamer 1500, straight axial vanes 1508 are provided (e.g., five), distributed circumferentially about the shaft portion 1504. Each vane 1508 projects radially, and the outer radial dimension varies along the axial direction. Thus, similar to several of the preceding embodiments, the first tooth base surface 1522 along the radially outer portion of each vane 1508 is subdivided into sections, which include front and rear angled surfaces and a central portion therebetween (i.e., between the vertical dashed reference lines in FIG. 29B) that is less angled or parallel to the axis A. As best shown in FIG. 29B, the surface 1522 also includes transition portions on either axial end of the central portion which is angled with respect to both axially adjacent surfaces. These transition portions can also support at least one cutter tooth 1512, 1512'. Along at least one axial portion of the first tooth base surface 1522 (e.g., the outermost central part), the positional arrangement of the cutter teeth 1512 may vary amongst circumferentially adjacent vanes 1508 so that, without resorting to numerous variations of cutter teeth, the path swept by one cutting insert 1518 is not followed exactly by another on the vane 1508 that follows in the rotation direction. As one particular example, looking at the three visible vanes 1508 in FIG. 29B, the bottom vane is the leading vane and has just one cutter tooth 1512 (centrally located) between the two dashed reference lines. The next vane 1508 is the middle vane vertically on the view and has two of the cutter teeth 1512 between the two dashed reference lines, the two cutter teeth 1512 being separated from each other axially by a gap. Finally, the third vane 1508 at the top of FIG. 29B includes two of the cutter teeth 1512 between the two dashed reference lines, the gap being reduced or eliminated compared to the preceding vane 1508.

In accordance with the preceding disclosure (e.g., reamer 100 of FIGS. 3F to 3H), a leading radially-outer edge of each vane 1508 is provided with an axially-extending notch or recess providing an additional cutter tooth support surface 1528 that faces the tangential direction T and provides support to back surfaces 1032, 1532 of the cutter teeth 1012, 1512, 1512'. Matching the configuration of the cutter tooth mounting surfaces, the support surface 1528 can be perpendicular to the radially outer tooth base surface 1522, although dovetail variants are also contemplated. At one or both axial ends of the vanes 1508, the reamer 1500 can include an additional collar 1533 supporting a plurality of additional cutting features 1518 (e.g., carbide, PDC, or combination) for cutting and improved wear/longer life. The collars 1533 are welded on or monolithically formed with the shaft portion 1504 and the vanes 1508. The vanes 1508 themselves can be welded onto the shaft portion 1504 or monolithically formed therewith. Although not required in all embodiments, the reamer 1500 (e.g., each vane 1508 thereof) supports at least two different types of cutter teeth 1012, 1512, 1512'. These can include both carbide picks 1012 like those of the preceding embodiments, plus at least one type of PDC cutter teeth (e.g., two different types of PDC cutters 1512, 1512' in the illustrated construction). The first type of PDC cutter 1512 is used along the downstream portion of each vane 1508 in the pullback direction P. The second type of PDC cutter 1512' is used between the first type 1512 and the carbide picks 1012. The different PDC cutter teeth 1512, 1512' can be similar to each other with the exception of rake (e.g., oppositely directed side rake angles).

As shown in FIG. 31A to 31F, the PDC cutter tooth 1512 has a body 1513 very similar to the body 1013 of the cutter tooth 1012 of FIG. 30 in that it extends substantially straight back from the front end rather than being sideswept. The back 1532 and side 1536 surfaces are perpendicular, but can be oriented differently if needed to match the surfaces 1522, 1528. The normal surface vector N is defined by the flat front surfaces of the PDC cutting inserts 1518. As in the preceding PDC embodiments, these are separately manufactured from the body 1513 and joined therewith, due to the very substantial material cost. In some constructions, the body 1513 can be a common casting that serves as a universal body for constructing different PDC cutter teeth 1512, 1512' having different normal surface vector orientation (e.g., the two illustrated variants having side rake in opposite directions).

The reamers of the present disclosure have several advantages over conventional reamers. For example, each reamer is rebuildable, and replacing the cutters is cheaper than replacing the entire reamer. The reamer is also repairable—in the event that an individual cutter is damaged, it can be replaced. The replaceable components of the reamers are smaller than the prior art, which reduces cost per repair component. Cutters can also be mixed/interchanged—different cutter patterns could be assembled using different style (cutting edges/surfaces/inserts) of cutters. This may be beneficial for certain soil/ground conditions. Similarly, the vanes could be changed. The reamer has a modular design (vanes and cutter can be changed). The diameter of the reamer can be changed by changing cutters—cutters can be different heights to allow for multiple hole diameters with one reamer base. Similarly, with detachable vanes, vanes of different heights can be swapped to achieve various diameters. Different cutters can also be used for different situations/conditions. For example, the rake angles can be different, the cutter insert can be different (PDC insert, carbide insert, blades, or a tooth). The disclosure can also provide a system of reamers with commonality of cutters—there could be a series of bases (for different applications and hole diameters) that use the same cutters. This can be an advantage to the customer, dealer, and manufacturer from a repair part perspective.

What is claimed is:

1. A reamer for reaming an underground passage during a drill string pullback operation of a horizontal directional drill, the reamer comprising:

a shaft portion defining a central axis and having a first end configured for attachment with a drill string of the horizontal directional drill;

a plurality of vanes extending radially from an outer periphery of the shaft portion, each of the plurality of vanes defining an outer peripheral tooth base surface; and on each of the plurality of vanes, a plurality of cutter teeth individually and removably secured along the outer peripheral tooth base surface thereof at different axial positions with respect to the central axis, wherein each one of the plurality of cutter teeth includes a body and a polycrystalline diamond compact (PDC) insert manufactured separately from the body and joined therewith;

wherein each cutter tooth of the plurality of cutter teeth is coupled to the respective one of the plurality of vanes by a removable fastener extending at least partially through the cutter tooth and at least partially through the one of the plurality of vanes, wherein each of the plurality of cutter teeth includes a first mounting surface configured to engage the outer peripheral tooth base surface, and a second mounting surface configured to engage an additional tooth support surface on one of the plurality of vanes, and wherein each cutter tooth of the plurality of cutter teeth has a foot that extends radially inward toward the central axis when mounted to the respective vane of the plurality of vanes, the foot providing the second mounting surface, which extends from the first mounting surface at an angle of 90 degrees or less.

2. The reamer of claim 1, wherein the plurality of vanes are monolithic extensions of the shaft portion.

3. The reamer of claim 1, wherein each one of the plurality of vanes is individually removable from the shaft portion by a plurality of fasteners.

4. The reamer of claim 1, wherein each of the plurality of cutter teeth includes a plurality of separate PDC inserts.

5. The reamer of claim 1, wherein the cutter tooth foot is configured to mount on a notch in one of the plurality of vanes, the notch being formed on a leading edge of the vane by the additional tooth support surface.

6. The reamer of claim 1, wherein the cutter tooth foot is configured to mount on a notch in one of the plurality of vanes, the notch being formed between respective leading and trailing edges of the vane.

7. The reamer of claim 1, wherein the foot of each cutter tooth of the plurality of cutter teeth includes an aperture configured to receive the corresponding fastener that extends tangentially through the cutter tooth and the vane.

8. The reamer of claim 1, wherein the fasteners extend radially through respective apertures in the plurality of cutter teeth to penetrate the first mounting surface thereof.

9. A reamer kit comprising:

the reamer of claim 1; and a second plurality of cutter teeth for replacing the plurality of cutter teeth and converting the reamer to an alternate cutting diameter.

10. A reamer kit comprising:

the reamer of claim 1, wherein the plurality of cutter teeth are a first plurality of cutter teeth and each exhibits a cutter tooth body rake angle; and a second plurality of cutter teeth for replacing the first plurality of cutter teeth and converting the reamer by providing each of the second plurality of cutter teeth with a cutter tooth body rake angle different from the cutter tooth body rake angle of the first plurality of cutter teeth.

11. A reamer kit comprising:

the reamer of claim 1, wherein the plurality of cutter teeth are a first plurality of cutter teeth and each exhibits a PDC cutter tip material by way of the PDC insert; and a second plurality of cutter teeth for replacing the first plurality of cutter teeth and converting the reamer by providing each of the second plurality of cutter teeth with a cutter tip material other than PDC.

12. A reamer kit comprising:

the reamer of claim 1, wherein the plurality of cutter teeth are a first plurality of cutter teeth and the PDC insert of each is provided alone or with at least one additional PDC insert on the body to provide a PDC insert arrangement defined by the number and positioning of the PDC insert(s) on the body; and a second plurality of cutter teeth for replacing the first plurality of cutter teeth and converting the reamer by providing each of the second plurality of cutter teeth with a body supporting one or more PDC inserts providing a PDC insert arrangement that differs from the PDC insert arrangement of the first plurality of cutter teeth in number and/or positioning of the PDC insert(s) on the bodies of the second plurality of cutter teeth.

13. A reamer for reaming an underground passage during a drill string pullback operation of a horizontal directional drill, the reamer comprising:

a shaft portion defining a central axis and having a first end configured for attachment with a drill string of the horizontal directional drill;

a plurality of vanes extending radially outward from an outer periphery of the shaft portion, each of the plurality of vanes defining an outer peripheral tooth base surface; and on each of the plurality of vanes, a plurality of cutter teeth individually and removably secured along the outer peripheral tooth base surface thereof at different axial positions with respect to the central axis;

wherein each cutter tooth of the plurality of cutter teeth has a first mounting surface configured to engage the outer peripheral tooth base surface and has a second mounting surface configured to engage an additional tooth support surface adjacent the outer peripheral tooth base surface; and wherein each cutter tooth of the plurality of cutter teeth is coupled to the respective one of the plurality of vanes by a removable fastener extending at least partially through the cutter tooth and at least partially through the vane, and wherein the first and second mounting surfaces are arranged at a 90-degree angle with respect to one another, and wherein the outer peripheral tooth base surface and the additional tooth support surface are arranged at a 90-degree angle with respect to one another.

14. The reamer of claim 13, wherein each of the plurality of vanes has an angled front surface in a pullback direction, at least some of the plurality of cutter teeth being positioned on the angled front surface.

15. The reamer of claim 13, wherein the plurality of cutter teeth include at least two different types of cutter teeth that vary in one or both of: directional arrangement and material of a cutting insert therein.

16. The reamer of claim 13, wherein each cutter tooth of the plurality of cutter teeth includes two to six inserts of polycrystalline diamond compact (PDC) material.

17. A reamer for reaming an underground passage during a drill string pullback operation of a horizontal directional drill, the reamer comprising:

a shaft portion defining a central axis and having a first end configured for attachment with a drill string of the horizontal directional drill;

a plurality of vanes extending radially outward from an outer periphery of the shaft portion, each of the plurality of vanes defining an outer peripheral tooth base surface; and on each of the plurality of vanes, a plurality of cutter teeth individually and removably secured along the outer peripheral tooth base surface thereof at different axial positions with respect to the central axis;

wherein each cutter tooth of the plurality of cutter teeth has a first mounting surface configured to engage the outer peripheral tooth base surface and has a second mounting surface configured to engage an additional tooth support surface adjacent the outer peripheral tooth base surface; and wherein each cutter tooth of the plurality of cutter teeth is coupled to the respective one of the plurality of vanes by a removable fastener extending at least partially through the cutter tooth and at least partially through the vane, wherein the first and second mounting surfaces are arranged at a less-than-90-degree angle with respect to one another, and wherein the outer peripheral tooth base surface and the additional tooth support surface are arranged at a less-than-90-degree angle with respect to one another such that the plurality of cutter teeth form a half-dovetail joint with the plurality of vanes.

* * * * *